US006444415B1

(12) United States Patent
Tanaka et al.

(10) Patent No.: US 6,444,415 B1
(45) Date of Patent: Sep. 3, 2002

(54) SILVER HALIDE LIGHT-SENSITIVE MATERIAL CONTAINING A SPECIFIC DYE

(75) Inventors: Shinri Tanaka; Dai Ikemizu, both of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/965,604

(22) Filed: Sep. 27, 2001

Related U.S. Application Data

(62) Division of application No. 09/409,030, filed on Sep. 29, 1999, now Pat. No. 6,342,340.

(30) Foreign Application Priority Data

Oct. 15, 1998 (JP) ..... 10-309493

(51) Int. Cl.[7] ..... G03C 1/825; G03C 1/498

(52) U.S. Cl. ..... 430/517; 430/510; 430/512; 430/522; 430/523; 430/619

(58) Field of Search ..... 430/619, 517, 430/523, 512, 510, 522

(56) References Cited

U.S. PATENT DOCUMENTS 5,312,722 A * 5/1994 Harada ..... 430/517

* cited by examiner

*Primary Examiner*—Thorl Chea
(74) *Attorney, Agent, or Firm*—Bierman, Muserlian and Lucas

(57) ABSTRACT

A thermally developable silver halide photographic light-sensitive material having a dye represented by formula (8), Formula (8)

wherein $X_1$ and $X_2$ each represents an oxygen atom, a sulfur atom, a selenium atom, or a tellurium atom; $R_5$ and $R_6$ each represents a hydrogen atom or an alkyl group; $R_7$ and $R_8$ each represents a monovalent substituents, and plural $R_7$ and plural $R_8$ may form a ring structure with each other; m and n each represents an integer of 0 to 4.

17 Claims, No Drawings

SILVER HALIDE LIGHT-SENSITIVE MATERIAL CONTAINING A SPECIFIC DYE

CROSS REFERENCE TO RELATED APPLICATIONS

This Application is a Divisional Application of U.S. application Ser. No. 09/409,030 filed Sep. 29, 1999, now U.S. Pat. No. 6,342,340.

FIELD OF THE INVENTION

The present invention relates to thermally developable light-sensitive material comprising a specific dye, a silver halide light-sensitive material comprising said specific dye, an image forming method using the same, a filter comprising said specific dye, and a support comprising said specific dye usable for a silver halide photosensitive material.

BACKGROUND OF THE INVENTION

In exposing a light-sensitive material to light, incident light is reflected or refracted by a silver halide, other additives, or at a layer interface, and as a result, the image dims and resolution degrades. In order to prevent such resolution degradation, an anti-halation (AH) dye or an anti-irradiation (AI) dye have been widely employed.

Conventionally, necessary characteristics of these AH and AI dyes are the following: they absorb a desired wavelength of light; they do not give an adverse effect to a silver halide emulsion; and they completely decolor or leach out of a photosensitive material so as not to leave any residual color stain in said photosensitive material.

In recent years, the trend toward more and more rapid developing processes and a dry developing process have been marked, and color stain derived from these dyes after processing a light-sensitive material, namely, residual color stain, has received much study. Therefore, reducing said residual color stain has been strongly demanded. Specifically, in the case of a dry process, using no water, in which dyes can not leach out of said photosensitive material, said residual color stain tends to become critical, therefore, reducing said residual color stain has become a point of focus.

Representative AI and AH dyes which can absorb infrared rays are organic dyes, and many such organic dyes have been suggested. Among them, specifically used have been cyanine and oxonol dyes. However, absorption in the visible region of these dyes is relatively large, and these dyes are also marginal effectiveness in preventing said residual color stain, since decomposed compounds derived from these dyes absorb yellow light. Further, these compounds are relatively unstable and decomposable, and still further, synthesizing these compounds is relatively expensive.

The solubility of squarylium dye and croconium dye in an organic solvent is, in general, relatively low, therefore, additon of these dyes into a silver halide photographic light-sensitive material is very challenging. Further, since spectral absorption characteristics of these dyes, in the form of a dispersion, tend to vary, reducing the sectral absorption characteristics has been demanded.

A thermally developable photographic light-sensitive material comprising a squarylium dye having a naphthalene ring is disclosed in Japanese Patent Publication to Public Inspection under PCT Application No. 9-509503, as well as in Japanese Patent Publication Open to Public Inspection (hereinafter referred to as JP-A) Nos. 8-262986, 10-236695, 10-104779, 10-158253 and 10-204310, however, these dyes are tinged with yellow, and therefore, their residual color stain is unacceptable. Furthermore, heat stability of these dyes is also unacceptable, so that storage stability of these dyes, used in a light-sensitive material is also critical. An image forming method described in JP-A No. 10-24654 is one in which an image is formed directly merely by exposing a light-sensitive material to infrared rays (thermally dye forming), however, said method does not refer to an image forming method in which a light-sensitive, material is exposed to light to form a latent image, and said light-sensitive material, in which said latent image is formed, must be subjected to thermal development so as to form an visible image. The present inventive employees have made a great effort to solve the above-mentioned problems and finally found a way to obtain "a blue-black tone" of a formed silver image which is desired to be applicable to a direct appreciation or the medical diagnosis. Solubility of S-1 and S-4 described in JP-A No. 10-24654 is relatively low in organic solvents, since these dyes have four hydroxy groups in their molecules, and therefore, sufficient antihalation and antiirradiation effect can not be obtained. Dyes described in JP-A Nos. 10-36695 and 10-158253 are difficult to commercially produce. Solubility of dyes described in JP-A 10-104779 in an organic solvent is relatively low and the cost for producing them is relatively expensive.

Squarylium dye having a thiopyrylium nucleous (being termed thiopyryliumsquarylium dye in the present invention, while squarylium dye having pyrylium nucleous is termed pyryliumsquarylium dye) is described in U.S. Pat. Nos. 4,508,811, and 5,667,943. However, these patents do not propose nor suggest that said thiopyryliumsquarylium dye can be applied to a silver halide photosensitive material.

SUMMARY OF THE INVENTION

An object of the present invention is to provide a thermally developable photographic light-sensitive material and a silver halide photographic light-sensitive material, capable of producing various preferable photographic characteristics of a formed image, such as a silver image of excellent resolution, less residual color stain, preferable blue-black silver image tone, excellent image stability when stored over a long period of time, employing a dye which is excellent in solubility in an organic solvent, and finally, one which exhibits desirable dispersibility in the form of a solid dispersion or an oil dispersion. Another object of the present invention is to provide a thermally developable photographic light-sensitive material as well as a silver halide photographic light-sensitive material, which are suitably applicable to a dry process by employing said dye, cited above, and an image forming method by which said thermally developable photographic light-sensitive material and said silver halide photographic light-sensitive material are processed, and further, an optical filter having preferable characteristics provided by employing said dye, and still further, a support for a silver halide light-sensitive material provided, employing said dye.

DETAILED DESCRIPTION OF THE INVENTION

The above-mentioned objects of the present invention are attained by the following constitution.

(1) A silver halide photographic light-sensitive material comprising a dye represented by the following formula (1) or formula (2):

Formula (1)

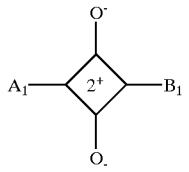

Formula (2)

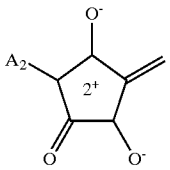

wherein $A_1$ and $B_1$ each represent substituents other than a naphthalene group; and $A_2$ and $B_2$ represent substituents.

(2) The silver halide photographic light-sensitive material of item 1, wherein said dye represented by said formula (1) or said formula (2) is a dye represented by the following formula (3) or formula (4):

Formula (3)

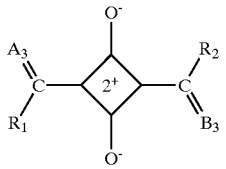

Formula (4)

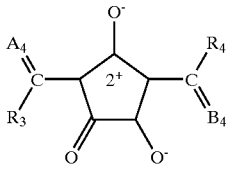

wherein $R_1$, $R_2$, $R_3$ and $R_4$ each represent a hydrogen atom or an alkyl group; each of $A_3$, $B_3$, $A_4$ and $B_4$ is symmetrical so that a structure obtained by rotating each of $A_3$, $B_3$, $A_4$ and $B_4$ by 180 degrees around the bond connecting each of $A_3$, $B_3$, $A_4$ and $B_4$ with a carbon atom attached to each of $A_3$, $B_3$, $A_4$ and $B_4$ leads to the same structure as each original structure of $A_3$, $B_3$, $A_4$ and $B_4$; the sum total of hydroxy group contained in $A_3$ and $B_3$ is 0 or 1; and the sum total of hydroxy group contained in $A_4$ and $B_4$ is 0 or 1.

(3) The silver halide photographic light-sensitive material of item 2, wherein said dye represented by said formula (3) or said formula (4) is a dye represented by the following formula (5) or formula (6):

Formula (5)

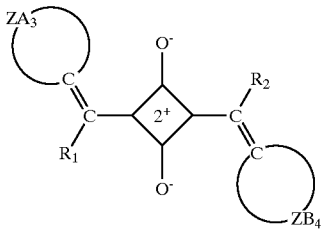

-continued

Formula (6)

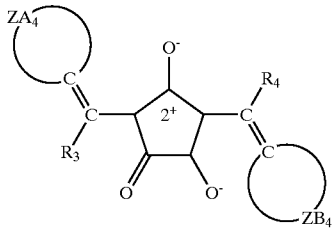

wherein $R_1$, $R_2$, $R_3$ and $R_4$ each represent a hydrogen atom or an alkyl group; ZA3, ZB3, ZA4 and ZB4 each represent a group of atoms necessary for forming a 6-membered heterocyclic ring with a carbon atom.

(4) The silver halide photographic light-sensitive material of item 1, wherein said dye is represented by said formula (1).

(5) The silver halide photographic light-sensitive material of item 1, wherein said dye is represented by said formula (2).

(6) The silver halide photographic light-sensitive material of item 5, wherein said dye is represented by the following formula (11).

Formula (11)

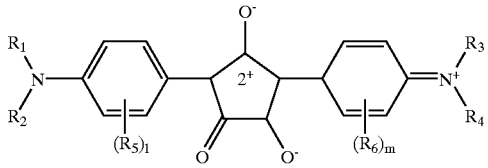

wherein $R_1$, $R_2$, $R_3$ and $R_4$ each represent an alkyl group on which an acidic substituent does not substitute; $R_5$ and $R_6$ each represent a monovalent substituent; and 1 and m each are an integer of 0 to 4.

(7) The silver halide photographic light-sensitive material of item 6, wherein at least one of $R_1$, $R_2$, $R_3$ and $R_4$ of said formula (11) is an alkyl group substituted with an alkoxy group, or an alkyl group having at least five carbon atoms.

(8) The silver halide photographic light-sensitive material of item 1, wherein said silver halide photographic light-sensitive material is exposed to light to form a latent image, and said silver halide photographic light-sensitive material, in which said latent image is formed, is followed by being subjected to thermal development so as to substantially form an image.

(9) The silver halide photographic light-sensitive material of item 1, wherein said silver halide photographic light-sensitive material comprises a component layer containing said dye represented by said formula (1) or said formula (2), and a water-soluble binder.

(10) The silver halide photographic light-sensitive material of claim 9, wherein said silver halide photographic light-sensitive material comprises a component layer containing said dye represented by said formula (1), and said water-soluble binder.

(11) The silver halide photographic light-sensitive material of item 10, wherein said component layer, containing said dye represented by said formula (1) and said water-soluble binder, is spectrally sensitized to the wavelength region of 600 nm to 700 nm.

(12) The silver halide photographic light-sensitive material of item 1, wherein said silver halide photographic light-sensitive material comprises a hydrazine compound.

(13) The silver halide photographic light-sensitive material of item 1, wherein said silver halide photographic light-sensitive material comprises said dye, represented by said formula (1) or said formula (2), in the form of a solid dispersion or an oil dispersion.

(14) The silver halide photographic light-sensitive material of item 9, wherein said component layer, containing said dye represented by said formula (1) or said formula (2) and said water-soluble binder, is spectrally sensitized to the wavelength region of 600 nm to 900 nm.

(15) A silver halide light-sensitive material comprising at least a dye selected from a group consisting of thiopyryliumsquarylium dye, thiopyryliumcroconium dye, pyryliumsquarylium dye, pyryliumcroconium dye, selenapyryliumsquarylium dye, selenapyryliumcroconium dye, telluropyryliumsquarylium dye, and telluropyryliumcroconium dye.

(16) The silver halide light-sensitive material of item 15, wherein said dye, selected from said group consisting of thiopyryliumsquarylium dye, thiopyryliumcroconium dye, pyryliumsquarylium dye, pyryliumcroconium dye, selenapyryliumsquarylium dye, selenapyryliumcroconium dye, telluropyryliumsquarylium dye, and telluropyryliumcroconium dye, has a molecular nucleus represented by the following formula (7):

Formula (7)

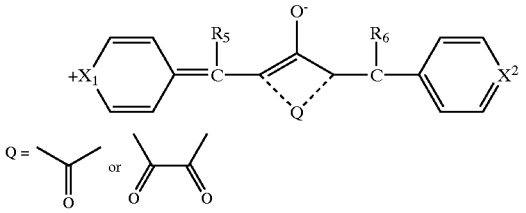

wherein $X_1$ and $X_2$ represent an oxygen atom, a sulfur atom, a selenium atom or tellurium atom; $R_5$ and $R_6$ represent a hydrogen atom and an alkyl group.

(17) The silver halide light-sensitive material of item 16, wherein said formula (7) is represented by the following formula (8):

Formula (8)

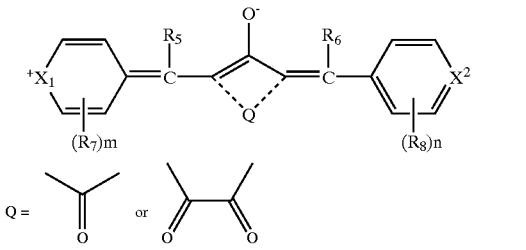

wherein $X_1$ and $X_2$ represent a oxygen atom, a sulfur atom, a selenium atom or tellurium atom; $R_5$ and $R_6$ represent a hydrogen atom and an alkyl group; $R_7$ and $R_8$ represent a monovalent substituent, and plural $R_7$ and plural $R_8$ may form a ring structure with each other; m and n represent an integer of 0 to 4.

(18) The silver halide light-sensitive material of item 15, wherein said silver halide light-sensitive material comprises a component layer containing at least a dye selected from said group consisting of thiopyryliumsquarylium dye, thiopyryliumcroconium dye, pyryliumsquarylium dye, pyryliumcroconium dye, selenapyryliumsquarylium dye, selenapyryliumcroconium dye, telluropyryliumsquarylium dye, and telluropyryliumcroconium dye, and further containing a water-soluble binder.

(19) The silver halide light-sensitive material of item 15, wherein said silver halide light-sensitive material comprises at least a dye selected from said group consisting of thiopyryliumsquarylium dye, thiopyryliumcroconium dye, pyryliumsquarylium dye, pyryliumcroconium dye, selenapyryliumsquarylium dye, selenapyryliumcroconium dye, telluropyryliumsquarylium dye, and telluropyryliumcroconium dye, in the form of a solid dispersion or an oil dispersion.

(20) The silver halide light-sensitive material of item 15, wherein said silver halide light-sensitive material comprises a hydrazine compound.

The present invention will now be detailed below.

First, a dye represented by the formula (1) will be explained.

In a dye represented by the formula (1), $A_1$ and $B_1$ each represent substituents other than a naphthalene group. Examples of $A_1$ and $B_1$ include an alkyl group, an alkenyl group, a cycloalkyl group, a phenyl group or a heterocyclic group, while preferable examples of $A_1$ and $B_1$ include an alkenyl group, a phenyl group and a heterocyclic group, with the most preferable example being an alkenyl group.

A dye represented by the formula (2) will be explained below.

In a dye represented by the formula (2), $A_2$ and $B_2$ each represent substituents. Examples of $A_2$ and $B_2$ include an alkyl group, an alkenyl group, a cycloalkyl group, an aryl group and a heterocyclic group, and preferable examples of $A_2$ and $B_2$ include an alkenyl group, an aryl group and a heterocyclic group. Most preferable example is an alkenyl group.

Dyes represented by the formulas (3) and (4) will be explained below.

In dyes represented by said formulas (3) and (4), each of $A_3$, $B_3$, $A_4$ and $B_4$ is symmetrical form so that a structure obtained by rotating each of $A_3$, $B_3$, $A_4$ and $B_4$ 180 degrees around the bond connecting each of $A_3$, $B_3$, $A_4$ and $B_4$ with a carbon atom attached to each of $A_3$, $B_3$, $A_4$ and $B_4$ leads to the same structure as each original structure of $A_3$, $B_3$, $A_4$ and $B_4$, with the preferable structure for each of $A_3$, $B_3$, $A_4$ and $B_4$ being a 6-membered monoheterocyclic ring. The sum total of hydroxy group contained in $A_3$ and $B_3$ is 0 or 1; the sum total of hydroxy group contained in $A_4$ and $B_4$ is also 0 or 1, while the sum total of hydroxy group contained in $A_3$ and $B_3$, or $A_4$ and $B_4$ is preferably 0.

Dyes represented by the formula (5) and formula (6) will be explained.

In the formula (5) and formula (6), $R_1$, $R_2$, $R_3$ and $R_4$ each represent a hydrogen atom or an alkyl group; ZA3, ZB3, ZA4 and ZB4 each represent a group of atoms necessary for forming a 6-membered heterocyclic ring with a carbon atom, and said formed 6-membered heterocyclic ring is preferably a 6-membered monoheterocyclic ring containing one hetero-atom in said 6-membered monoheterocyclic ring. Preferable examples of hetero-atoms are a nitrogen atom or a sulfur atom.

In the present invention, thiopyryliumsquarylium dye, thiopyryliumcroconium dye, pyryliumsquarylium dye, pyryliumcroconium dye, selenapyryliumsquarylium dye, selenapyryliumcroconium dye, telluropyryliumsquarylium dye, and telluropyryliumcroconium dye have a thiopyrylium nucleus, a pyrylium nucleus and a squarylium dye, a croconium dye, a selenapyrylium dye and a telluropyrylium dye.

A compound having a squarylium nucleus is a compound having 1-cyclobutene-2-hydroxy-4-one in its molecular structure, and a compound having a croconium nucleus is a compound having 1-cyclopentene-2-hydroxy-4,5-dione. Herein, a hydroxy group may be dissociated.

Formula (7) of the present invention represents only a mother nucleus which may be substituted with an appropriate substituent.

In the formula (8) of the present invention, $R_7$ and $R_8$ each represent a monovalent substituent. Examples of said monovalent substituent are not specifically limited, but preferable are an alkyl group (for example, a methyl group, an ethyl group, an iso-propyl group, a tert-butyl group, a methoxyethyl group, a methoxyethoxyethyl group, a 2-ethylhexyl group, a 2-hexyldecyl group, a benzyl group), or an aryl group (for example, a phenyl group, a 4-chlorophenyl group, a 2,6-dimethylphenyl group), while more preferable is an alkyl group, and most preferable is a tert-butyl group. $R_7$ and $R_8$ may also form a ring with each other. m and n each represent an integer of 0 to 4, and each of m and n is preferably not more than 2.

Exemplified dyes used in the present invention are illustrated below, but the present invention is not limited thereto.

Exemplified compound (1)-1

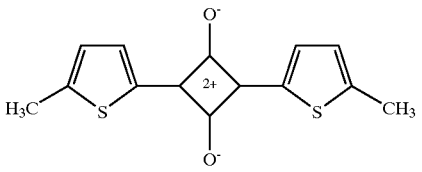

Exemplified compound (1)-2

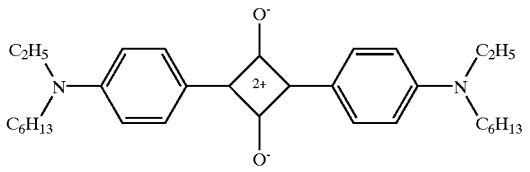

Exemplified compound (1)-3

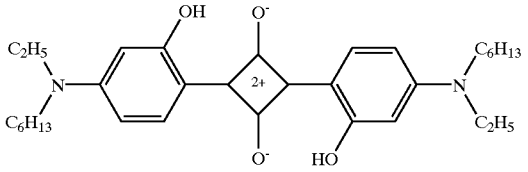

Exemplified compound (1)-4

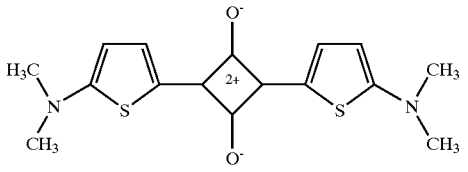

Exemplified compound (1)-5

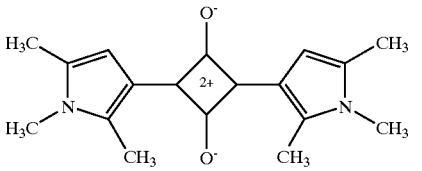

Exemplified compound (1)-6

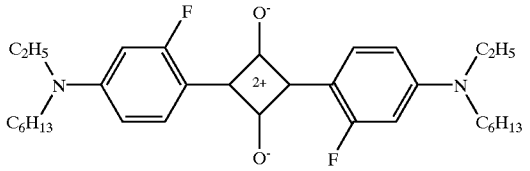

Exemplified compound (1)-7

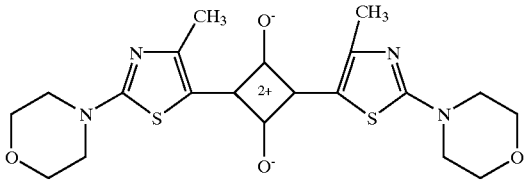

Exemplified compound (1)-8

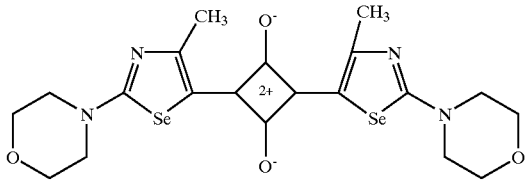

Exemplified compound (1)-9

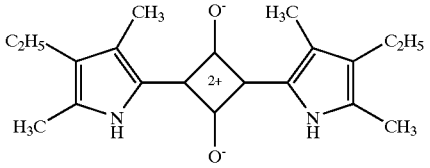

Exemplified compound (1)-10

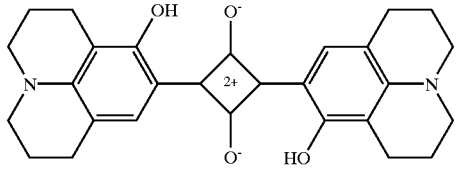

-continued
Exemplified compound (1)-11
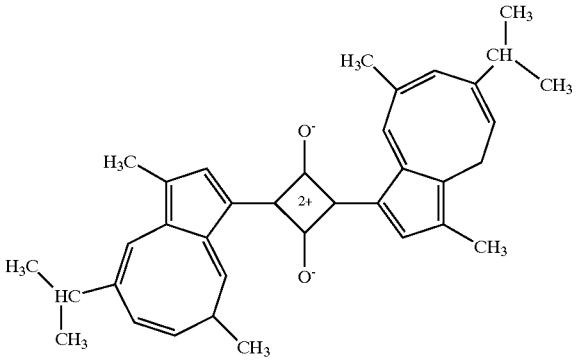
Exemplified compound (1)12
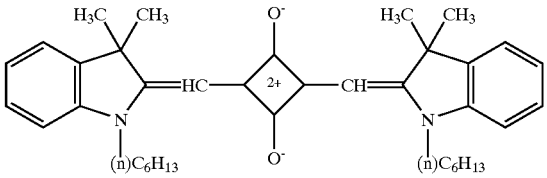
Exemplified compound (1)-13
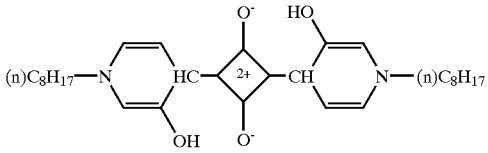
Exemplified compound (1)-14
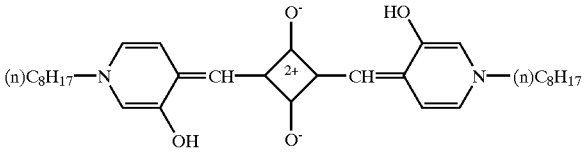
Exemplified compound (1)-15
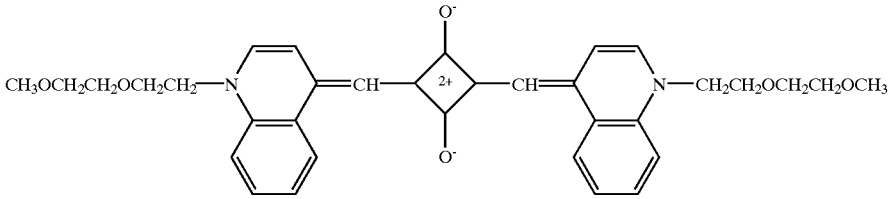
Exemplified compound (1)-16
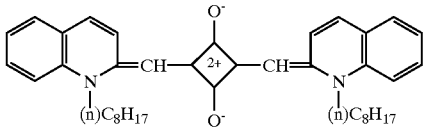
Exemplified compound (1)-17
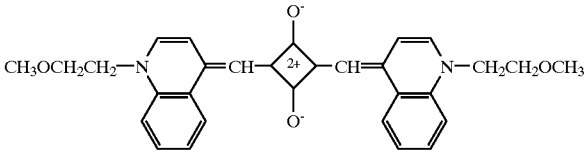
Exemplified compound (1)-18
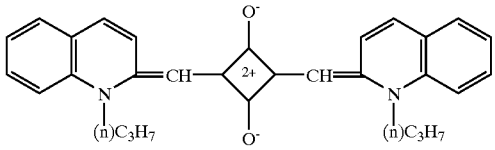
Exemplified compound (1)-19
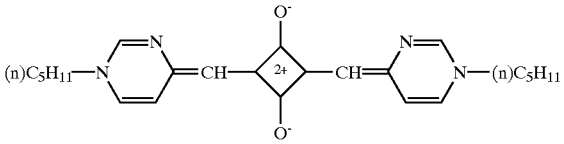
Exemplified compound (1)-20
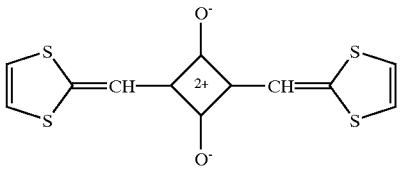
Exemplified compound (1)-21
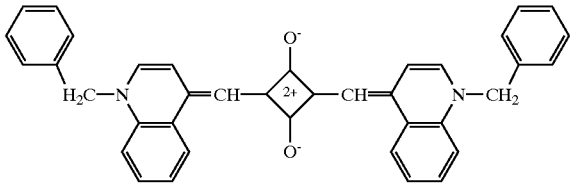
Exemplified compound (1)-22
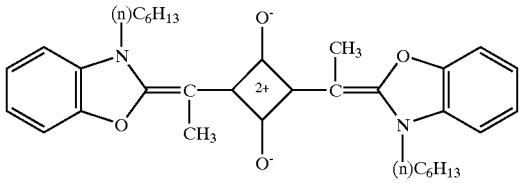
Exemplified compound (1)-23
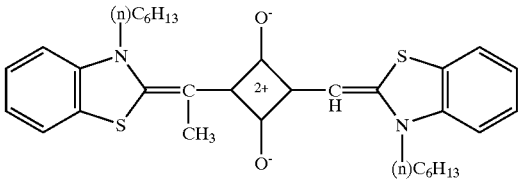

-continued
Exemplified compound (1)-24
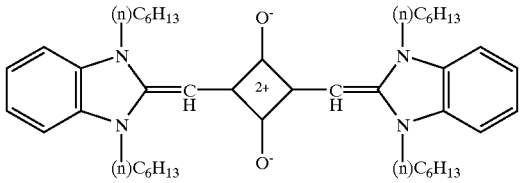
Exemplified compound (2)-1
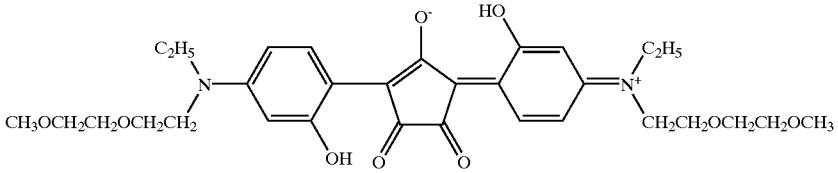
Exemplified compound (2)-2
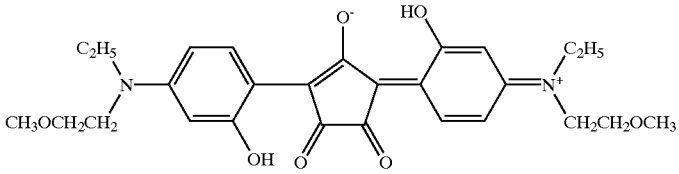
Exemplified compound (2)-3
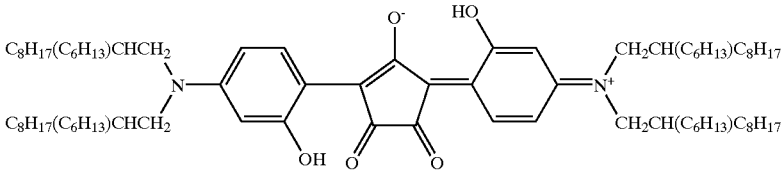
Exemplified compound (2)-4
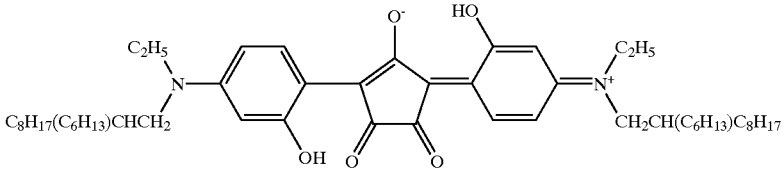
Exemplified compound (2)-5
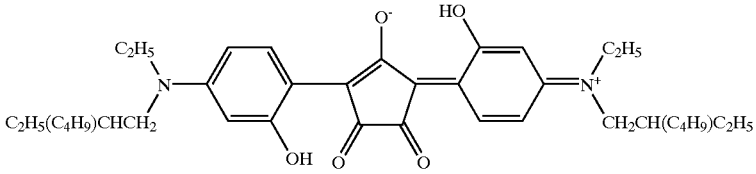
Exemplified compound (2)-6
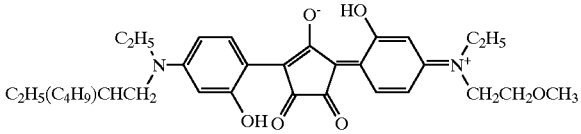
Exemplified compound (2)-7
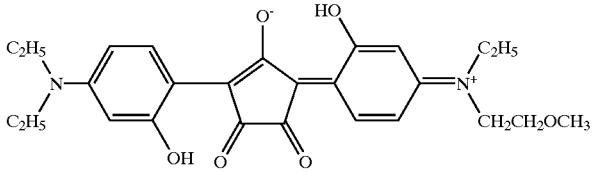
Exemplified compound (2)-8
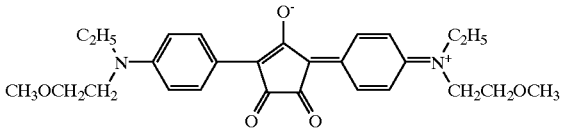
Exemplified compound (2)-9
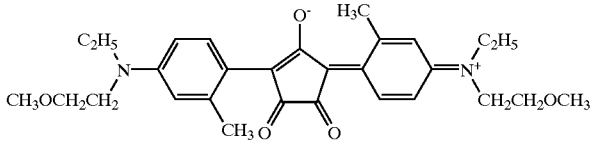

-continued
Exemplified compound (2)-10
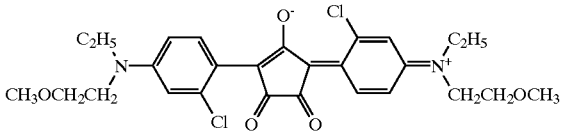
Exemplified compound (2)-11
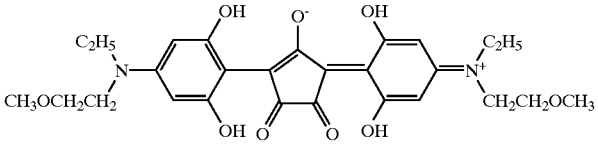
Exemplified compound (2)-12
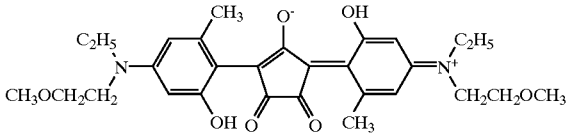
Exemplified compound (2)-13
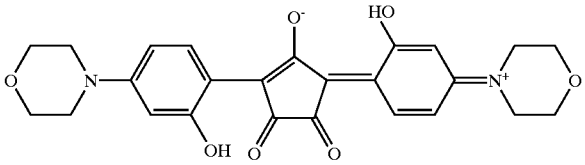
Exemplified compound (2)-14
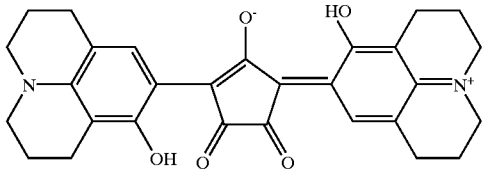
Exemplified compound (2)-15
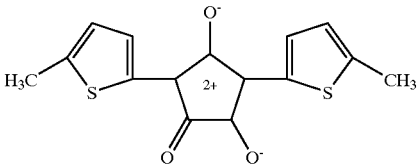
Exemplified compound (2)-16
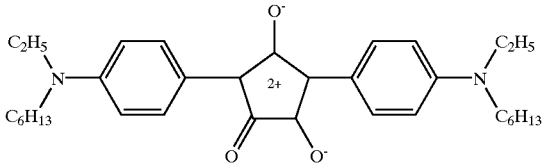
Exemplified compound (2)-17
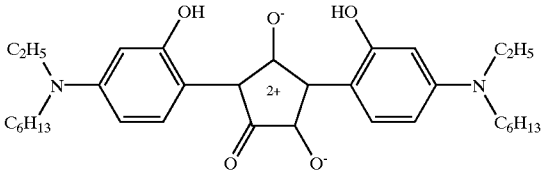
Exemplified compound (2)-18
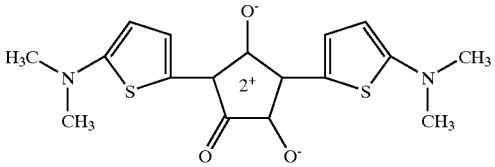
Exemplified compound (2)-19
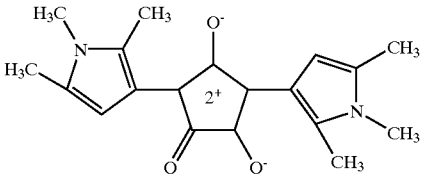
Exemplified compound (2)-20
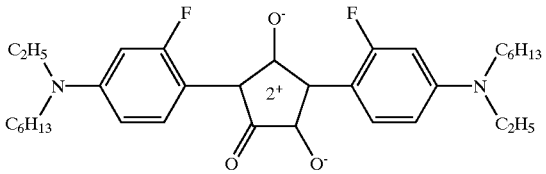
Exemplified compound (2)-21
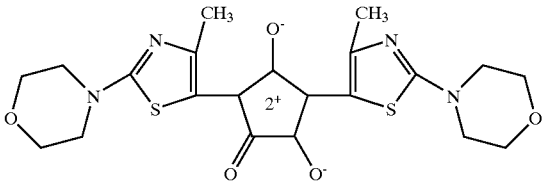
Exemplified compound (2)-22
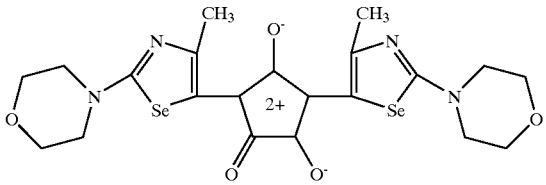
Exemplified compound (2)-23
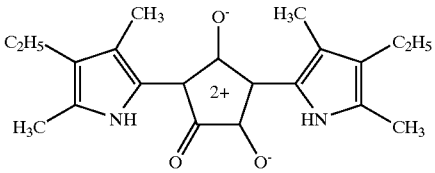

-continued
Exemplified compound (2)-24
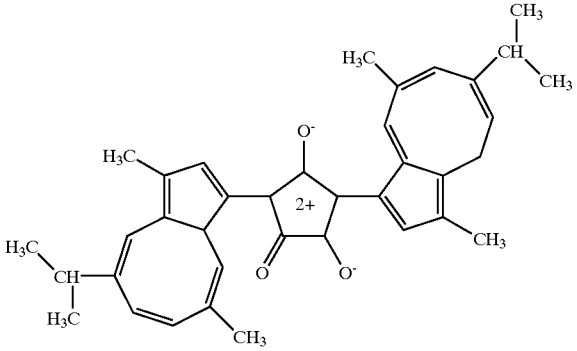
Exemplified compound (2)-25
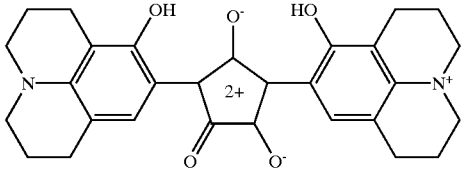
Exemplified compound (2)-26
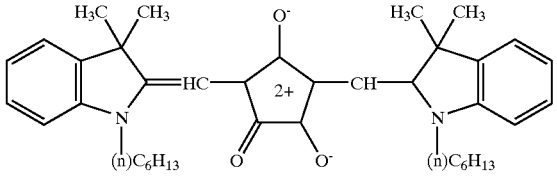
Exemplified compound (2)-27
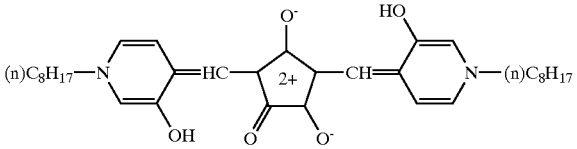
Exemplified compound (2)-28
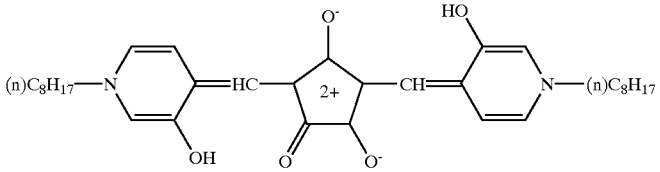
Exemplified compound (2)-29
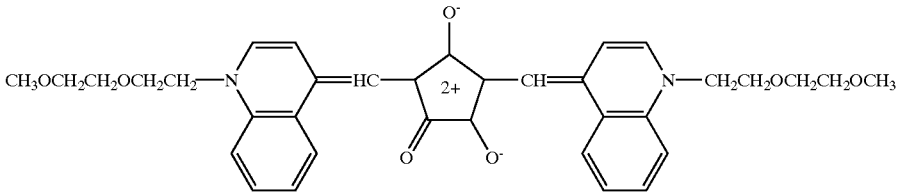
Exemplified compound (2)-30
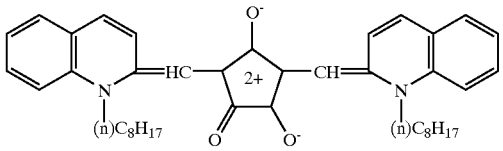
Exemplified compound (2)-31
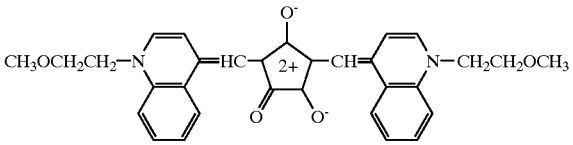
Exemplified compound (2)-32
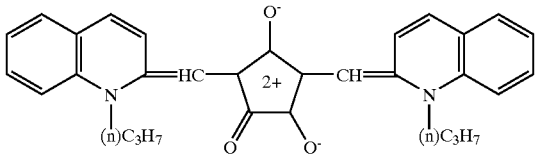
Exemplified compound (2)-33
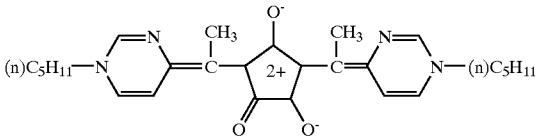
Exemplified compound (2)-34
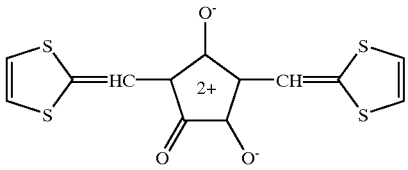
Exemplified compound (2)-35
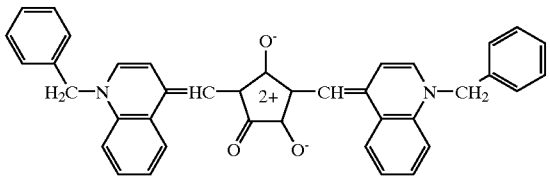

-continued
Exemplified compound (2)-36
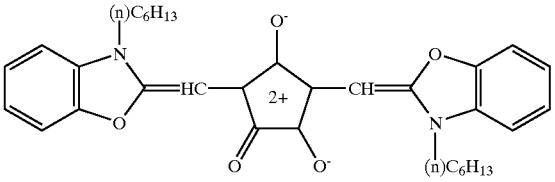
Exemplified compound (2)-37
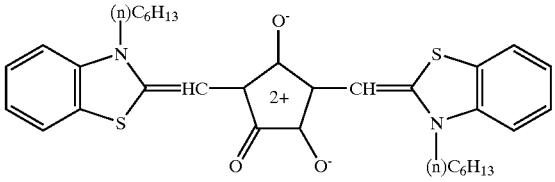
Exemplified compound (2)-38
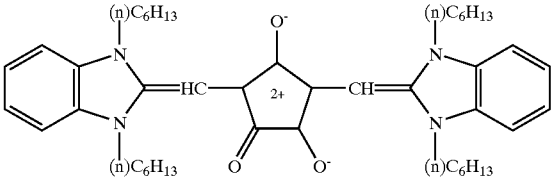
Exemplified compound (3,5)-1
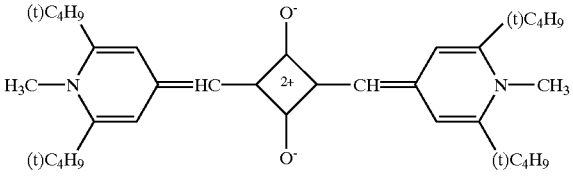
Exemplified compound (3,5)-2
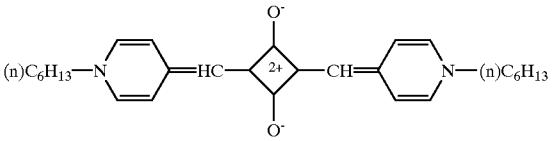
Exemplified compound (3,5)-3
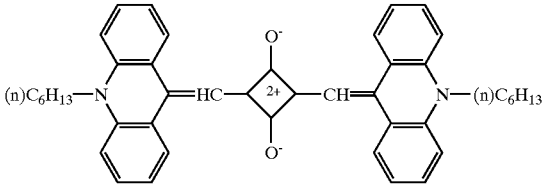
Exemplified compound (3,5)-4
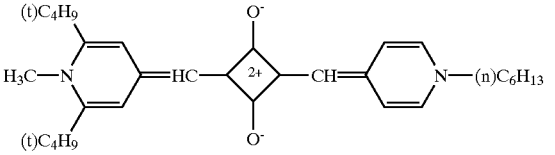
Exemplified compound (3,5)-5
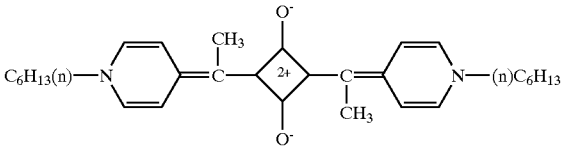
Exemplified compound (3,5)-6
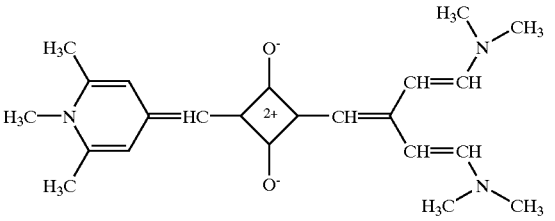
Exemplified compound (4,6)-1
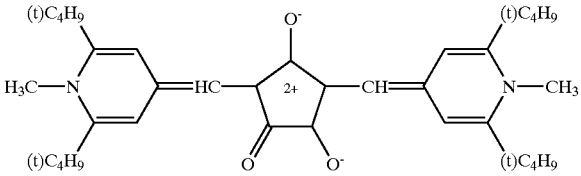
Exemplified compound (4,6)-2
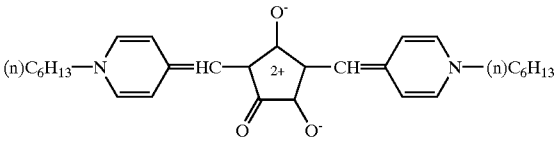
Exemplified compound (4,6)-3
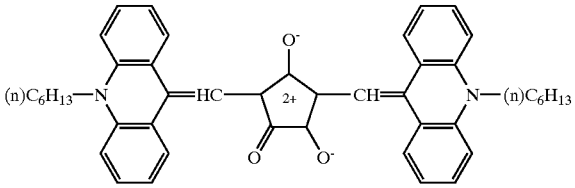
Exemplified compound (4,6)-4
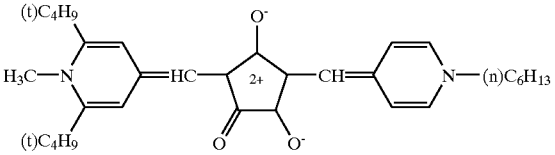
Exemplified compound (4,6)-5
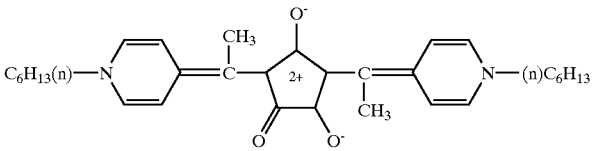

-continued

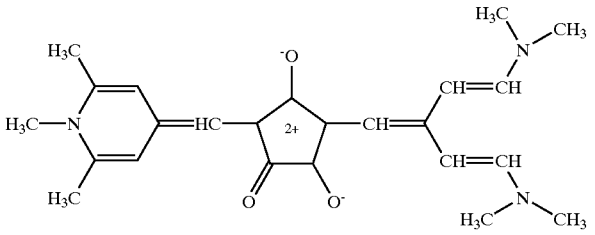

Exemplified Compounds

Thiopyryliumsquarylium dye, thiopyryliumcroconium dye, pyryliumsquarylium dye, pyryliumcroconium dye, selenapyryliumsquarylium dye, selenapyryliumcroconium dye, telluropyryliumsquarylium dye, and telluropyryliumcroconium dye.

Exemplified compound P-1

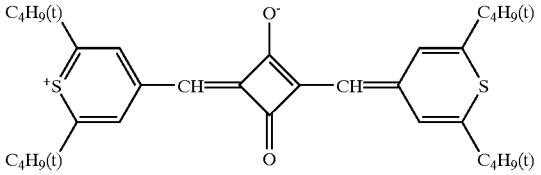

Exemplified compound P-2

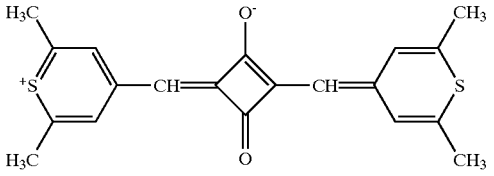

Exemplified compound P-3

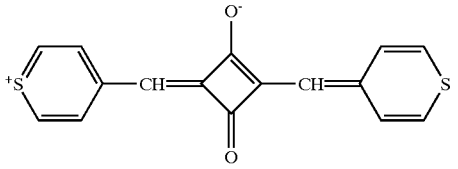

Exemplified compound P-4

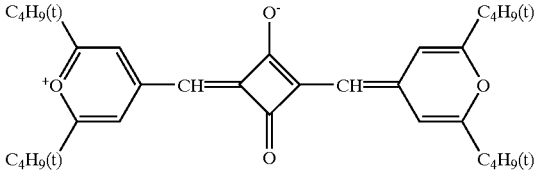

Exemplified compound P-5

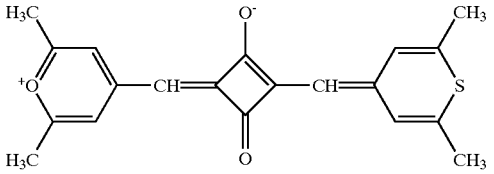

Exemplified compound (4,6)-6

-continued

Exemplified compound P-6

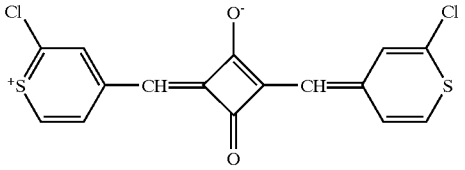

Exemplified compound P-7

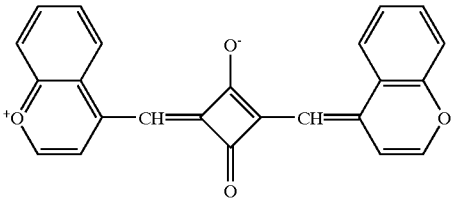

Exemplified compound P-8

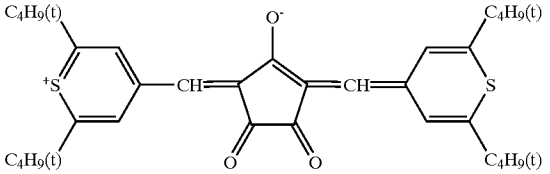

Exemplified compound P-9

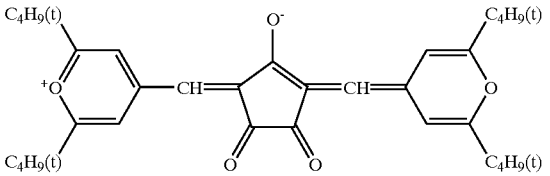

Exemplified compound P-10

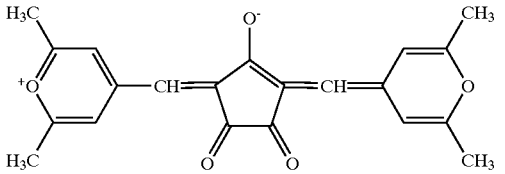

Exemplified compound P-11

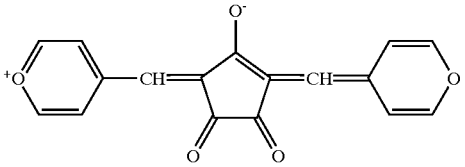

-continued
Exemplified compound P-12
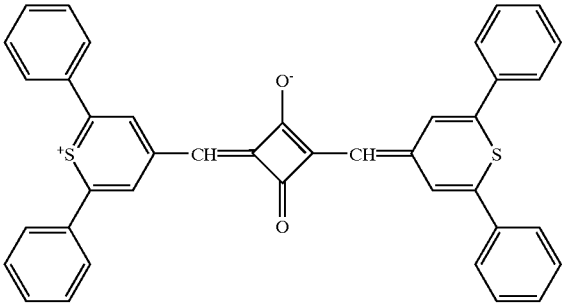
Exemplified compound P-13
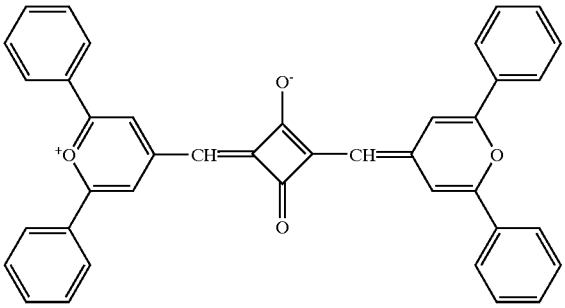
Exemplified compound P-14
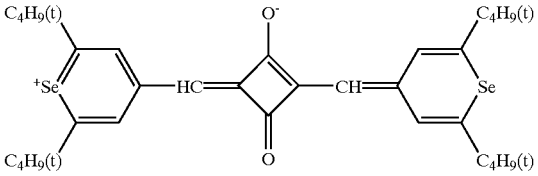
Exemplified compound P-15
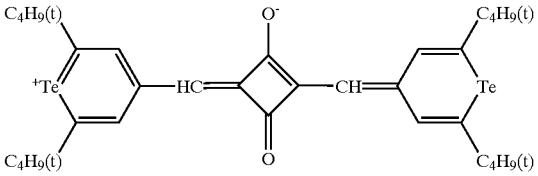
Exemplified compound P-16
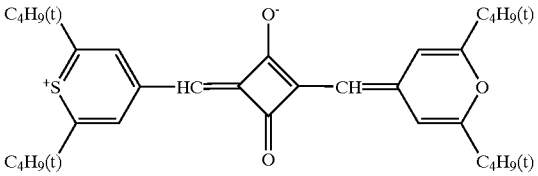
Exemplified compound P-17
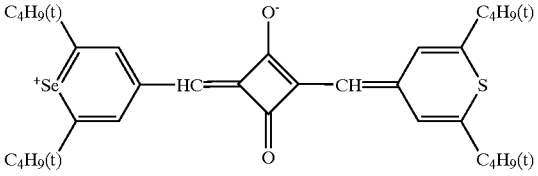
-continued
Exemplified compound P-18
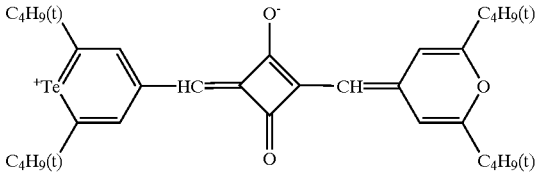
Exemplified compound P-19
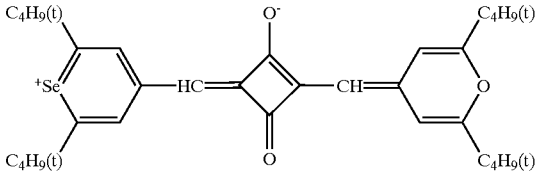
Exemplified compound P-20
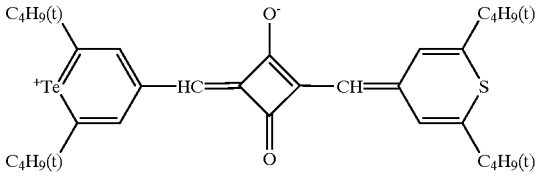
Exemplified compound P-21
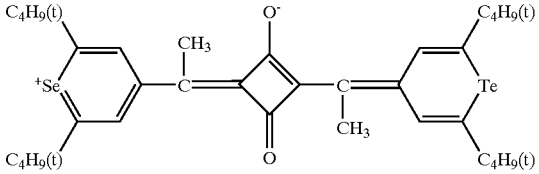
Exemplified compound P-22
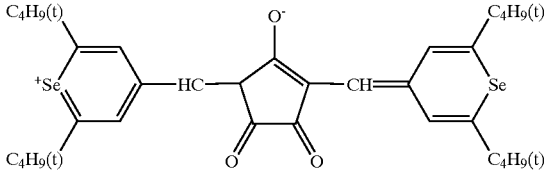
Exemplified compound P-23
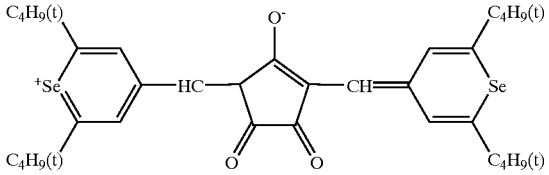
Exemplified compound P-24
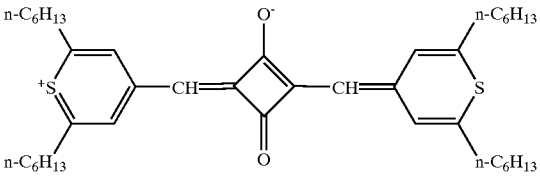

-continued

Exemplified compound P-25

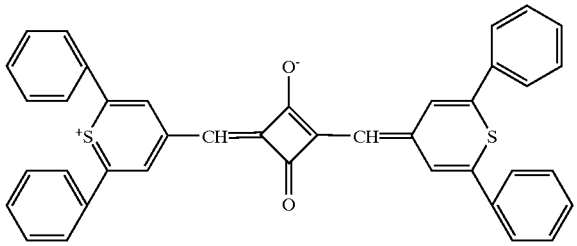

Exemplified compound P-26

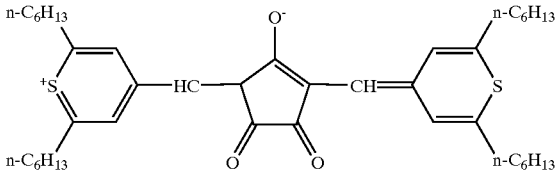

Formula (11) of the present invention will be explained below.

In the formula (11), $R_1$, $R_2$, $R_3$ and $R_4$ each represent an alkyl group which does not contain an acidic substituent in said alkyl group; $R_5$ and $R_6$ each represent a monovalent substituent.

Examples of $R_1$, $R_2$, $R_3$ and $R_4$ include a methyl group, an ethyl group, an iso-propyl group, a tert-butyl group, a methoxyethyl group, a methoxyethoxyethyl group, a 2-ethylhexyl group, a 2-hexyldecyl group or a benzyl group. In the present invention, an acidic substituent represents a sulfonic acid group, a carboxylic acid group, a phosphoric acid group, —$SO_2NHSO_2R$ or —$CONHSO_2R$ (R represents a lower alkyl group having 1 to 5 carbon atoms or a phenyl group). The sulfonic acid group includes a sulfo group or its salt, with the carboxylic acid group including a carboxyl group or its salt, while the phosphoric acid group includes a phosphono group or its salt.

When $R_1$, $R_2$, $R_3$ and $R_4$ represent an alkyl group substituted with an alkoxy group or an alkyl group having 5 or more carbon atoms, it is preferred that solubility of the dye represented by the formula (11) in an organic solvent is improved. Examples of a monovalent substituent represented by $R_5$ and $R_6$ are not limited, but preferable examples of said monovalent substituent include an alkyl group (e.g. an alkyl group represented by $R_1$), an aryl group (e.g. a phenyl group, a 4-chlorophenyl group, a 2,6-dimethyphenyl group), a hydroxyl group, an amino group, or an acyl group (e.g. an acetyl group), while the preferable examples are an alkyl group, an aryl group or a hydroxyl group. From the viewpoint of ease of synthesis and preferable spectral absorption, a hydroxyl group is most preferable.

$R_1$, $R_2$, $R_3$, $R_4$, $R_5$ and $R_6$ may form a ring with each other, for example, $R_1$, $R_2$ and $R_5$ may form a durolidyl ring with each other. 1 and m each represent an integer of 0 to 4, however, from the viewpoint of ease in synthesis, 1 and m are preferably 0 or 1, and, from the viewpoint of desirable spectral absorption characteristic, 1 and m are preferably to be 1.

Exemplified dyes represented by the formula (11) are illustrated below, but the present invention is not limited thereto.

Exemplified compound 1

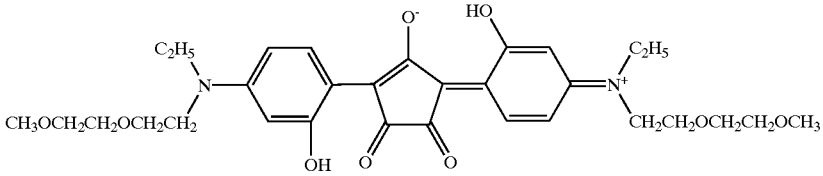

Exemplified compound 2

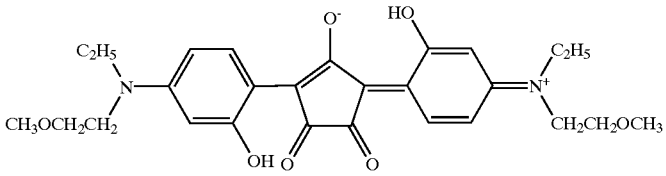

Exemplified compound 3

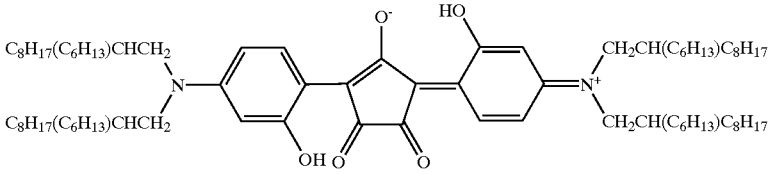

Exemplified compound 4

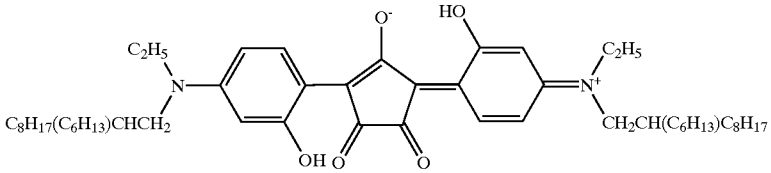

-continued

Exemplified compound 5

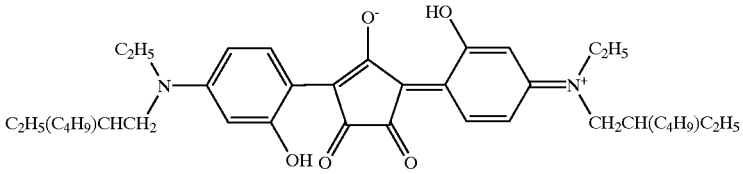

Exemplified compound 6

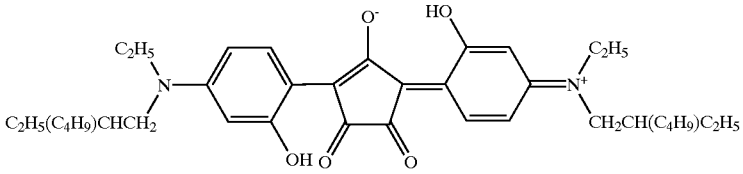

Exemplified compound 7

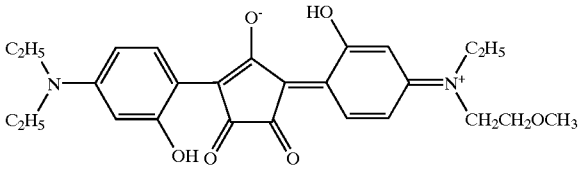

Exemplified compound 8

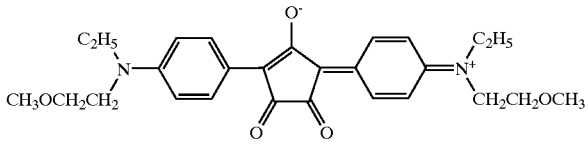

Exemplified compound 9

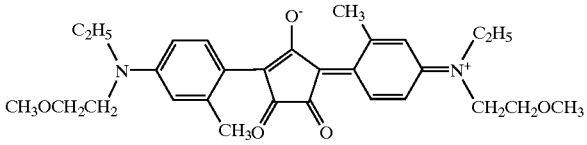

Exemplified compound 10

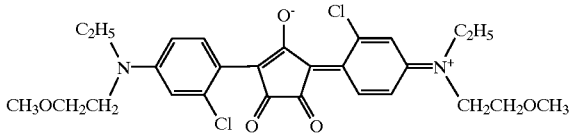

Exemplified compound 11

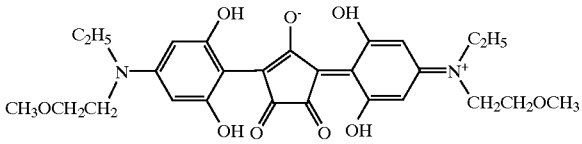

Exemplified compound 12

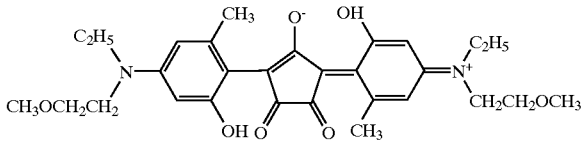

Exemplified compound 13

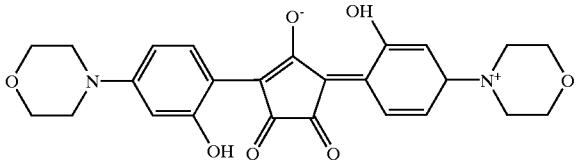

Exemplified compound 14

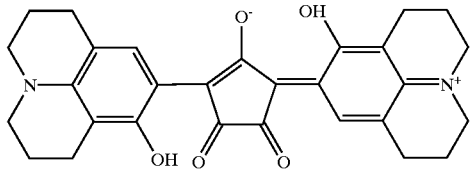

Exemplified compound 15

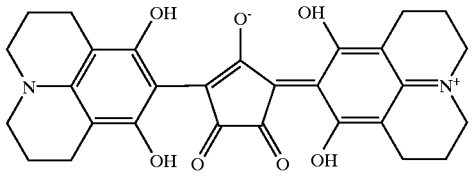

Exemplified synthesizing methods will be illustrated below, but the present invention is not limited thereto.

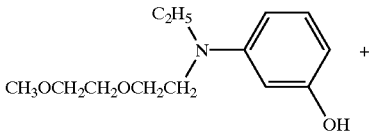

-continued

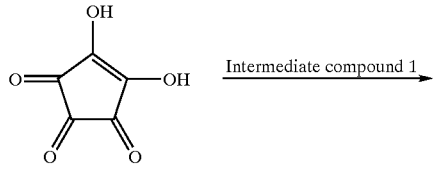

Exemplified compound 1

To 20 ml of 1-propanol were added 2.39 g of an intermediate compound 1 and 0.75 g of croconic acid. The thus obtained mixture was refluxed by heating for 1 hour, after which reaction products were extracted with ethyl acetate. Following that, the organic solvent phase containing the target compound was washed with water, after which the organic solvent was removed to leave a residue, which was recrystallized from methanol to produce dark greenish crystals at a 72% yield. The chemical structure of the thus obtained exemplified compound 1 was confirmed by MASS spectrum and NMR spectrum. λmax of the exemplified compound was 813 nm in ethyl acetate.

Other exemplified compounds can be synthesized according to the method described above.

"A silver halide photographic light-sensitive material is exposed to light to form a latent image, and said silver halide photographic light-sensitive material, in which said latent image is formed, is followed by being subjected to thermal development so as to substantially form an image", will be explained in detail below. The exposing method is not limited and every kind of exposing method is acceptable. However, as a light source, a laser light source is preferable. As a laser light source useful in the present invention, preferably cited are a gas laser, a YAG laser, a dye laser and semiconductor laser. Furthermore, combinations of a semiconductor laser and a secondary high frequency wavelength generating element are also viable. The energy of the exposing light is preferably between 1 mJ/mm$^2$ and 40 mJ/mm$^2$ per mm sec. A latent image may not substantially be recognized with the naked eye, however, said latent image can be recognized with the naked eye follwing the developing process, and the term, "said latent image" is well known in this art. The heat in the present inventive thermally developing process is preferably between 80° C. and 200° C., is more preferably between 100° C. and 150° C. When the heat is less than 80° C., a sufficient image density is not obtained in the desired short time. On the other hand, when the heat is more than 200° C., the binder is melted to result in adhesion to the rollers, as well as other adverse effects such as an unpreferable transferability and unacceptable developing machine problems. Developing time is preferably between 1 to 180 sec., and is more preferably 10 to 90 sec. Any known developing method may be employed, however, a light-sensitive material is preferably heated on a roller or a heat block heated to the desired temperature. A thermally developable light-sensitive material of the present invention is processed by a thermally developing process to obtain a photographic image, and said thermally developable light-sensitive material comprises a light-sensitive silver halide and, if necessary, for example, an organic silver salt as a reducible silver source, as well as an image toner to control a silver image tone in the form of a dispersion state or a solution state in a binder-matrix. The thermally developable light-sensitive material of the present invention is stable at normal temperatures and is developed, after exposure, when heated to higher temperatures (for example, not lower than 80° C.). Image formation is conducted by only the heating without any further supply of a processing solution such as water, etc. from outside, therefore, since this processing generates no processing solution waste, it is preferable from the viewpoint of environmental concerns.

A silver halide photographic light-sensitive material, to which the present invention applies, is not limited, and examples of said silver halide photographic light-sensitive material, to which the present invention is applied, include a known color negative film, a color reversal film, a color paper, a graphic art film, and a medical X-ray film. Of these, preferred ones are said graphic art film and medical X-ray film, and most preferable are the graphic art film and X-ray film by which an image is formed via the above-mentioned thermal development.

The average particle size of the dye in the form of a solid dispersion is expressed as the diameter of a sphere which has the same volume as the dye in the form of said solid dispersion, with the average particle diameter being preferably between 0.05 and 3.0 μm. The diameter of 70 wt % or more of the dye particles is preferably between 0.1 and 1.5 μm, and is more preferably between 0.1 to 1.0 μm. The diameter of the dye particle can be measured with a particle size measuring apparatus utilizing light scattering by coherent light such as light or laser light. The shape of the dye particle is almost spherical. The dye of the present invention in the form of said solid dispersion is preferably provided in the form of a fine solid particle dispersion prepared in the presence of a dispersant, in order to obtain fine particles which do not coagulate. As to a method by which the dye of the present invention is dispersed in the form of said fine particles, the dye is mechanically dispersed in the presence of an auxiliary dispersing agent by means of any of several known method to produce a fine particle dispersion (for example, a ball mill, a vibration ball mill, a planet ball mill, a sand mill, a colloid mill, a jet mill, and a roller mill). Furthermore, the dye is dissolved in a water-insoluble solvent, the boiling point of which is lower than that of water, and the thus obtained solvent containing the dye is subjected to ultrasonic dispersion to obtain fine oil droplets, after which the solvent is distilled by heating to obtain a fine solid dispersion.

When the dye is prepared in the form of a fine solid dispersion by the use of a dispersant, may be any of dispersant used those as described below; synthesized anionic polymers such as polyacrylic acid, copolymer derived from acrylic acid, copolymer derived from maleic acid, copolymer derived from maleic acid monoester, and copolymer derived from acryloylmethylpropanesulfonic acid; half-synthesized polymers such as carboxymethyl starch and carboxymethyl cellulose; anionic polymers such as alginic acid and pectic acid; anionic surfactants described in JP-A No. 52-92716, and WO No. 88/04794; compounds described in Japanese Patent Application No. 7-350753; a known anionic, nonionic, and cationic surfactant; in addition, known polymers such as polyvinyl alcohol, polyvinyl pyrrolidone, carboxymethyl cellulose, hydroxypropyl cellulose, and hydroxypropylmethyl cellulose; high molecular compounds naturally existing, such as gelatin, etc. Any of the above-mentioned compounds may be selected for use, as appropriate The dispersant is mixed with the dye provided in the form of a powder or in the form of a wet cake (thick paste) before dispersion, and the thus obtained mixture is usually fed into a homogenizer in a slurry state. The dispersant may be previously mixed with the dye, and the thus obtained mixture may be subjected to heat treatment or solvent treatment to be fed into the homogenizer. The pH of said mixture may be controlled by the use of a pH controlling agent, before, after, or during the dispersion.

Other than mechanically dispersing, the dye is primarily dispersed in a solvent by controlling the pH, after which fine particle dispersion of the dye can be obtained by varying the pH in the presence of an auxiliary dispersing agent. At that time, as a solvent used for primary dispersing, an organic solvent may be used, and said organic solvent is usually removed after obtaining said fine particle dispersion.

The thus prepared fine solid particle dispersion can be stored, while stirring said dispersion for the purpose of preventing precipitation of the fine particles, or while keeping said dispersion in the highly viscous state formed with a hydrophilic colloid (for example, in the state of a jell formed by the use of gelatin). An antiseptic can be added to said dispersion to prevent the propagation of germs.

The dye of the present invention is dissolved in a water-insoluble high boiling solvent (for example, tricresyl phosphate, di-butyl phthalate, di-nonylphenol, etc.) and the thus obtained solution is subjected to ultrasonic dispersion or the like to obtain said fine oil dispersion. The boiling point of said water-insoluble high boiling solvent is preferably 100° C., and is more preferably between 140 and 300° C. Examples of the medium used for dispersing said fine oil dispersion include those described below; synthesized anionic polymers such as polyacrylic acid, copolymer derived from acrylic acid, copolymer derived from maleic acid, copolymer derived from maleic acid monoester, and copolymer derived from acryloylmethylpropanesulfonic acid; half-synthesized polymers such as carboxymethyl starch and carboxymethyl cellulose; anionic polymers such as alginic acid and pectic acid; anionic surfactants described in JP-A No. 52-92716, and WO No. 88/04794; compounds described in Japanese Patent Application No. 7-350753; any commonly known anionic, nonionic, and cationic surfactant; in addition, known polymers such as polyvinyl alcohol, polyvinyl pyrrolidone, carboxymethyl cellulose, hydroxypropyl cellulose, and hydroxypropylmethyl cellulose; any naturally existing high molecular compounds, such as gelatin, etc. Any of the above-mentioned compounds may be selected for use as appropriate.

Examples of a water-soluble binder of the present invention include water-soluble polymers such as gelatin and/or gelatin derivatives (for example, phthalated gelatin, etc.), polyvinyl alcohol, methyl cellulose, carboxymethyl cellulose, hydroxypropyl cellulose; as well as various kinds of emulsions such as gum arabi, polyvinyl pyrrolidone, casein, styrene-butadiene latex, acrylonitrile-butadiene latex, polyvinyl acetate, polyacrylic acid ester, ethylene-polyvinyl acetate copolymer.

The amount of binder used is preferably between 0.5 and 5 g/m$^2$ in terms of solid composition. The preferable water-soluble binder used in the present invention is a styrene-butadiene copolymer latex. The weight ratio of the monomer unit of styrene to the monomer unit of butadiene contained in said styrene-butadiene copolymer latex is preferably between 50:50 to 95:5.

Examples of preferable styrene-butadiene copolymer latex include LACSTAR 3307B, 7132C, DS206, Nipol Lx 416, Lx 433, which are all commercially available.

A silver halide photographic light-sensitive material, which is spectrally sensitized to the wavelength region of 600 to 700 nm, is a silver halide photographic light-sensitive material, which can substantially form an image through an operation in which said silver halide photographic light-sensitive material is thermally developed after exposing it to a light source at wavelengths between 600 and 700 nm. A laser light source is preferable as said light source, Examples of preferable laser light sources used in the present invention include a gas laser, a YAG laser, a dye laser, and a semiconductor laser, and combined usage of a semiconductor laser and a secondary high frequency wavelength generating element is acceptable. The energy of said exposing light is preferably between 1 mmJ/mm$^2$ and 40 mmJ/mm$^2$ oer mm sec.

As hydrazine derivatives employed in the present invention, preferred are those having the following general formula (H).

General formula (H)

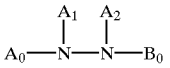

wherein $A_0$ represents an aliphatic group, an aromatic group, a $C_0$—$D_0$ group, or a heterocyclic group, each of which may have a substituent; $B_0$ represents a blocking group; both $A_1$ and $A_2$ represent hydrogen atoms, or one of which represents a hydrogen atom and the other represents an acyl group, a sulfonyl group or an oxalyl group. $C_0$ represents a —CO— group, a —COCO— group, a —CS— group, a —C(=N$G_1D_1$)— group, a —SO— group, a —$SO_2$— group or a —P(O)($G_1D_1$)— group; $G_1$ represents a simple linking groups such as a —O— group, —S— group, or —N($D_1$)— group; $D_1$ represents an aliphatic group, an aromatic group, a heterocyclic group, or a hydrogen atom; and $D_0$ represents a hydrogen atom, an aliphatic group, an aromatic group, a heterocyclic group, an amino group, an alkoxy group, an aryloxy group, an alkylthio group, or an arylthio group.

In general formula (H), aliphatic groups represented by $A_0$ preferably have from 1 to 30 carbon atoms, and straight, branched or cyclic alkyl groups having from 1 to 20 carbon atoms are particularly preferred and, for example, cited are a methyl group, an ethyl group, a t-butyl group, an octyl group, a cyclohexyl group, and a benzyl group. These may be substituted with a suitable substituent (for example, an aryl group, an alkoxy group, an aryloxy group, an alkylthio group, arylthio group, a sulfoxy group, a sulfonamide group, a sulfamoyl group, an acylamino group, a ureido group, etc.).

In the general formula (H), aromatic groups represented by $A_0$ are preferably monoring or condensed ring aryl groups, and cited, for example, are a benzene ring and a naphthalene ring. Heterocyclic groups represented by $A_0$ are preferably monoring or condensed ring groups composed of a heterocycle containing at least one hetero atom selected from nitrogen, sulfur, and oxygen atoms, which are, for example, a pyrrolidone ring, an imidazole ring, a tetrahydrofuran ring, a morpholine ring, a pyridine ring, a pyrimidine ring, a quinoline ring, a thiazole ring, a benzothiazole ring, a thiophene ring, or a furan ring; as $A_0$, those particularly preferred are an aryl group, and aromatic groups and heterocyclic groups of $A_0$ may have a substituent and particularly preferred groups include a substituent having an acidic group with a pKa of 7 to 11, and specifically cited are a sulfonamide group, a hydroxyl group, a mercapto group, etc.

In the general formula (H), the —$G_0$—$D_0$— group represented by $A_0$ will now be described.

$G_0$ represents a —CO— group, a —COCO— group, a —CS— group, a —C(=N$G_1D_1$)— group, a —SO— group, a —$SO_2$— group, or a —P(O)($G_1D_1$)— group, and as preferred $G_0$, listed are a —CO— group and a —COCO— group, and as particularly preferred, a —COCO— group is listed. $G_1$ represents a simple linking group such as a —O— group, a —S— group or a —N($D_1$)— group, and $D_1$ represents an aliphatic group, an aromatic group, a heterocyclic group, or a hydrogen atom, and when a plurality of $D_1$s are present in a molecule, these may be the same or different.

$D_0$ represents a hydrogen atom, an aliphatic group, an aromatic group, a heterocyclic group, an amino group, an alkoxy group, an aryloxy group, an alkylthio group, an arylthio group, and as preferred $D_0$, listed are a hydrogen atom, an alkyl group, an alkoxy group, an amino group, an aryl group, etc.

Furthermore, in the general formula (H), $A_0$ preferably contains at least one of a nondiffusion group or a silver halide adsorption group. As the nondiffusion group, a ballast group is preferred which is commonly used as immobilizing photographic additives such as couplers, and the ballast groups include an alkyl group, an alkenyl group, an alkynyl group, an alkoxy group, a phenyl group, a phenoxy group, an alkylphenoxy group, etc. which have at least 8 carbon atoms and are photographically inactive.

In the general formula (H), silver halide adsorption accelerators include thiourea, a thiourethane group, a mercapto group, a thioether group, a thione group, a heterocyclic groups, a thioamido heterocyclic group, a mercapto heterocyclic group, or adsorption groups described in Japanese Patent Publication Open to Public Inspection No. 64-90439.

In the general formula (H), $B_0$ represents a blocking group; preferably represents —$G_0$—$D_0$ which is the same as the —$G_0$—$D_0$ group in $A_0$, and $A_0$ and $B_0$ may be different.

Both $A_1$ and $A_2$ represent a hydrogen atom and when one of them represents a hydrogen atom, the other represents an acyl group (for example, an acetyl group, a trifluoroacetyl group, a benzoyl group, etc.), a sulfonyl group (for example, a methanesulfonyl group, a toluenesulfonyl group, etc.), or an oxalyl group (for example, an ethoxalyl group, etc.).

Specific examples represented by the general formula (H) are described below. However, the present invention is not limited to these examples.

H-1

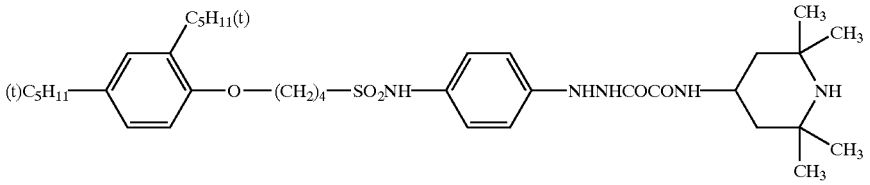

H-2

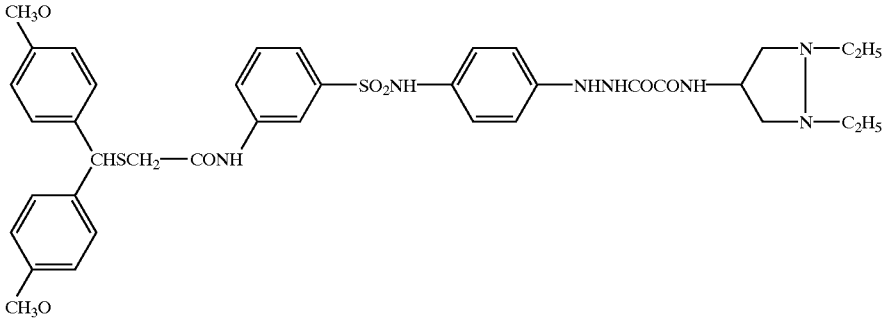

H-3

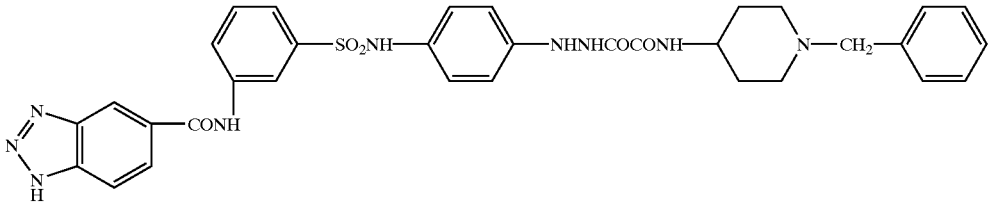

H-4

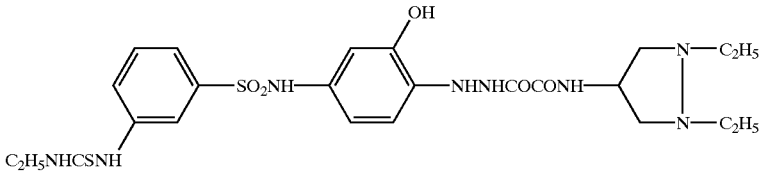

H-5

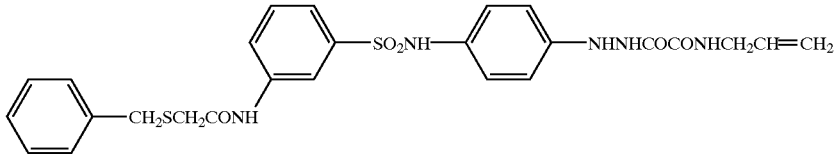

-continued
H-6
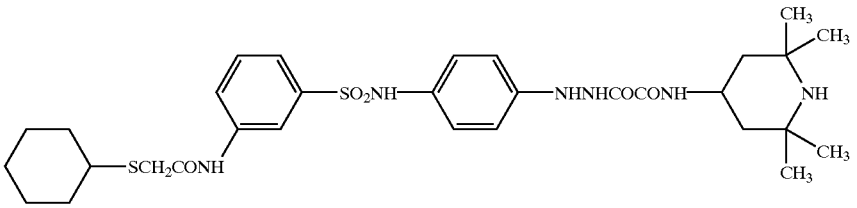
H-7
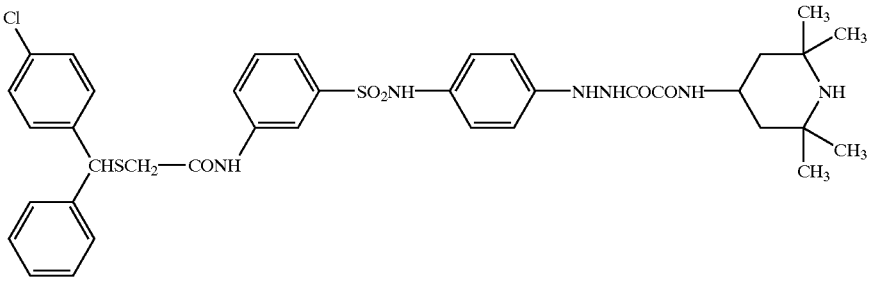
H-8
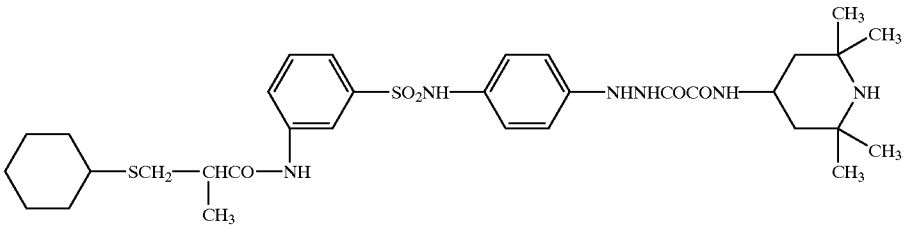
H-9
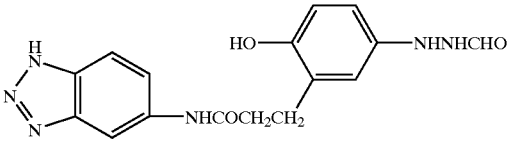
H-10
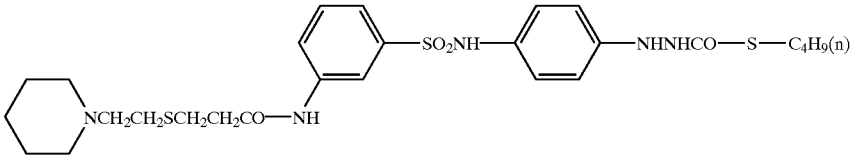
H-11
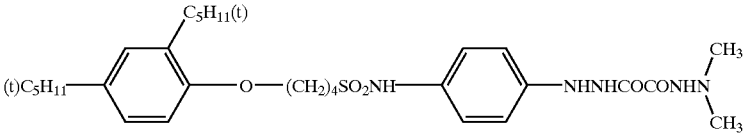
H-12
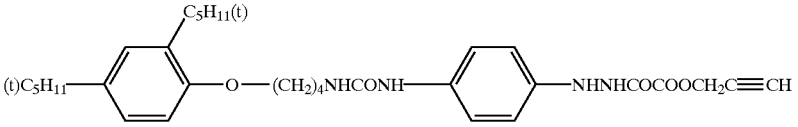
H-13
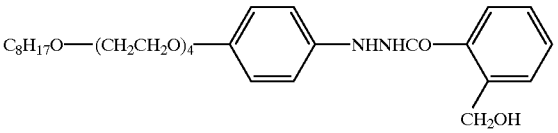

-continued
H-14
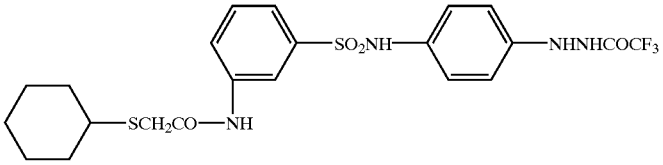
H-15
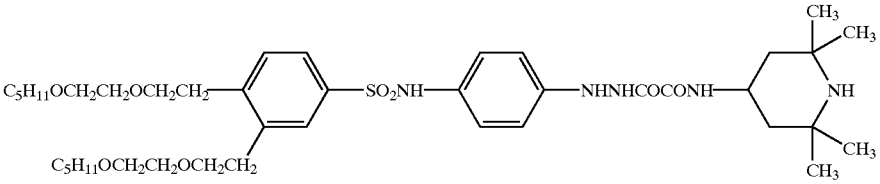
H-16
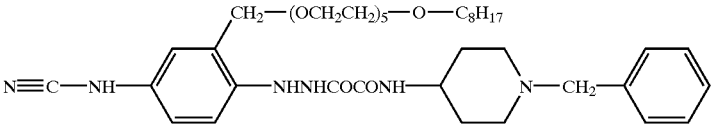
H-17
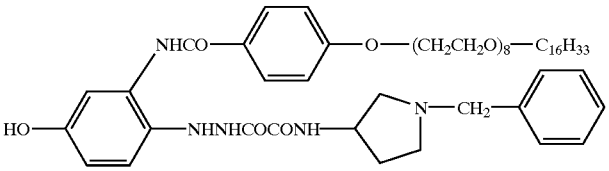
H-18
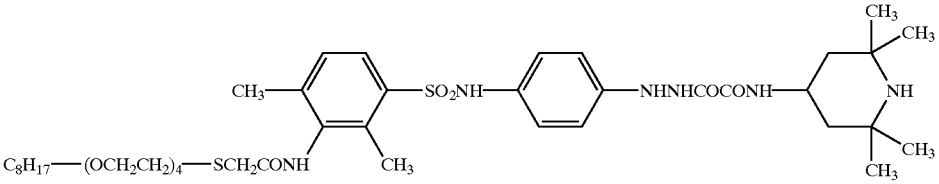
H-19
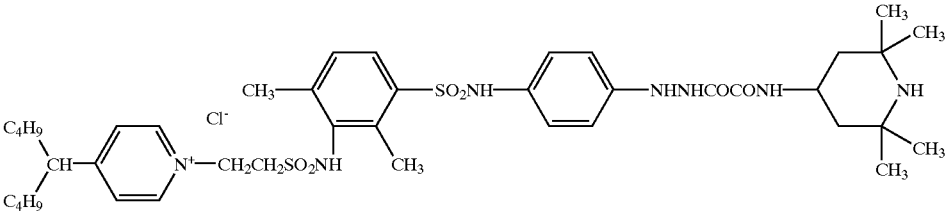
H-20
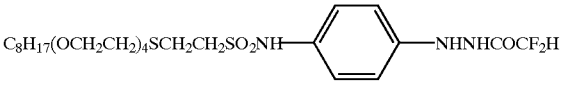
H-21
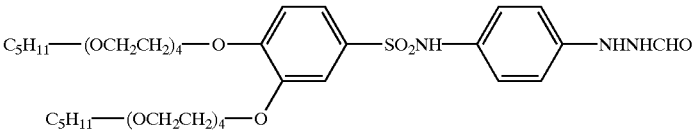
H-22
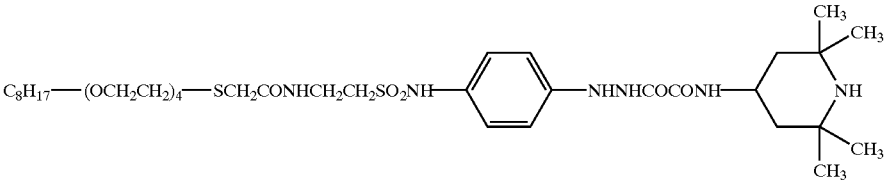

-continued

H-23

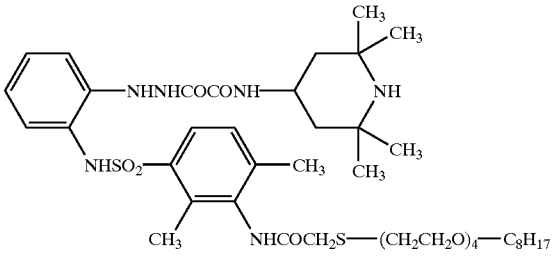

H-24

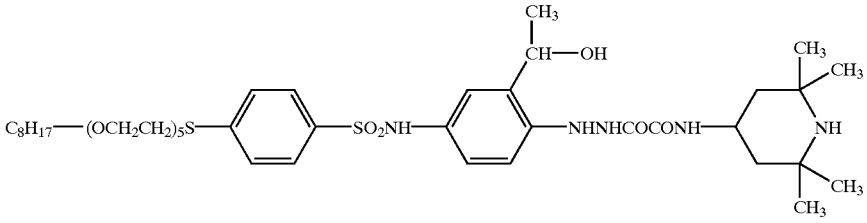

H-25

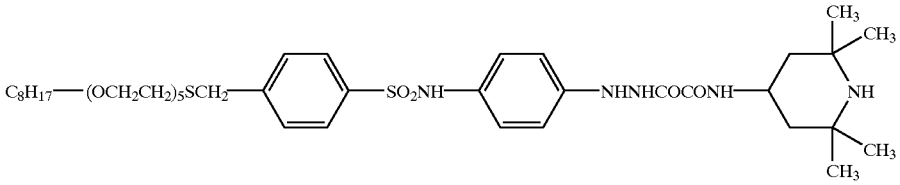

H-26

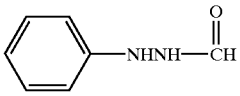

H-27

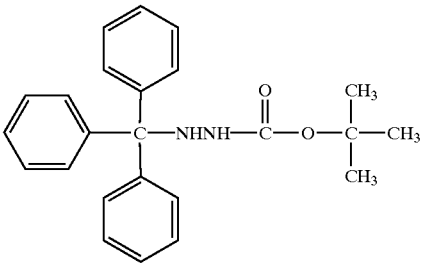

H-28

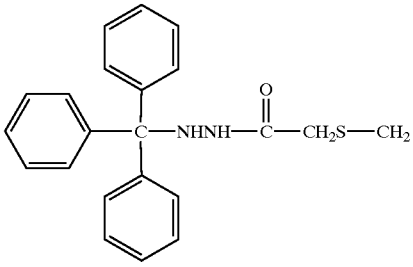

H-29

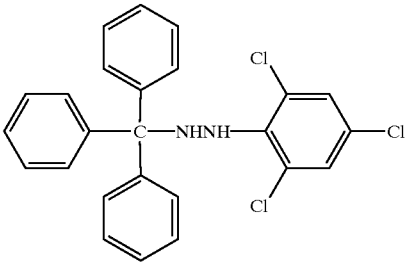

H-30

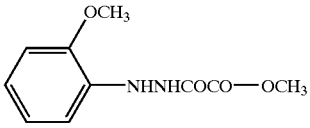

H-31

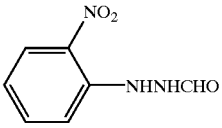

H-32

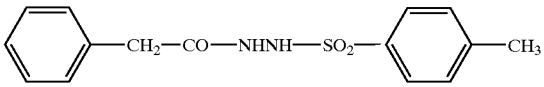

As hydrazine compounds employed in the present invention, other than the compounds described above, those described below may also be employed.

In addition to the compounds described in Research Disclosure, Item 23516 (November 1983 Issue, page 346) and publications cited therein, listed can be those described in U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769; U.K. Patent No. 2,011,391B; European Patent Nos. 217310, 301,799, and 356,898; and Japanese Patent Publication Open to Public Inspection Nos. 60-179734, 61-170733, 61-270744, 62-178246, 62-270948, 63-29751, 63-32538, 63-104047, 63-121838, 63-129337, 63-223744, 63-234244, 63-234245, 63-234246, 63-294552, 63-306438, 64-10233, 1-90439, 1-100530, 1-105941, 1-105943, 1-276128, 1-280747, 1-283548, 1-283549, 1-285940, 2-2541, 2-77057, 2-139538, 2-196234, 2-196235, 2-198440, 2-198441, 2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524, and 9-160164, etc.

Furthermore, other than those, employed can be compounds described in (Ka 1) of Japanese Patent Publication No. 6-77138, specifically, compounds described on pages 3 and 4 of the Publication; compounds represented by general formula (I) in Japanese Patent Publication No. 6-93082, specifically, compounds 1 through 38 described on pages 8 to 18 of the Publication; compounds represented by general formula (4), general formula (5), and general formula (6) in Japanese Patent Publication Open to Public Inspection No. 6-230497, specifically, compounds 4-1 through 4-10 on pages 25 and 26, compounds 5-1 through 5-42 on pages 28 to 36, and compounds 6-1 through 6-7 on pages 39 and 40 of the Publication; compounds represented by general formula (I) and general formula (2) in Japanese Patent Publication Open to Public Inspection No. 6-289520, specifically, compounds 1-1) through 1-17) and 2-1) on pages 5 to 7 of the Publication; compounds described in (Ka 2) and (Ka 3) of Japanese Patent Publication Open, to Public Inspection No. 6-313936, specifically, compounds described on pages 6 to 19 of the Publication; compounds described in (Ka 1) of Japanese Patent Publication Open to Public Inspection No. 6-313951, specifically, compounds described on pages 3 to 5 of the Publication; compounds represented by general formula (I) in Japanese Patent Publication Open to Public Inspection No. 7-5610, specifically, compounds I-1 through I-38 described on pages 5 to 10 of the Publication; compounds represented by general formula (II) in Japanese Patent Publication Open to Public Inspection No. 7-77783, specifically, compounds II-1 through II-102 described on pages 10 to 27 of the Publication; and compounds represented by general formula (H) and general formula (Ha) in Japanese Patent Publication Open to Public Inspection No. 7-104426, specifically, compounds H-1 through H-44 described on pages 8 to 15 of the Publication.

A hydrazine derivative addition layer is a photosensitive layer and/or a constitution layer adjacent to the photosensitive layer. The added amount is preferably in the range of $10^{-6}$ to $10^{-1}$ mole per mole of silver halide and is most preferably in the range of $10^{-5}$ to $10^{-2}$ mole, though the optimum amount is not defined, depending on the silver halide grain size, halide composition, chemical sensitization degree, reducing agent type, retarder type, etc.

A silver halide photographic light-sensitive material, which is spectrally sensitized to the wavelength region of 600 to 900 nm, is a silver halide photographic light-sensitive material, which can substantially form an image through an operation in which said silver halide photographic light-sensitive material is thermally developed after exposing it to a light source in the wavelength region between 600 and 900 nm. As said light source, a laser light source is preferable. Examples of the preferable laser light used in the present invention include a gas laser, a YAG laser, a dye laser, and a semiconductor laser, and combined usage of a semiconductor laser and a secondary high frequency wavelength generating element is available. The energy of the exposing light is preferably between 1 mmJ/mm$^2$ and 40 mmJ/mm$_2$ per mm sec.

The additional amount of the dye of the present invention incorporated into the thermally developable photosensitive material, the silver halide photographic light-sensitive material, the optical filter, and the support usable for a silver halide photographic light-sensitive material is not limited, but it is preferable that said additional amount is controlled so that a transmission density at the spectral maximum of the dye is between 0.01 to 3.0, and is more preferably between 0.1 to 1.5.

The dye may be incorporated into any layer of the thermally developable photosensitive material and the silver halide photographic light-sensitive material, but the dye is preferably incorporated in the light-sensitive layer or the backing layer, and is specifically preferably incorporated into said light-sensitive layer. It is preferable that the dye is dissolved in an organic solvent (e.g. methylethyl ketone, ethyl acetate, and toluene) and directly added to the photographic light-sensitive material. In addition, dye in the form of a solid dispersion and dye in the form of an oil dispersion are preferably employed.

The light-sensitive material can comprise the dye of the present invention on both sides of a support, however, preferably the dye is comprised in the layer provided opposite to the emulsion layer. Furthermore, in the present invention, when the dye is incorporated into the support itself, it results in a marked improvement of resolution.

The processing method of a silver halide photographic light-sensitive material of the present invention is not specifically limited, and said silver halide photographic light-sensitive material may be processed in a processing solution such as C-41, produced by Kodak Co., or also thermally developed. Thermal development is more preferable, because a processing solution need not be prepared, maintenance of said processing solution is avoided, and comparatively, development time is extremely short.

A thermally developable silver halide photographic light-sensitive material comprising a support having thereon an organic silver salt and a binder is preferably applied to the present invention, from the viewpoint of minimal residual color stain.

When said photosensitive material is processed in a solution, the CPC-2-22 process introduced by Konica Co., or the like, other than the C-41 process previously mentioned, is preferably employed. The development method is not specifically limited, however, preferred is when the photographic light-sensitive material is soaked in a tank of a solution to be processed, alternatively, a processing solution may be sprayed or coated onto the photographic light-sensitive material.

When a silver halide photographic light-sensitive material comprising a dye represented by formulas (1) or (2) is subjected to reversal development, while said silver halide photographic light-sensitive material is being subjected to secondary exposure, an image with excellent resolution can be obtained, and stable photographic characteristics can as well be obtained.

It is advantageous to incorporate a dye represented by the formulas (1) or (2) into a photographic light-sensitive material by applying a solution containing said dye. Incorporation of said dye into said photographic light-sensitive material is preferably carried out by mixing a dye dispersion with gelatin or a binder such as a polymer, and by coating the thus obtained mixture.

When a dye represented by formula (1) is used in the form of a solid dispersion, improvement of resolution is specifically marked and residual color stain is minimal. Specifically, when a photosensitive material is developed in a developing solution, residual color stain is extremely minimal.

It is preferable that the present inventive dye is used in a photographic light-sensitive material for pleasurable photographic viewing, because the residual color stain is minimal.

Use of a filter according to the present invention is not specifically limited, and said filter may be utilized for all usage where the absorption of light is required. Specifically, when said filter is required to absorb infrared rays and it is required that existence of the dye incorporated in a support is not to be noticed with the naked eye, the filter according to the present invention is preferably employed. A support constituting said filter is not specifically limited, and glass, resin and the like can preferably be used.

The dye can be incorporated in the support constituting the filter, or can also be incorporated in a photographic component layer provided on one side of the support, but can also be incorporated in photographic component layers provided on both sides of the support. The photographic component layer(s) provided on either one side or both sides of the support can be obtained through coating, spraying or evaporating a coating solution containing said dye, so that said dye is fixed on either one or both sides of the support. As a method for incorporating the dye into the support, any of the several known methods may be employed. For example, preferable methods may be: (i) said dye is dissolved in a resin and the thus treated resin is casted, or (ii) said dye is dissolved in a resin monomer and the thus treated resin monomer is polymerized. In the case of coating the dye on the support, a binder is preferably used, and as said binder, gelatin, polyvinyl alcohol, polybutyl acrylate or the like may be used.

The absorption amount of infrared rays absorbed by the dye can, if necessary, be adjusted. However, the optical density obtained through absorption by the dye is preferably between 0.01 and 3.0, and is more preferably between 0.1 and 2.0.

Thermally developable photosensitive materials used for forming a photographic image, employing a thermally developing process, are disclosed, for example, in U.S. Pat. Nos. 3,152,904 and 3,457,075, and D. Morgan, "Dry Silver Photographic Material" and D. Morgan and B. Shely, "Thermally Processed Silver Systems" (Imaging Processes and Materials) Neblette, 8th Edition, edited by Sturge, V. Walworth, and A. Shepp, page 2, 1969, etc.

The present invention is preferably applied to a photographic material comprising organic silver salts. Said organic silver salts are reducible silver sources and preferred are organic acid silver salts and silver salts of hetero-organic acids having a reducible silver ion source, specifically, long chain (having from 10 to 30 carbon atoms, but preferably from 15 to 25 carbon atoms) aliphatic carboxylic acid silver salts as well as nitrogen-containing heterocylic ring silver salts.

Organic or inorganic silver salt complexes are also useful in which the ligand has a total stability constant for silver ion of 4.0 to 10.0. Examples of preferred silver salts are described in Research Disclosure, Items 17029 and 29963, and include the following; organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these, the preferred silver salt is silver behenate. The content of the organic silver salt is 3 $g/m^2$ in terms of silver amount, and is preferably not more than 2 $g/m^2$.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in JP-A No. 9-127643, etc.

Silver halide grains used in the present invention is specifically not limited, however, in order to minimize the translucence after image formation and to obtain excellent image quality, the average grain size is preferably minute. The average grain size is preferably not more than 0.20 $\mu$m; is more preferably between 0.03 and 0.15 $\mu$m, and is most preferably between 0.03 and 0.11 $\mu$m. The grain size as described herein implies the ridge line length of a silver halide grain when it is a so-called regular crystal which is either cubic or octahedral. When the grain is not a regular crystal, for example, when it is a spherical, cylindrical, or tabular grain, the grain size is the diameter of a sphere having the same volume as each of those grains.

There is no particular limitation on the silver halide grain shape. However, a high ratio occupying a Miller index [100] plane is preferred. This ratio is preferably at least 50 percent; is more preferably at least 70 percent, and is most preferably at least 80 percent. The ratio occupying the Miller index [100] plane can be obtained based on T. Tani, J. Imaging Sci., 29, 165 (1985) in which adsorption dependency of a [111] plane and a [100] plane is utilized.

The composition of silver halide used in the present invention is not particularly limited and may be any of silver chloride, silver chlorobromide, silver chloroiodobromide, silver bromide, silver iodobromide, or silver iodide. The photographic emulsion employed in the present invention can be prepared employing methods described in P. Glafkides, "Chimie et Physique Photographique" (published by Paul Montel, 1967), G. F. Duffin, "Photographic Emulsion Chemistry" (published by The Focal Press, 1966), V. L. Zelikman et al., "Making and Coating Photographic Emulsion" (published by The Focal Press, 1964), etc. Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed. The resulting silver halide may be incorporated into an image forming layer utilizing any practical method, and at such time, silver halide is placed adjacent to a reducible silver source. Furthermore, silver halide may be prepared by converting a part or all of the silver in an organic silver salt formed through the reaction of an organic silver salt with halogen ions into silver halide. Silver halide may be previously prepared and the resulting silver halide may be added to a solution to prepare the organic silver salt, or combinations thereof may be used, however, the latter is preferred. Generally, the content of silver halide in organic silver salt is preferably between 0.75 and 30 weight percent.

Silver halide employed in the present invention is preferably comprised of ions of metals or complexes thereof, in transition metal belonging to Groups IB, IIB, IIIA, VA, VIA, VIIA and VIII of the Periodic Table. As the above-mentioned metals, preferred are W (in Group VIA); Fe, Co, Ni (in Group VIII); and Cu (in Group IB), Ru, Rh, Pd (in Group VIII), Re (in Group VIIA), Os, Ir, Pt (in Group VIII) and Au (in Group IB).

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. The addition may be carried out several times by dividing the added amount. Uniform content in the interior of a silver halide grain can be carried out. As described in JP-A Nos. 63-29603, 2-306236, 3-167545, 4-76534, 6-110146, 5-273683, etc., incorporation can be carried out so as to result in distribution formation in the interior of a grain. These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

A reducing agent is preferably incorporated into the thermally developable photosensitive material to which the present invention is applied. Examples of suitable reducing agents are described in U.S. Pat. Nos. 3,770,448, 3,773,512, and 3,593,863, and Research Disclosure Items 17029 and 29963, and include the following. Aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl)methylsulfone); sulfhydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols.

As hindered phenols, listed are compounds represented by the general formula (A) described below.

General formula (A)

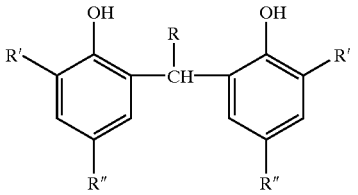

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below. However, the present invention is not limited to these examples.

(Exemplified compounds)

A-1

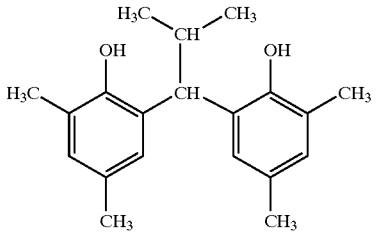

-continued

A-2

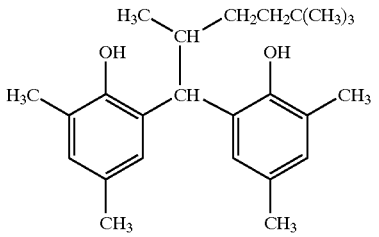

The used amount of reducing agents first represented by the above-mentioned general formula (A) is preferably between $1\times10^{-2}$ and 10 moles per mole of silver, and is most preferably between $1\times10^{-2}$ and 1.5 moles.

Binders suitable for the thermally developable photosensitive material to which the present invention is applied are transparent or translucent, and generally colorless. Binders are natural polymers, synthetic resins, and polymers and copolymers, other film forming media; for example, gelatin, gum arabi, poly(vinyl alcohol), hydroxyethyl cellulose, cellulose acetate, cellulose acetatebutylate, poly(vinyl pyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile, copoly(styrene-butadiene, poly (vinyl acetal) series (for example, poly(vinyl formal)and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic.

In the present invention, the additional amount of the binder in a photosensitive layer is preferably between 1.5 and 6.0 g/m$^2$, and is more preferably between 1.7 and 5.0 g/m$^2$.

In the present invention, a matting agent is preferably incorporated into the photosensitive layer side. A polymer matting agent or an inorganic matting agent is preferably incorporated in an amount of 0.5 to 10 percent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent.

The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below.

(Standard deviation of grain diameter)/(average grain diameter)×100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface.

Addition methods of the matting agent according to the present invention include those in which a matting agent is previously dispersed into a coating composition and is then coated, and prior to the completion of drying, a matting agent is sprayed. When a plurality of matting agents are added, both methods may be employed in combination.

A photosensitive material according to the present invention can comprise hydrazine compounds, and preferable hydrazine compounds are described in Research Disclosure, Item 23516 (November 1983 Issue, page 346) and publications cited therein. In addition to the hydrazine compounds described in the above-mentioned publications, listed can be those described in U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769; U.K. Patent No. 2,011,391B; European Patent Nos. 217310, 301,799, and 356,898; and Japanese Patent Publication Open to Public Inspection Nos. 60-179734, 61-170733, 61-270744, 62-178246, 62-270948, 63-29751, 63-32538, 63-104047, 63-121838, 63-129337, 63-223744, 63-234244, 63-234245, 63-234246, 63-294552, 63-306438, 64-10233, 1-90439, 1-100530, 1-105941, 1-105943, 1-276128, 1-280747, 1-283548, 1-283549, 1-285940, 2-2541, 2-77057, 2-139538, 2-196234, 2-196235, 2-198440, 2-198441, 2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524, and 9-160164, etc.

The addional amount of the hydrazine compound is preferably in the range of $10^{-6}$ to $10^{-1}$ mole per mole of silver halide and is most preferably in the range of $10^{-5}$ to $10^{-2}$ mole.

The hydrazine compound used in the present invention may be dissolved in a suitable organic solvent such as, for example, alcohols (methanol, ethanol, propanol, and fluorinated alcohol), ketones (acetone, methylethyl ketone), dimethylformamide, dimethyl sulfoxide, methyl cellosolve, etc. and then added to the present inventive photosensitive material. Furthermore, according to a well known emulsion dispersion method, the hydrazine compound is dissolved in an oil such as dibutyl phthalate, tricresyl phthalate, glyceryl triacetate or diethyl phthalate, etc., with aid of an auxiliary solvent such as ethyl acetate, cyclohexane, etc., and the thus obtained mixture is mechanically dispersed to result in producing an emulsified dispersion containing said hydrazine compound to be employed for practical use. In addition to the method mentioned above, according to a known method as a solid dispersion method, powders of said hydrazine compound is added to water, and the thus obtained mixture is dispersed using a ball mill, a colloid mill or an ultrasonic homogenizer to result in producing a solid dispersion containing said hydrazine compound to be employed for practical use. In this invention, indazoles (e.g. nitroindazole), which is one of antifoggants, is preferably used in combination with the hydrazine compound.

In this invention, a neucleation accelerating agent such as an amine derivative, an onium salt compound and a hydroxylamine derivative can be used in combination with the hydrazine compound.

The thermally developable photosensitive material, to which the present invention is applied, is stable at normal temperatures and is developed, after exposure, when heated up to high temperatures (for example, from 80° C. to 140° C.). Upon heating, silver is formed through an oxidation-reduction reaction between the organic silver salt (functioning as an oxidizing agent) and the reducing agent. This oxidation-reduction reaction is accelerated by the catalytic action of a latent image formed in the silver halide through exposure. Silver formed by the reaction with the organic silver salt in an exposed area yields a black image, which contrasts with an unexposed area to form an image. This reaction process proceeds without the further supply of a processing solution such as water, etc. from outside.

The thermally developable photosensitive material, to which the present invention is applied, comprises a support having thereon at least one photosensitive layer, and the photosensitive layer may only be formed on the support. Further, at least one nonphotosensitive layer is preferably formed on the photosensitive layer. The photosensitive layer may be composed of a plurality of layers. Furthermore, for gradation adjustment, in terms of sensitivity, layers may be constituted in such a manner as a fast layer/slow layer or a slow layer/fast layer. Various types of additives may be incorporated into any of a photosensitive layer, a nonphotosensitive layer, or other formed layers. Surface active agents, antioxidants, stabilizers, plasticizers, UV absorbers, covering aids, etc. may be employed in the thermally developable photosensitive material to which the present invention is applied.

Image color control agents are preferably incorporated into the thermally developable photosensitive material to which the present invention is applied. Examples of suitable image color control agents are disclosed in Research Disclosure Item 17029. Preferred image color control agents include phthalazone or phthalazine.

In the photosensitive material to which the present invention is applied, employed can be sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, November 1978), 1831, Section X (page 437, August 1978). Specifically, tricarbocyanines described in JP-A Nos. 59-191032, 60-80841, and dicarbocyanines having a 4-quinoline nucleous represented by the formula (IIIa) and (IIIb) described in JP-A Nos. 59-192242, 3-67242 are advantageously employed. Furthermore, sensitizing dyes described in JP-A Nos. 4-182639, 5-341432, 7-13295, Japanese Patent Examined Publication Nos. 6-52387, 3-10931, U.S. Pat. No. 5,441,866 are preferably used so that the present inventive photographic material can be exposed to infrared laser beam light sources of which wavelength is not less than 750 nm, and additionally not less than 800 nm. These sensitizing dyes may be used singly or in combination of them, and combined usage of these sensitizing dyes are specifically often used for the purpose of super sensitization. Other dyes which do not have spectral sensitizing effect, or compounds which do not substantially absorb visible light, but exhibit super sensitizing effect, can be contained in an emulsion along with the sensitizing dyes.

The dyes used in the present invention can be synthesized according to the method described in U.S. Pat. No. 4,508,811, as well as by the following procedure. According to these methods, derivatives of these dyes can easily be synthesized by a skilled person in this art.

Exemplified synthesizing method will be shown below, but the present invention is not limited thereto.

EXAMPLES

Exemplified synthesizing methods will be shown below, but the present invention is not limited thereto. The chemical structures of compounds including intermediate compounds were confirmed by NMR spectrum and MASS spectrum.

Example 1

Exemplified compound P-1

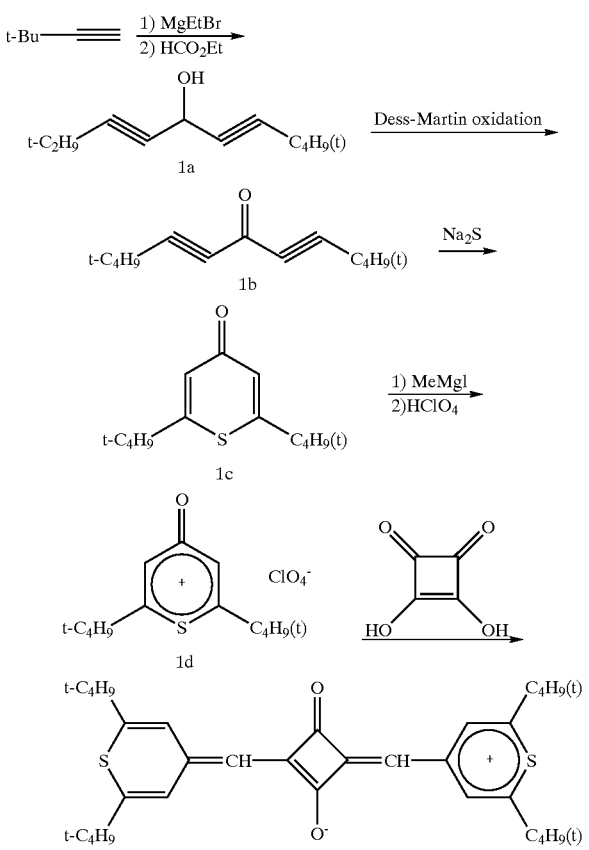

While diethyl ether containing 6.1 g of magnesium metal powder, which was cooled with ice water, was stirred under nitrogen atmosphere, in said diethyl ether solution was dripped 25.2 g of ethyl iodide, after which, into the thus obtained solution, was dripped 20 g of tert-butylacetylene. After that, the thus obtained mixture was stirred for 3 hours at room temperature. Subsequently, the ice water was used again to cool the mixture, to which was added 9.0 g of ethyl formate, and after that, to the thus obtained mixture were added 50 ml of diethyl ether and 80 ml of 6 N hydrochloric acid. Organic compounds were extracted from the reaction products, and the thus obtained organic phase was washed with water and concentrated under reduced pressure to produce a residue, which was purified through silica gel column chromatography to give 32.8 g of 2,6-di-tert-butyl-1,4-pentadiine-3-ol, 1a, at a yield of 70%.

66 g of Dess-Martin periodinane, prepared according to the method described in The Journal of Organic Chemistry, vol. 58, page 2899 (1993) and disclosed by Ireland et. al., was dissolved in 400 ml of methylene chloride. To the thus obtained solution was added 300 ml of ethylene chloride containing 30 g of 2,6-di-tert-buthyl-1,4-pentadiine-3-ol. The thus obtained mixture was stirred at room temperature for 3 hours. To the thus obtained reaction mixture were added 1000 ml of diethyl ether and 1500 ml of 1 N sodium hydroxide aqueous solution, after which the organic phase was separated from the water phase. Said organic phase was washed with water and concentrated under reduced pressure to produce a residue, which was purified through silica gel column chromatography to yield 23.7 g of 2,6-di-tert-butyl-1,4-pentadiine-3-one, 1b, at a yield of 80%.

To 240 ml of ethanol solution of 0.5 M sodium ethoxide were added 15 g of 2,6-di-tert-butyl-1,4-pentadiine-3-one and 18 g of sodium sulfide 18 hydrate, after which, the thus obtained mixture was stirred at room temperature for 3 hours. The reaction mixture was poured into 400 ml of water, and the organic products were exracted with methylene chloride. The exracted organic phase was washed with water and concentrated under reduced pressure to produce a residue, which was purified through silica gel chromatography to give 11.3 g of 2,6-di-tert-butyl-4H-thiopyran-4-one, 1c, at a yield of 64% yield.

10 g of 2,6-di-tert-butyl-4H-thiopyran-4-one was dissolved in 150 ml of diethyl ether, after which, to the thus obtained solution was added 20 ml of diethyl ether solution of 1 M methyl iodide magnesium under a nitrogen atmosphere, while said solution was cooled with ice water. The thus obtained mixture was stirred at room temperature for 3 hours to hasten the reaction. After that, the reaction mixture was poured into 700 ml of saturated ammonium chloride aqueous solution, and the separated organic phase was extracted. To the thus separated organic phase was added 100 ml of 60% perchloric acid aqueous solution, after which the thus obtained mixture was allowed to stand over a night so as to precipitate a crystallized product which was filtered to obtain 9.3 g of perchloric acid adduct of 2,6-di-tert-butyl-4-methyl-4H-thiopyrylium, 1d, at a yield of 55%.

8.0 g of perchloric acid adduct of 2,6-di-tert-butyl-4-methyl-4H-thiopyrylium and 1.4 g of squaric acid were dispersed in a solvent mixture of 50 ml of 1-buthanol and 50 ml of toluene, after which, to the thus obtained mixture was added 1.0 g of quinoline. After that, the thus obtained mixture was refluxed by heating for 2 hours, and then, the reaction mixture was concentrated to produce a residue, to which was added 200 ml of toluene, and subsequently any insoluble substances were filtered out. The filtrate was concentrated under reduced pressure to produce a residue, which was recrystallized from acetonitrile to give 3.9 g of exemplified compound at a yield of 60% (the total yield, including the above-mentioned 5 steps, being 9.6%).

Example 2

Exemplified compound P-24

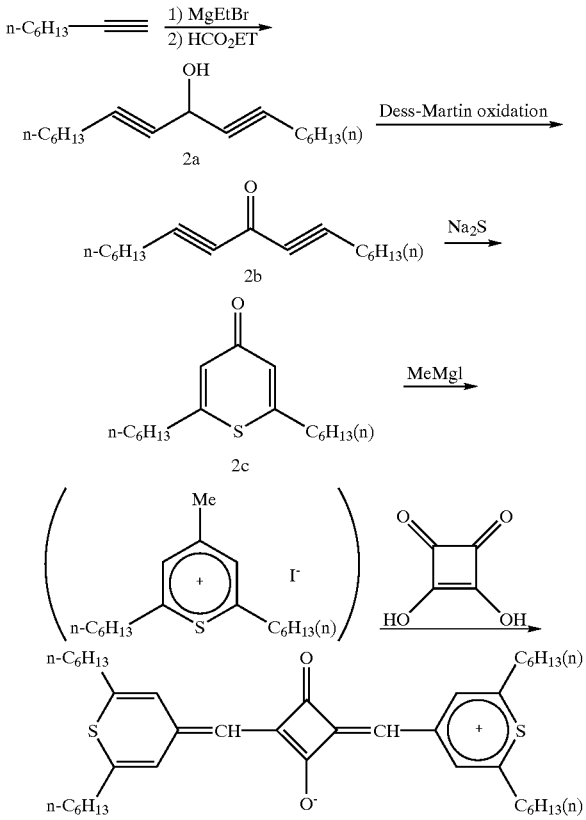

While 170 ml of tetrahydrofuran solution of 1 M ethyl bromide magnesium was cooled with ice water, into said solution was dripped 50 ml of tetrahydrofuran containing 20 g of 1-octyne. After completion of the dripping, the reaction mixture was stirred at room temperature for another 3 hours, after which, the reaction mixture was cooled again with ice water, and into the thus treated reaction mixture was dripped 6.7 g of ethyl formate. After the dripping, to the thus obtained reaction mixture were added 50 ml of tetrahydrofuran and 60 ml of 6 N hydrochloric acid. Organic compounds were extracted from the reaction products, and the thus obtained organic phase was washed with water and concentrated under reduced pressure to produce a residue, which was purified through silica gel column chromatography to give 16.6 g of heptadeca-7,10-diine-9-ol, 2a, at a yield of 85%. The chemical structure of the compound, 2a, was confirmed by NMR spectrum, MASS spectrum, IR spectrum and gas chromatography.

20.5 g of Dess-Martin periodinane prepared according to the previously mentioned method described in The Journal of Organic Chemistry, vol. 58, page 2899 (1993) and disclosed by Ireland et. al., was dissolved in 150 ml of methylene chloride. The thus obtained solution was stirred at room temperature. To the thus treated solution was added 50 ml of ethylene chloride containing 12.0 g of heptadeca-7,10-diine-9-ol, and the thus obtained solution was stirred at room temperature for 3 hours. To the reaction mixture were added 300 ml of diethyl ether and 500 ml of 1 N sodium hydroxide to extract organic compounds. The separated organic phase was washed with water and concentrated to produce a residue, which was purified through silica gel column chromatography to give 9.5 g of heptadeca-7,10-diine-9-one, 2b, at a yield of 85%.

To 35 ml of acetonitrile were added 7.0 g of heptadeca-7,10-diine-9-one and an aqueous solution consisting of 14.0 g of sodium sulfide 9 hydrate, along with 35 ml of water, and the thus obtained mixture was stirred at room temperature for 30 min. After that, the reaction mixture was left undisturbed to allow the water phase to separate from the organic phase. To the organic phase was added 80 ml of saturated ammonium chloride aqueous solution and 30 ml of ethyl acetate to extract the organic compounds. The thus obtained organic phase was washed with water and concentrated under reduced pressure to produce a residue, which was purified through silica gel column chromatography to give 5.5 g of 2,6-di-n-hexyl-4H-thiopyran-4-one, 2c, at a yield of 69%.

4.0 g of 2,6-di-hexyl-4H-thiopyran-4-one was dissolved in 100 ml of diethyl ether. While the thus obtained solution was cooled with ice water, to said solution was added 16 ml of diethyl ether solution of 1 M methyl iodide magnesium under a nitrogen atmosphere, after which, the thus obtained mixture was stirred at room temperature for 3 hours. To the reaction mixture was added 500 ml of saturated ammonium chloride aqueous solution, after which, organic compounds were exracted and the separated organic phase was washed with water and dried with sodium sulfate anhydride. After that, the organic phase was concentrated under reduced pressure. The concentrated organic phase was employed in the following synthetic process without purification.

The reaction product obtained in the previous process and 0.75 g of squaric acid were dispersed in 60 ml of 1-propanol, and the thus obtained mixture was refluxed for 4 hours by stirring and heating. The reaction mixture was cooled and concentrated under reduced pressure to produce a residue, which was recrystallized from 20 ml of methanol and the thus obtained crystals were further recrystallized from 6 ml of ethyl acetate to give 1.8 g of exemplified compound P-24 (the yield of these 2 steps, including the above-mentioned step and the present step being 40%, while the total yield, of the above-mentioned 5 steps, being 19.9%).

Example 3

Exemplified compound P-25

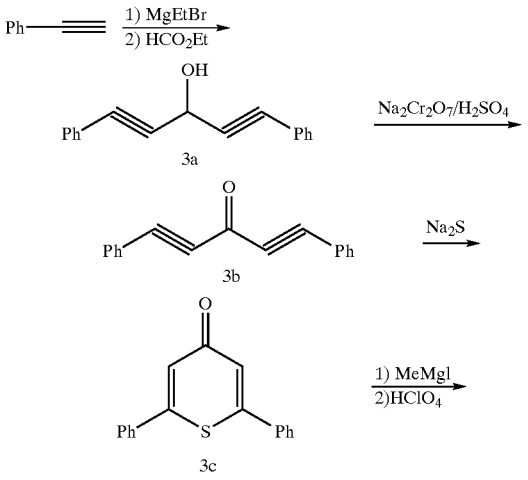

-continued

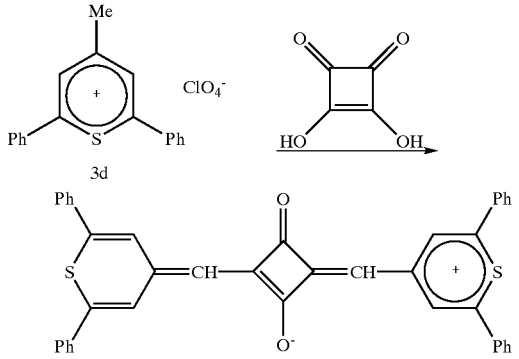

While 185 ml of tetrahydrofuran solution of 1 M ethyl bromide magnesium was cooled with ice water under a nitrogen atmosphere, into said solution was dripped 50 ml of tetrahydrofuran containing 20 g of phenyl acetylene. After completion of dripping, the reaction mixture was stirred at room temperature for 3 hours, after which, into said solution, which was cooled again with ice water, was dripped 7.3 g of ethyl formate. After completion of dripping, to the reaction mixture was added 50 ml of tetrahydrofuran, and then, into the thus treated solution was dripped 60 ml of 6 N hydrochloric acid. After that, organic compounds were extracted from the reaction products and the separated organic phase was washed with water and concentrated to precipitate a residue which was crystallized from hexane to give 16.4 g of 1,5-diphenyl-1,4-pentadiine-3-ol, 3a, at a yield of 72%. Its chemical structure was confirmed by NMR spectrum, MASS spectrum, IR spectrum, and gas chromatography.

11.2 g of 1,5-diphenyl-1,4-pentadiine-3-ol was dissolved in 50 ml of acetone, and then, while the thus obtained mixture was cooled with ice water, into said solution was dripped 400 ml of aqueous solution containing 9.0 of sodium dichromate and 12.0 g of sulfuric acid. After completion of dripping, the reaction mixture was poured into 300 g of crushed ice, after which, organic compounds were extracted, and then the separated organic phase was washed with water and concentrated to precipitate a residue, which was purified through silica gel chromatography to give 7.4 g of 1,5-diphenyl-1,4-pendadiine-3-one, 3b, at a yield of 67%.

To 50 ml of ethanol solution of 0.5 M sodium ethoxide were added 7.0 g of 1,5-diphenyl-1,4-pentadiine-3-one and 14 g of sodium sulfide 9 hydrate, and the thus obtained mixture was stirred at room temperature for 3 hours. The mixture was poured into 300 ml of water, after which, organic compounds were extracted with methyl chloride from the thus treated mixture. The separated organic phase was washed with water and concentrated under reduced pressure to precipitate a residue, which was purified through silica gel chromatography to give 5.1 g of 2,6-diphenyl-4H-thiopyran-4-one, 3c, at a yield of 64%.

4.0 g of 2,6-diphenyl-4H-thiopyran-4-one was dissolved in 100 ml of diethyl ether. While the thus obtained solution was cooled with ice water under a nitrogen atmosphere, into said solution was dripped 21 ml of diethyl ether solution of 1 M methyl iodide magnesium, after which, the thus obtained mixture was stirred at room temperature for 3 hours. The thus obtained reaction mixture was poured into 500 ml of saturated ammonium chloride aqueous solution, and then, organic compounds were extracted. To the thus separated organic phase was added 100 ml of 60% perchloric acid aqueous solution, after which, the thus obtained mixture was allowed to stand over a night so as to give a crystallized product which was filtered to obtain 3.7 g of perchloric acid adduct of 2,6-diphenyl-4-methyl-4H-thiopyrylium, 3d, at a yield of 54%.

3.0 g of perchloric acid adduct of 2,6-diphenyl-4-methyl-4H-thiopyrylium and 0.93 g of squaric acid were dispersed in a solvent mixture consisting of 50 ml of 1-buthanol and 50 ml of toluene, after which, 1.2 g of quinoline was added to the thus treated mixture, and subsequently, the thus obtained mixture was refluxed by heating for 2 hours. After the reaction mixture was cooled and concentrated to produce a residue, to which was added 200 ml of toluene, after which the insoluble substances were filtered out. The filtrate was concentrated under reduced pressure to produce a residue, which was recrystallized from acetonitrile to give 3.2 g of exemplified compound P-25 at a yield of 65% (the total yield, including the above-mentioned 5 steps, being 10.8%).

Example 4

Exemplified compound P-26

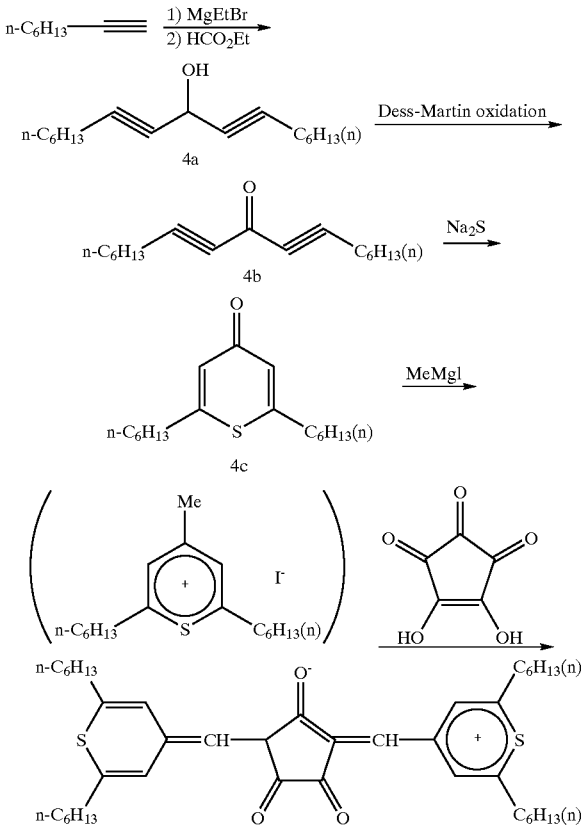

While 85 ml of tetrahydrofuran solution of 1 M ethyl bromide magnesium was cooled with ice water, into said solution was dripped 25 ml of tetrahydrofuran containing 10 g of 1-octyne. After completion of the dripping, the reaction mixture was stirred at room temperature for still another 3 hours, after which the reaction mixture was cooled again with ice water, and to the thus treated reaction mixture was dripped 3.4 g of ethyl formate. After dripping, to the thus obtained reaction mixture were added 25 ml of tetrahydrofuran and 30 ml of 6 N hydrochloric acid. Organic compounds were extracted from the reaction products, and the thus obtained organic phase was washed with water and concentrated under reduced pressure to leave a residue, which was purified through silica gel column chromatography to give 8.2 g of heptadeca-7,10-diine-9-ol, 4a, at a yield of 73%. The chemical structure of the compound, 4a, was confirmed by NMR spectrum, MASS spectrum, IR spectrum and gas chromatography.

12.8 g of Dess-Martin periodinane prepared according to the previously mentioned method described in The Journal of Organic Chemistry, vol. 58, page 2899 (1993) and disclosed by Ireland et. al., was dissolved in 80 ml of methylene chloride. To the thus treated solution was added 50 ml of ethylene chloride containing 7.5 g of heptadeca-7,10-diine-9-ol, and the thus obtained solution was stirred at room temperature for 3 hours. To the reaction mixture were added 200 ml of diethyl ether and 300 ml of 1 N sodium hydroxide to extract organic compounds. The separated organic phase was washed with water and concentrated to produce a residue, which was purified through silica gel column chromatography to give 6.1 g of heptadeca-7,10-diine-9-one, 4b, at a yield of 82%.

To 30 ml of acetonitrile were added 6.0 g of heptadeca-7,10-diine-9-one and an aqueous solution consisting of 12.0 g of sodium sulfide 9 hydrate and 30 ml of water, and the thus obtained mixture was stirred at room temperature for 30 min. After that, the reaction mixture was left undisturbed to allow the water phase to separate from the organic phase. The water phase was removed, and then, to the remaining organic phase were added 50 ml of saturated ammonium chloride aqueous solution and 30 ml of ethyl acetate to extract the organic compounds. The thus obtained organic phase was washed with water and concentrated under reduced pressure to produce a residue, which is purified through silica gel column chromatography to give 4.5 g of 2,6-di-n-hexyl-4H-thiopyran-4-one, 4c, at a yield of 66%.

4.0 g of 2,6-di-n-hexyl-4H-thiopyran-4-one was dissolved in 100 ml of diethyl ether. While the thus obtained solution was cooled with ice water, to said solution was added 16 ml of diethyl ether solution of 1 M methyl iodide magnesium under a nitrogen atmosphere, after which, the thus obtained mixture was stirred at room temperature for 3 hours. To the reaction mixture was added 500 ml of saturated ammonium chloride aqueous solution, after which organic compounds were exracted and the separated organic phase was washed with water and dried with sodium sulfate anhydride. After that, the organic phase was concentrated under reduced pressure. The concentrated organic phase was employed in the following synthetic process without purification.

The reaction product obtained in the previous process and 0.92 g of croconic acid were dispersed in a solvent mixture consisting of 30 ml of 1-buthanol and 30 ml of toluene, and to the thus obtained mixture was added 0.1 g of quinoline after which the thus treated mixture was refluxed for 4 hours by stirring and heating. After that, the reaction mixture was cooled and concentrated under reduced pressure to produce a residue, which was purified through silica gel column chromatography and recrystallized to give 1.6 g of exemplified compound P-26 (the yield of the 2 steps including the above-mentioned step and the present step being 34%, and the total yield, including the above-mentioned 5 steps, being 13.4%).

Example 5-1

(Preparation of Silver Halide Grains)

In 900 ml of water, 7.5 g of gelatin and 10 mg of potassium bromide were dissolved. After adjusting the temperature to 35° C. and the pH to 3.0, 370 ml of an aqueous solution, containing 74 g of silver nitrate, and an aqueous solution, containing potassium bromide and potassium iodide (in a mole ratio of 96/4), were added over a period of 10 min., employing a controlled double-jet method while maintaining the pAg at 7.7. Subsequently, 0.3 g of 4-hydroxy-6-methyl-1,3,3a,7-tetraazaindene was added and the pH was adjusted to 5 using NaOH. Thus, obtained was cubic silver iodobromide grains having an average grain size of 0.06 $\mu$m, a projection diameter area variation coefficient of 8 percent, and a [100] plane ratio of 86 percent. The resulting emulsion was subjected to desalting through coagulation precipitation employing an coagulant. After that, 0.1 g of phenoxyethanol was added, and the pH and pAg were adjusted to 5.9 and 7.5 respectively to obtain a silver halide emulsion. Subsequently, to the thus obtained silver halide emulsion were added a sensitizing dye, SD-1, in an amount of $5\times10^{-5}$ mol per mol of silver halide, and 0.44 g/m$^2$ of 2-(4-chlorobenzoyl)benzoic acid, and while keeping the temperature of the thus treated silver halide emulsion at 60° C., to said silver halide emulsion was added 2 mg of sodium thiosulfate. The thus obtained silver halide emulsion was subjected to chemical sensitization for 100 min. at 60° C., after which the thus treated silver halide emulsion was cooled to 38° C. so that the chemical sensitization was terminated. Thus, silver halide grains were obtained.

SD-1

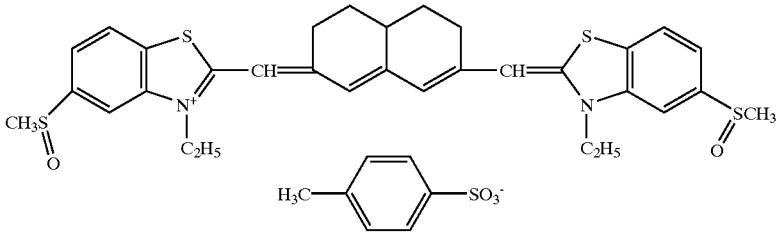

(Preparation of Organic Fatty Acid Silver Emulsion)

300 ml of water containing 10.6 g of behenic acid was heated up to 90° C. to dissolve the behenic acid. While sufficiently being stirred, to the thus obtained solution was added 31.1 ml of 1N NaOH, and the solution was then stirred for an additional hour, after which the solution was cooled down to 30° C. While being stirred sufficiently, to the solution were added 7.0 ml of 1N phosphoric acid and 0.01 g of N-bromosuccinic acid imide. After that, while being stirred upon heating at 40° C., to the thus obtained solution were added previously prepared silver halide grains in an amount of 10 mol % to silver behenate in terms of silver amount. To the above obtained solution was continuously added 25 ml of 1N silver nitrate aqueous solution for 2 minutes and thus obtained solution was stirred for an additional hour.

To the thus obtained emulsion was added polyvinylbutyral dissolved in ethyl acetate. The emulsion was sufficiently stirred and allowed to stand quietly so that ethyl acetate phase containing the silver behenate and the silver halide grains was separated from water phase. After the water phase was removed, the silver behenate and the silver halide grains were collected employing a centrifuge. After that, to the thus obtained silver behenate and silver halide grains were added 20 g of synthesized Zeorite A-3 (spherical form, produced by Toso Co.) and 22 ml of isopropylalcohol and the thus obtained mixture was allowed to stand for 1 hour and then filtered. Furthermore, to the thus obtained mixture were added 3.4 g of polyvinylbutyral and 23 ml of isopropylalcohol and the resulting mixture was sufficiently stirred at rapid rotational rate and dispersed so that the preparation of an organic fatty acid silver emulsion was completed.

(Photosensitive Layer Composition)

| | |
|---|---|
| Organic fatty acid silver emulsion (in terms of silver amount) | 1.75 g/m$^2$ |
| Bis-acetamidehydrogenbromideperbromide | 0.07 g/m$^2$ |
| Potassium bromide | 0.05 g/m$^2$ |
| 2-mercapto-5-methylbenzimidazole | 0.04 g/m$^2$ |
| 2-tribromomethylsulfonylpyridine | 0.36 g/m$^2$ |
| Hexamethylene-di-isocyanate | 0.16 g/m$^2$ |
| Phthalazine | 0.30 g/m$^2$ |
| 4-methyphthalic acid | 0.14 g/m$^2$ |
| Tatrachlorophthalic acid | 0.10 g/m$^2$ |
| Exemplified compound P-1 | 0.088 g/m$^2$ |

As solvents, methyl ethyl ketone, acetone and methanol were suitably used.

(Surface Protective Layer Composition)

A surface protective layer coating solution was prepared as follows.

| | |
|---|---|
| Cellulose acetate | 2.30 g/m$^2$ |
| Polymethylmethacrylate (particle size: 10 $\mu$m) | 0.02 g/m$^2$ |
| 1,1-bis(2-hydroxy-3,5-dimethylphenyl)-3,5,5-trimethylhexane | $4.8\times10^{-3}$ mol/m$^2$ |
| Benzotriazole | 0.021 g/m$^2$ |
| Silicon dioxide (particle size: 2 $\mu$m) | 0.22 g/m$^2$ |

As solvents, methyl ethyl ketone, acetone and methanol were suitably used.

(Backing Layer Composition)

A backing layer coating solution was prepared as follows.

| | |
|---|---|
| Cellulose acetate | 4 g/m$^2$ |
| Exemplified compound P-1 | 0.019 g/m$^2$ |
| Polymethylmethacrylate (particle size: 10 $\mu$m) | 0.02 g/m$^2$ |

The above-mentioned coating compositions were coated onto a biaxially stretched polyethyleneterephthalate film and dried so as to obtain coating Sample No. 101.

Sample Nos. 102, 103 through 108, and 10A through 10L were obtained in the same manner as that employed in preparing Sample No. 101 except that the dye used for preparing Sample No. 101 was replaced with dyes shown in Table 1. At that time, added amount of said dyes was the same as that of the exemplified compound used in preparing Sample No. 101 in terms of mol.

The thus obtained thermally developable photosensitive material Sample Nos. 101 through 103, 106 through 108, and 10A through 10L were cut into 14×17 inch size sheets. These sheets were exposed to a laser diode capable of generating a 810 nm laser beam, which was inclined at 13 degrees from the vertical plane. After that, these sheets were subjected to thermal development employing a heated drum at 120° C. for 15 sec., and the thus obtained samples were termed Sample Nos. 111 though 113, 116 through 118 and 11A through 11L (see Table 1).

TABLE 1

| Sample No. | Dye | Sample No. after thermal development | Remarks |
|---|---|---|---|
| 101 | Exemplified compound P-1 | 111 | Invention |
| 102 | Exemplified compound P-2 | 112 | Invention |
| 103 | Exemplified compound P-10 | 113 | Invention |
| 106 | Dye C | 116 | Comparison |
| 107 | Dye D | 117 | Comparison |
| 108 | Dye E | 118 | Comparison |
| 10A | Exemplified compound (1)-1 | 11A | Invention |
| 10B | Exemplified compound (1)-12 | 11B | Invention |
| 10C | Exemplified compound (1)-16 | 11C | Invention |
| 10D | Exemplified compound (2)-7 | 11D | Invention |
| 10E | Exemplified compound (2)-16 | 11E | Invention |
| 10F | Exemplified compound (2)-31 | 11F | Invention |
| 10G | Exemplified compound (3,5)-1 | 11G | Invention |
| 10H | Exemplified compound (4,6)-7 | 11H | Invention |
| 10I | Exemplified compound P-16 | 11I | Invention |
| 10J | Exemplified compound P-24 | 11J | Invention |
| 10K | Exemplified compound P-23 | 11K | Invention |
| 10L | Exemplified compound P-26 | 11L | Invention |

In Table 1, comparative dyes illustrated below were used.

(Comparative Dyes)

Comparative dye C

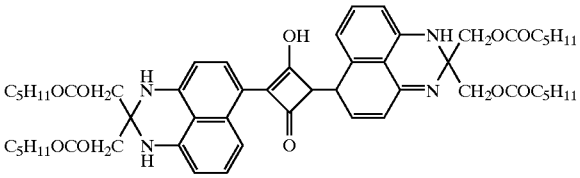

Described in Japanese Patent Publication to Public Inspection under PCT Application No. 2-216140

Comparative dye D

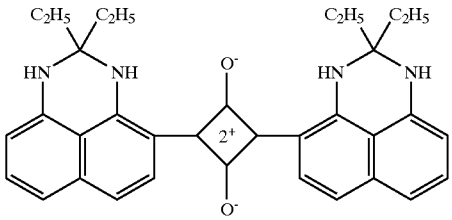

Described in Japanese Patent Publication Open to Public Inspection No. 10-36695

Comparative dye E

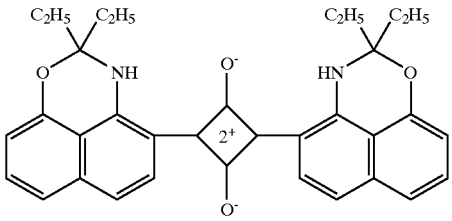

Described in Japanese Patent Publication Open to Public Inspection No. 10-158253

The evaluation of the above obtained samples was conducted according to the following criteria.

[Evaluation of resolution]

MTF (modulation transfer function) at 10 lines/mm of Sample Nos. 111 through 113, 116 through 118, and 11A through 11L was measured, and relative MTF values of Sample Nos. 112, 113, 116 through 118, and 11A through 11L were listed, using an MTF value of Sample No. 111 as 100.

[Residual color stain]

Residual color stain was visually observed and compared. The residual color stain test was conducted under subjective evaluation by ten monitors, and the evaluated results were obtained based on the following criteria.

3: No problem was observed for practical use

1: Problems were observed for practical use, but practical use is allowable under specific conditions of compromise 0: Practical use is entirely unacceptable.

The above-mentioned points which the ten monitors offered were totaled for comparison.

TABLE 2

| Sample No. | Resolution | Residual color stain | Silver image tone | Remarks |
|---|---|---|---|---|
| 111 | 100 | 29 | Acceptable | Invention |
| 112 | 96 | 28 | Acceptable | Invention |
| 113 | 94 | 27 | Acceptable | Invention |
| 116 | 90 | 2 | Unacceptable | Comparison |
| 117 | 60 | 5 | Unacceptable | Comparison |
| 118 | 46 | 5 | Unacceptable | Comparison |
| 11A | 96 | 26 | Acceptable | Invention |
| 11B | 95 | 25 | Acceptable | Invention |
| 11C | 95 | 25 | Acceptable | Invention |
| 11D | 94 | 26 | Acceptable | Invention |
| 11E | 96 | 25 | Acceptable | Invention |
| 11F | 95 | 24 | Acceptable | Invention |
| 11G | 95 | 25 | Acceptable | Invention |

TABLE 2-continued

| Sample No. | Resolution | Residual color stain | Silver image tone | Remarks |
|---|---|---|---|---|
| 11H | 96 | 26 | Acceptable | Invention |
| 11I | 97 | 27 | Acceptable | Invention |
| 11J | 96 | 27 | Acceptable | Invention |
| 11K | 97 | 26 | Acceptable | Invention |
| 11L | 96 | 26 | Acceptable | Invention |

As can be seen from Table 2, the present inventive samples, namely Nos. 111, through 113, 116 through 118, and 11A through 11L offer more excellent characteristics in both resolution and color residual stain. Conversely, the other samples obtained by using the comparative dyes show large absorption in the visible region and unacceptable residual color strain.

Example 5-2

Ten times weight of ethylacetate and ten times weight of tri-cresylphosphate (TCP) were added to a dye, and the thus obtained mixture was subjected to ultrasonic dispersion, while ethylacetate was being removed under reduced pressure, which resulted in an oil dispersion of the dye having an average particle diameter of 90 nm.

Samples were produced in the same manner as that employed in Example 5-1 except that the dye solutions, which were used to obtain Samples Nos. 101 through 103, 106 through 109, and 10A through 10 L were replaced with the oil dispersions of the dyes obtained above. The thus obtained samples were subjected to the same thermal development as that employed in Example 5-1 so as to obtain Sample Nos. 121 through 123, 126 through 128, and 12A through 12L. The evaluation of resolution and residual color stain was conducted in the same manner as that employed in Example 5-1. The obtained results are shown in Table 3.

TABLE 3

| Sample No. | Resolution | Residual color stain | Silver image tone | Remarks |
|---|---|---|---|---|
| 121 | 100 | 29 | Acceptable | Invention |
| 122 | 97 | 28 | Acceptable | Invention |
| 123 | 95 | 27 | Acceptable | Invention |
| 126 | 70 | 15 | Unacceptable | Comparison |
| 127 | 41 | 5 | Unacceptable | Comparison |
| 128 | 42 | 5 | Unacceptable | Comparison |
| 12A | 96 | 27 | Acceptable | Invention |
| 12B | 96 | 26 | Acceptable | Invention |
| 12C | 96 | 25 | Acceptable | Invention |
| 12D | 95 | 25 | Acceptable | Invention |
| 12E | 95 | 26 | Acceptable | Invention |
| 12F | 96 | 24 | Acceptable | Invention |
| 12G | 95 | 26 | Acceptable | Invention |
| 12H | 95 | 25 | Acceptable | Invention |
| 12I | 96 | 27 | Acceptable | Invention |
| 12J | 97 | 26 | Acceptable | Invention |
| 12K | 96 | 26 | Acceptable | Invention |
| 12L | 95 | 26 | Acceptable | Invention |

As can be seen from Table 3, the resolution of the Comparative Sample Nos. 126 through 128 is more inferior, when these comparative dyes are used in the form of an oil dispersion, whereas both the resolution and residual color stain of Inventive Sample Nos. 121 through 123, 126 through 128, and 12A through 12L are surprisingly not deteriorated, even when these inventive dyes are used in the form of an oil dispersion.

Accordingly, as can be seen from Example 5-2, the present inventive dyes exhibit more of the desired effect, when these dyes are employed in the form of an oil dispersion.

Example 5-3

Added to the mixture consisting of a dye, a gelatin aqueous solution, and a sodium dodecylbenzenesulfonate aqueous solution were zirconia beads. The resultant mixture was subjected to ball mill dispersion for 24 hours so that the dye was completely pulverized, after which the zirconia beads were removed, which resulted in producing the dispersion of fine solid particles of the dye having an average particle size of 80 nm.

Samples were produced in the same manner as that employed in Example 5-1 except that the dye solutions, which were used in providing Sample Nos. 101 through 103, 106 through 108, and 10A through 10L were replaced with the fine solid particles dispersions of the dyes obtained above. The thus obtained samples were subjected to the same thermal development as that employed in Example 5-1 so as to obtain Sample Nos. 131 through 133, 136 through 138, and 13A through 13L. The evaluation of resolution and residual color stain was conducted in the same manner as that employed in Example 5-1. The obtained results are shown in Table 4.

TABLE 4

| Sample No. | Resolution | Residual color stain | Silver image tone | Remarks |
|---|---|---|---|---|
| 131 | 100 | 29 | Acceptable | Invention |
| 132 | 98 | 28 | Acceptable | Invention |
| 133 | 94 | 27 | Acceptable | Invention |
| 136 | 42 | 4 | Unacceptable | Comparison |
| 137 | 38 | 4 | Unacceptable | Comparison |
| 138 | 40 | 4 | Unacceptable | Comparison |
| 13A | 96 | 27 | Acceptable | Invention |
| 13B | 96 | 25 | Acceptable | Invention |
| 13C | 95 | 26 | Acceptable | Invention |
| 13D | 96 | 26 | Acceptable | Invention |
| 13E | 95 | 26 | Acceptable | Invention |
| 13F | 96 | 25 | Acceptable | Invention |
| 13G | 95 | 26 | Acceptable | Invention |
| 13H | 96 | 26 | Acceptable | Invention |
| 13I | 97 | 27 | Acceptable | Invention |
| 13J | 97 | 27 | Acceptable | Invention |
| 13K | 96 | 26 | Acceptable | Invention |
| 13L | 96 | 26 | Acceptable | Invention |

A dye was incorporated by blending it with melted polyester, and the resultant mixture was kneaded. The thus obtained mixture was biaxially stretched to obtain a support.

The light-sensitive materials Nos. 401 through 403, 406 through 408, and 40A through 40L were obtained in the same manner as that employed in Example 5-1 except that a support used in Example 5-1 was replaced with the supports in which dyes were incorporated. These samples were exposed and thermally developed in the same manner as that employed in Example 5-1 so as to obtain Sample Nos. 411 through 413, 416 through 418, and 41A through 41L. The evaluation of resolution and residual color stain was conducted in the same manner as that employed in Example 5-1 and the thus obtained results were compared with those obtained in Example 5-1. The obtained results are shown in Table 5.

TABLE 5

| Sample No. | Resolution | Residual color stain | Remarks |
|---|---|---|---|
| 411 | 105 | 29 | Invention |
| 412 | 100 | 28 | Invention |

TABLE 5-continued

| Sample No. | Resolution | Residual color stain | Remarks |
|---|---|---|---|
| 413 | 98 | 27 | Invention |
| 416 | 99 | 3 | Comparison |
| 417 | 26 | 3 | Comparison |
| 418 | 32 | 2 | Comparison |
| 41A | 98 | 27 | Invention |
| 41B | 98 | 26 | Invention |
| 41C | 99 | 26 | Invention |
| 41D | 98 | 27 | Invention |
| 41E | 98 | 26 | Invention |
| 41F | 99 | 25 | Invention |
| 41G | 97 | 26 | Invention |
| 41H | 98 | 26 | Invention |
| 41I | 98 | 28 | Invention |
| 41J | 98 | 27 | Invention |
| 41K | 98 | 27 | Invention |
| 41L | 99 | 27 | Invention |

Example 6

(Preparation of Silver Halide Grains B)

In 700 ml of water, 24 g of phthalated gelatin and 30 mg of potassium bromide were dissolved. After adjusting the temperature to 40° C. and the pH to 5.0, 159 ml of an aqueous solution containing 18.7 g of silver nitrate and an aqueous solution containing potassium bromide and potassium iodide (in a mole ratio of 92/8) were added employing a controlled double-jet method while maintaining the pAg at 7.8, over a period of 10 min.

Subsequently, to the thus obtained solution were added 476 ml of an aqueous solution containing 55.4 g of silver nitrate and an aqueous solution containing 7 μm mol/l of di-potassium iridium hexachloric acid and 1 mol/l of potassium bromide, employing a controlled double-jet method while maintaining the pAg at 7.6, over a period of 30 min., after which, the pH of the solution obtained above was lowered so as to coagulate and precipitate an silver halide emulsion to be desalted. To the thus obtained emulsion was added 0.2 g of phenoxy ethanol, and the pH and the pAg were adjusted to 5.9 and 8.0 respectively. Thus, obtained was cubic silver iodobromide grains having an iodide content of 8% mol in a core portion, an average iodide content of 2% in whole grains, a projection diameter area variation coefficient of 10%, and a [100] plane ratio of 85%.

The temperature of the resulting silver halide grains B was raised to 60° C., and to said silver halide grains B were added sodium thiosulfate in an amount of 85 μm/mol of silver, 2,3,4,5.6-pentafluorophenyldiphenylphosphine selenide in an amount of 6 μm/mol of silver, chloroauric acid in an amount of 3.9 μm/mol of silver, and thiocyanic acid in an amount of 220 μm/mol of silver, and the resulting silver halide grains were ripened for 120 min. After that, the temperature of the thus treated silver halide grains was lowered to 50° C., and to said silver halide grains were added sensitizing dye C in an additional amount of $5\times10^{-4}$ mol/mol of silver, and sensitizing dye D in an additional amount of $3\times10^{-4}$ mol/mol of silver, while said silver halide grains emulsion was stirred. Furthermore, to said silver halide grains emulsion was added potassium iodide in an additional amount of 3.7 mol %/mol of silver. The thus obtained silver halide grains emulsion was stirred for 30 min., after which, the temperature of said silver halide grains emulsion was rapidly lowered to 30° C. Thus, the preparation of silver halide grains was terminated.

Sensitizing dye C

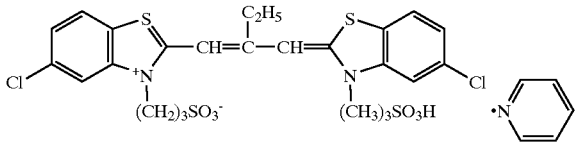

Sensitizing dye D

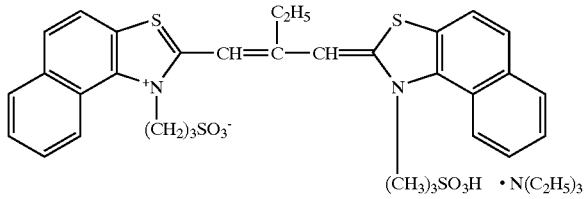

(Preparation of Fine Organic Acid Silver Crystals Dispersion B)

A solution consisting of 40 g of behenic acid, 7.3 g of stearic acid, and 500 ml of water was stirred at 90° C. for 20 min. To the thus obtained solution was added 187 ml of 1N NaOH aqueous solution over a period of 15 min., after which to the thus treated solution was added 61 ml of 1N nitric acid aqueous solution. After that, the temperature of the thus obtained solution was lowered to 50° C.

Subsequently, to said solution was added 124 ml of 1N silver nitrate aqueous solution over a period of 2 min., and then, the thus obtained solution was stirred for additional 40 min. After that, solid components were filtered employing a centrifuge, and the thus obtained solid components were washed with water until the conductivity of the filtrate reached 30 μS/cm. The thus solid components were treated in the form of wet cakes without drying. To said wet cakes, of which dried components content was 33.4 g, were added 12 g of polyvinyl alcohol and 150 ml of water, and the thus obtained mixture was sufficiently mixed to obtain a slurry. Said slurry was placed in a homogenizer (trade name; Microfluidizer M-110-E/H, produced by Microfullindex Co., wall-impact type chamber) and dispersed. At that time, the pressure at impact was 500 kg/cm$^2$. Thus, the fine organic fatty acid silver crystals dispersion was obtained. Said fine organic fatty acid silver crystals dispersion was found to have an average short size of 0.04 μm, an average long size of 0.8 μm, and to be needle grains having a projection area variation coefficient of 35%.

(Preparation of Fine Solid Particles Dispersion of a Reducing Agent)

To 88.5 ml of water were added 10 g of 1,1-bis(2-hydroxy-3,5-dimethylphenyl)-3,5,5-trimethylhexane and 1.5 g of hydroxypropylmethyl cellulose, and the resulting mixture was sufficiently stirred to obtain a slurry. The thus obtained slurry was left undisturbedly for 3 hours, after which, said slurry and 360 g of zirconia beeds having 0.5 mm diameter were placed in a vessel and dispersed employing a homogenizer (¼ G sand grinder mill produced by Eyemex Co.) over a period of 3 hours to produce fine solid particles dispersion of a reducing agent. An average particle size of 80 wt % of said fine solid particles dispersion is between 0.3 μm and 1.0 μm.

(Preparation of Fine Solid Particles Dispersion of an Antifoggant)

To 88.5 ml of water were added 10 g of tribromomethylphenylsulfone and 1.5 g of hydroxypropylmethyl cellulose, and the resulting mixture was sufficiently stirred to obtain a slurry. The thus obtained slurry was left undisturbedly for 3 hours, after which, fine solid particles dispersion of an antifoggant was prepared in the same way as that employed for preparing the fine solid particles dispersion of a reducing agent. An average particle size of 70 wt % of said fine solid particles dispersion is between 0.3 μm and 1.0 μm.

(Preparation of Fine Solid Particles Dispersion of an Image Toner)

To 88.5 ml of water were added 10 g of phthalazine and 1.5 g of hydroxypropylmethyl cellulose, and the resulting mixture was sufficiently stirred. The thus obtained mixture was left undisturbedly for 3 hours, after which, fine solid particles dispersion of an image toner was prepared in the same way as that employed for preparing the fine solid particles dispersion of a reducing agent. An average particle size of 60 wt % of said fine solid particles dispersion is between 0.3 μm and 1.0 μm.

(Preparation of Fine Solid Particles Dispersion of a Development Accelerating Agent)

To 94.3 ml of water were added 5 g of 3,4-dihydro-4-oxo-1,2,3-benzotriazine and 0.7 g of hydroxypropylmethyl cellulose, and the resulting mixture was sufficiently stirred. The thus obtained mixture was left undisturbedly for 3 hours, after which, fine solid particles dispersion of a development accelerating agent was prepared in the same way as that employed for preparing the fine solid particles dispersion of a reducing agent. An average particle size of 70 wt % of said fine solid particles dispersion is between 0.4 μm and 1.0 μm.

(Preparation of an Emulsion Layer Coating Solution)

An emulsion layer coating solution was provided by blending previously prepared fine organic acid silver crystals dispersion B (of which silver amount being equal to a mol of silver), also previously prepared silver halide grains (of which silver amount being equal to 10 mol %/mol of organic acid silver), polymer latex described below, and compounds described below.

| | |
|---|---|
| LACSTAR 3307B (SBR latex, produced by Dainihon Ink Co.) | 431 g |
| 1,1-bis(2-hydroxy-3,5-dimethylphenyl)-3,5,5-trimethylhexane (fine solid dispersion) | 98 g |
| Tribromomethylphenylsulfone (fine solid dispersion) | 21.8 g |
| 3,4-dihydro-4-oxo-1,2,3-benzotriazine (fine solid dispersion | 4.3 g |

(Preparation of an Emulsion Surface Protective Layer Coating Solution)

To 66 ml of water were added 10 g of inert gelatin, 0.26 g of surfactant A, 0.10 g of surfactant B, 1.0 g of fine silica particles (an average particle size being 2.5 μm), 0.4 g of 1,2-(bis-vinylsulfonylacetamide)ethane, and 65 mg of 4-methylphthalic acid, so that a surface protective layer coating solution was prepared.

Surfactant A

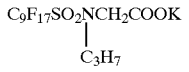

Surfactant B

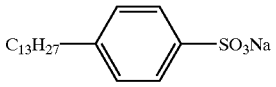

(Preparation of a Dye Dispersion)

To 35 g of ethyl acetate were added 2.5 g of the following compound 1 and 27.5 g of the following compound 2, after which, the resulting mixture was stirred to dissolve these compounds. To the thus obtained mixture was added 50 g of 10 wt % polyvinyl alcohol aqueous solution, and then, the resulting mixture was stirred by the use of a homogenizer. After that, ethyl acetate was evaporated, and the resulting solution was diluted with water, so that the dye dispersion was prepared.

Compound 1

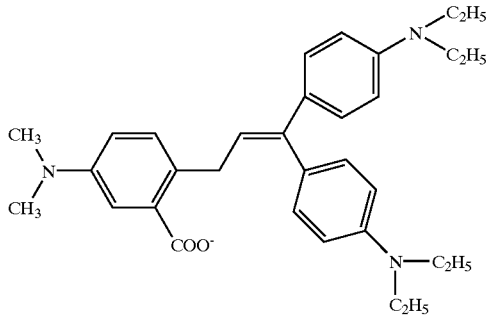

Compound 2

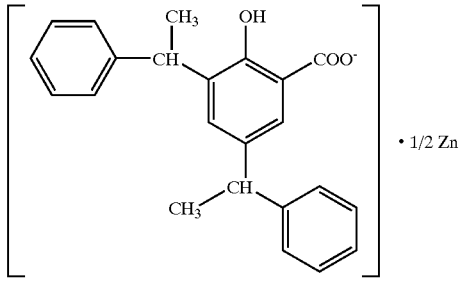

(Preparation of a Backing Layer Coating Solution)

30 g of polyvinyl alcohol were added 51 g of previously prepared dye dispersion, 20 g of compound 3 illustrated below, 250 g of water and 2.0 g of Sildex H121 (sherical silica produced by Dokai Chemical Co., an average particle size being 12 μm), so that a backing layer coating solution was provided.

Compound 3

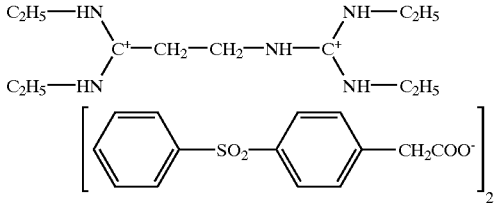

(Preparation of Coating Samples)

Onto a 175 μm thick polyethyleneterephthalate film colored in blue with a blue dye were simultaneously coated the above-mentioned emulsion layer coating solution, and the above-mentioned emulsion surface protective coating solution being coated on said emulsion layer, so that a coated amount of silver of said emulsion layer was 1.8 g/m$^2$ and a coated amount of gelatin of said protective layer was 1.8 g/m$^2$. After drying, the backing layer coating solution was coated on an opposite side to the emulsion layer, so that an optical density was 0.7 at 650 nm, and thus, coating Sample No. 601 was obtained. Other samples were obtained in the same way as that employed for obtaining Sample No. 601 except that the compounds 1 and 2 employed in preparing the dye dispersion mentioned-above were replaced with the dyes shown in Table 6 in an amount being equal to the same mole of that of the compound 1. Thus, the samples shown in Table 6 were obtained.

The obtained samples were exposed by the use of a Kr laser sensitometer, generating a 647 laser beam (the maximum generating power being 550 mW), and being inclined by 30 degrees against a normal line, after which the thus obtained samples were thermally developed at 120° C. for 20 sec. The obtained samples were evaluated in the same way as that employed for the evaluation in Example 5-1. The obtained results were listed in Table 6.

TABLE 6

| Sample No. | Dye | Resolution | Residual color stain | Remarks |
|---|---|---|---|---|
| 601 | Compound 1 | 100 | 5 | Comparison |
| 602 | Exemplified compound P-4 | 160 | 29 | Invention |
| 603 | P-5 | 155 | 27 | Invention |
| 604 | Dye C | 95 | 6 | Comparison |
| 605 | Dye D | 96 | 7 | Comparison |
| 606 | Dye-E | 94 | 6 | Comparison |
| 607 | Exemplified compound (1)-1 | 155 | 26 | Invention |
| 608 | (1)-2 | 150 | 26 | Invention |
| 609 | (1)-3 | 145 | 26 | Invention |
| 610 | (1)-4 | 140 | 25 | Invention |
| 611 | (1)-10 | 140 | 24 | Invention |
| 612 | (3,5)-1 | 135 | 26 | Invention |
| 613 | (3,5)-2 | 137 | 26 | Invention |
| 614 | (3,5)-3 | 138 | 27 | Invention |
| 615 | P-7 | 148 | 26 | Invention |
| 616 | P-9 | 154 | 26 | Invention |
| 617 | P-13 | 150 | 25 | Invention |
| 618 | P-16 | 145 | 26 | Invention |

As can be seen from Table 6, the present inventive samples exhibit excellent resolution and preferable residual color stain.

Example 7

Silver halide grains C was prepared in the same way as that employed in preparing the silver halide grains B provided in Example 6 except that the sensitizing dyes C and D were replaced with the following sensitizing dyes E and F. The evaluation of the photographic characteristics of the thus obtained samples was conducted in the same way as that employed in Example 6 except that the sinsitometer employed in Example 6 was replaced with a laser sensitometor equipped with a diode generating 810 nm laser beam. The used dyes are listed in Table 7. The obtained results are shown in Table 7.

TABLE 7

| Sample No. | Dye | Resolution | Residual color stain, | Remarks |
|---|---|---|---|---|
| 701 | Exemplified Compound P-1 | 100 | 29 | Invention |
| 702 | P-2 | 98 | 28 | Invention |
| 703 | P-10 | 97 | 27 | Invention |
| 704 | Dye C | 35 | 6 | Comparison |
| 705 | Dye D | 36 | 7 | Comparison |
| 706 | Dye-E | 32 | 6 | Comparison |
| 707 | Exemplified compound (1)-2 | 94 | 26 | Invention |
| 708 | (1)-11 | 93 | 26 | Invention |
| 709 | (1)-17 | 93 | 26 | Invention |
| 710 | (2)-7 | 92 | 25 | Invention |
| 711 | (2)-17 | 92 | 24 | Invention |
| 712 | (2)-38 | 91 | 26 | Invention |
| 713 | (3,5)-2 | 92 | 26 | Invention |
| 714 | (4,6)-2 | 92 | 27 | Invention |
| 715 | P-14 | 95 | 26 | Invention |
| 716 | P-23 | 97 | 27 | Invention |
| 717 | P-24 | 97 | 27 | Invention |
| 718 | P-19 | 96 | 27 | Invention |

Sensitizing dye E

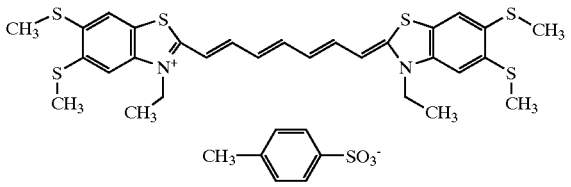

Sensitizing dye F

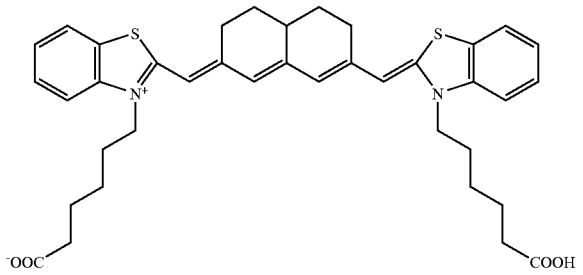

Example 8

(Preparation of Silver Halide Grains α)

In 900 ml of water, 7.5 g of inert gelatin and 10 mg of potassium bromide were dissolved. After adjusting the temperature to 35° C. and the pH to 3.0, 370 ml of an aqueous solution, containing 74 g of silver nitrate, and an aqueous solution, containing potassium bromide and potassium iodide (in a mole ratio of 96/4), and further containing $K_3[Ir(Cl)_6]$, were added over a period of 10 min., employing a controlled double-jet method while maintaining the pAg at 7.7. At that time, additional amount of $K_3[Ir(Cl)_6]$ was $3\times10^{-7}$/mol of silver/mol of silver. Subsequently, 0.3 g of 4-hydroxy-6-methyl-1,3,3a,7-tetraazaindene was added and the pH was adjusted to 5 using NaOH. Thus, obtained was cubic silver iodobromide grains having an average grain size of 0.06 μm, a projection diameter area variation coefficient of 8 percent, and a [100] plane ratio of 87 percent. The resulting emulsion was subjected to desalting through coagulation precipitation employing an coagulant. After that, 0.1 g of phenoxyethanol was added, and the pH and pAg were adjusted to 5.9 and 7.5 respectively.

(Preparation of an Organic Acid Silver Emulsion)

300 ml of distilled water containing 10.6 g of behenic acid was stirred at 90° C. for 15 min., and then, to the thus obtained solution was added 31.1 ml of 1N-NaOH aqueous solution over a period of 15 min., while the thus obtained mixture was sufficiently stirred, after which the thus obtained mixture was left undisturbedly for one hour. After that, the mixture was cooled down to 30° C., and then, to the mixture was added 7 ml of 1N-phosphoric acid. The thus obtained mixture was more sufficiently stirred, and to the mixture was added 0.13 g of N-bromosuccinimido, after which to the thus obtained mixture was added the silver halide grains A prepared previously, so that an additional amount of silver halide was 2.5 mmol. Further, to the thus obtained mixture was added 25 ml of 1N-silver nitrate aqueous solution over a period of 2 min., and the resulting mixture was stirred for 90 min. To the thus obtained aqueous mixture was added 37 g of butyl acetate containing 1.2 wt % polyvinyl acetate, so that blocks of dispersion were formed, from which water was removed, and the thus obtained blocks were subjected to water-washing and water-removing twice. After that, to the thus treated blocks was added 20 g of a mixture solvent consisting of butyl acetate solution containing 2.5 wt % polyvinyl butyral (Denka butyral #3000-K, produced by Denki Kagaku Kogyo Co.) and isopropyl alcohol solution (solution ratio being 1:2), while stirring.

After that, to the thus obtained mixture, in the gel state, consisting of the organic acid silver and the silver halide, were added 7.8 g of polyvinyl butyral (Denka butyral #4000-K, produced by Denki Kagaku Kogyo Co.) and 57 g of 2-butanone, after which the thus obtained mixture was dispersed employing a homogenizer, so that behenic acid silver salt emulsion (needle shape particles having an average short diameter of 0.04 $\mu$m, an average long diameter of 1.0 $\mu$m, and variation coefficient of 30%) was provided.

(Preparation of an Emulsion Layer Coating Solution $\alpha$)

To the above obtained organic acid silver emulsion was added each agent of which additional amount per mol of silver was adjusted to the amount described below. To the organic acid silver emulsion was added at 25° C., 10 mg of sodium phenylthiosulfonate, 25 mg of sensitizing dye AA, 20 mg of sensitizing dye BB, 18 mg of sensitizing dye CC, 2 g of 2-mercapto-5-methylbenzoimidazole, 21.5 g of 4-chlorobenzophenone-2-carboxylic acid, 580 g of 2-butanone, and 220 g of demethylformamide, while stirring, and then, the thus obtained mixture was left undisturbedly for 3 hours. Subsequently, to the thus obtained mixture were added 4 g of 4,6-di-trichloromethyl-2-phenyltriazine, 2 g of di-sulfido compound A, 170 g of 1,1-bis(2-hydroxy-3,5-dimethylphenyl)-3,5,5-trimethylhexane, 5 g of tetrachlorophthalic acid, 15 g of phthalazine, 10 g of hydrazine compound A, 1.1 g of Megafax F-176P (fluorine containing surfactant, produced by Dainihon Ink Kagaku Kogyo Co.), 590 g of 2-butanone, and 10 g of methyl isobutyl ketone, while stirring.

Sensitizing dye AA

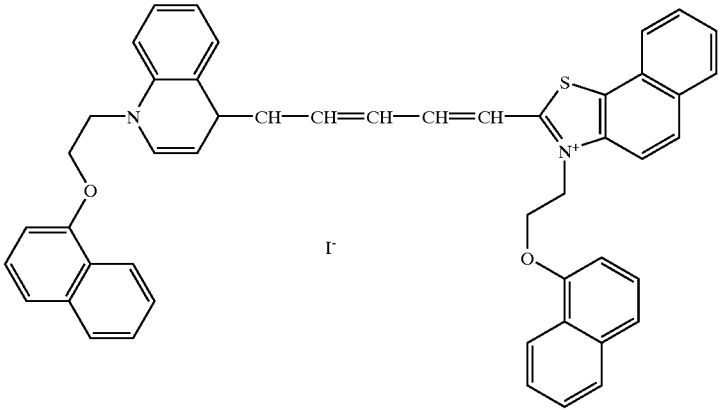

Sensitizing dye BB

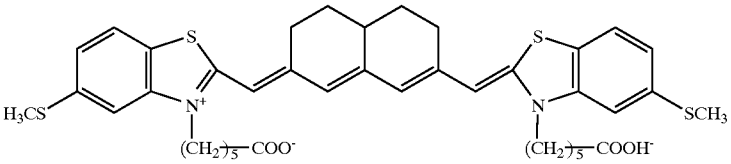

Sensitizing dye CC

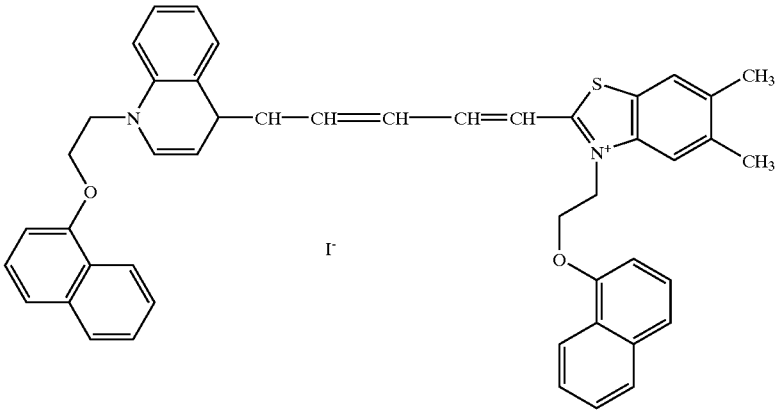

(Preparation of an Emulsion Surface Protective Layer Coating Solution α)

75 g of CAB 171-15S (cellulose acetate butylate, produced by Eastman Chem. Co.), 5.7 g of 4-methylphthalic acid (C-8), 1.5 g of tetrachlorophthalic acid anhydride, 8 g of tri-bromomethylsulfonylbenzene, 6 g of 2-tri-bromomethylsulfonylbenzothiazole, 3 g of phthalazone, 0.3 g of Megafax F-176P, 2 g of Sildex H31 (spherical silica having an average size of 3 μm, produced by Dokal Kagaku Co.), and Sumidur N3500 (polyisocyanate, produced by Sumitomo Bayer Urethane Co.) were dissolved in a mixture consisting of 3070 g of 2-butanone and 30 g of ethyl acetate. Thus the emulsion surface protective layer coating solution α was prepared.

(Preparation of a Support Having a Backing Layer)

6 g of polyvinyl butyral (Denka butyral #4000-2, produced by Denki Kagaku Kogyo Co.), 0.2 g of Sildex H121 (spherical silica having an average size of 12 μm, produced by Dokai Kagaku Co.), 0.2 g of Sildex H51 (spherical silica having an average size of 5 μm, produced by Dokai Kagaku Co.), and 0.1 g of Megafax F-176P were added to 64 g of 2-propanol, while stirring, and dissolved to be blended. Further, to the thus obtained solution were added 410 mg of dye A dissolved in a solvent mixture consisting of 10 g of methanol and 20 g of acetone, and 0.8 g of 3-isocyanatemethyl-3,5,5-trimethylhexylisocyanate dissolved in 6 g of ethyl acetate. Thus, a backing layer coating solution was prepared.

Onto one side of a polyethyleneterephthalate film having moisture-proof sublayers containing vinylidene chloride on its both sides, was coated the above-mentioned backing layer coating solution, so that an optical absorption density at 780 nm was 0.7.

Onto another side of the above-obtained film was coated an emulsion layer coating solution, so that a coated amount of silver was 2 g/m$^2$, after which the emulsion surface protective layer was coated on said emulsion layer, so that a drying thickness was 5 μm. Thus, a thermally developable light-sensitive material, Sample 801, was provided. Samples Nos. 802 through 818 were provided in the same way as that employed for providing Sample 801 except that the dye A was replaced with dyes listed in Table 8 in the equivalent mol to the used mol of the dye A.

Dye-A

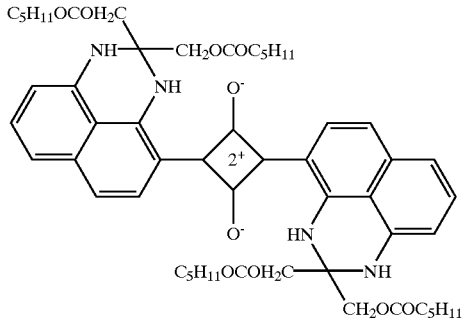

Tellurium compound 1

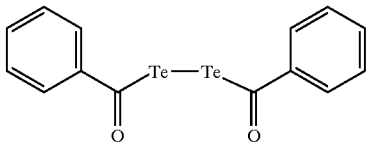

(Exposure, Development)

The thus obtained thermally developable light-sensitive materials were exposed through an interference filter having a peak at 780 nm, using a step wedge, to a xenon flash light of which flashing time was $10^{-4}$ sec., after which said thermally developable light-sensitive materials is developed at 115° C. for 25 sec. After that, the evaluation was conducted.

(Evaluation of the Resolution)

The evaluation of the resolution was conducted in the same way as that employed in Example 1.

(Evaluation of the Residual Color Stain)

The evaluation of the residual color stain was conducted in the same way as that employed in Example 1.

The obtained results are shown in Table 8.

TABLE 8

| Sample No. | Dye | Resolution | Residual color stain | Remarks |
|---|---|---|---|---|
| 801 | Dye A | 100 | 5 | Comparison |
| 802 | Exemplified Compound P-1 | 161 | 29 | Invention |
| 803 | P-10 | 154 | 28 | Invention |
| 804 | Dye C | 86 | 6 | Comparison |
| 805 | Dye D | 88 | 7 | Comparison |
| 806 | Dye-E | 87 | 6 | Comparison |
| 807 | Exemplified compound (1)-1 | 154 | 25 | Invention |
| 808 | (1)-11 | 145 | 25 | Invention |
| 809 | (1)-17 | 147 | 25 | Invention |
| 810 | (2)-7 | 141 | 27 | Invention |
| 811 | (2)-17 | 145 | 24 | Invention |
| 812 | (2)-38 | 137 | 26 | Invention |
| 813 | (3,5)-2 | 140 | 25 | Invention |
| 814 | (4,6)-2 | 139 | 24 | Invention |
| 815 | P-14 | 140 | 28 | Invention |
| 816 | P-23 | 155 | 24 | Invention |
| 817 | P-24 | 149 | 25 | Invention |
| 818 | P-19 | 147 | 27 | Invention |

(Preparation of Silver Halide Grains α)

In 700 ml of water, 22 g of phthalated gelatin and 30 mg of potassium bromide were dissolved. After adjusting the temperature to 40° C. and the pH to 5.0, 159 ml of an aqueous solution containing 18.6 g of silver nitrate, and an aqueous solution containing potassium bromide were added over a period of 10 min., employing a controlled double-jet method while maintaining the pAg at 7.7. Subsequently, to the thus obtained mixture was added an aqueous solution containing $8\times10^{-6}$ mol/l of $K_3[Ir(Cl)_6]$ and 1 mol/l of potassium bromide over a period of 30 min. while maintaining the pAg at 7.7. After that, the pH and pAg were adjusted to 5.9 and 8.0 respectively.

Thus, obtained was cubic silver bromide grains having an average grain size of 0.07 μm, a projection diameter area variation coefficient of 8 percent, and a [100] plane ratio of 86 percent.

The thus obtained silver halide grains β was heated to 60° C., after that, sodium thiosulfate in an additional amount of $8.5\times10^{-5}$ mol/mol of silver, 2,3,4,5,6-pentafluorophenyl-diphenylsulfineselenide in an additional amount of $1.1\times10^{-5}$ mol/mol of silver, chloroauric acid in an additional amount of $3.3\times10^{-6}$ mol/mol of silver, and thiocyanic acid in an additional amount of $2.3\times10^{-4}$ mol/mol of silver were added to said silver halide grains β, after which the thus treated silver halide grains β were ripened for 120 min. After that the temperature was adjusted to 50° C., to the thus obtained emulsion was added sensitizing dye C in an additional amount of $8.0\times10^{-4}$ mol/mol silver, while stirring, and further, to the thus obtained emulsion was added potassium iodide in an additional amount of $3.5\times10^{-2}$ mol, and after that, the thus obtained emulsion was stirred for 30 min., ant rapidly cooled to 30° C. Thus, the preparation of the silver halide grains was terminated.

(Preparation of Fine Organic Acid Silver Crystals Dispersion)

40 g of behenic acid, 7.3 g of stearic acid and 500 ml of distilled water were blended at 90° C. for 15 min., and the thus obtained mixture, to which was added 187 ml of 1N-NaOH aqueous solution over a period of 15 min., while the mixture was vigorously blended, and then, to which was added 61 ml of 1N-nitric acid aqueous solution, was cooled to 50° C. After that, to the thus obtained mixture was added 124 ml of silver nitrate aqueous solution, and the resulting mixture was stirred for additional 30 min. After that, solid components were filtered employing a suction filtration, and the thus obtained solid components were washed with water until the conductivity of the filtrate reached 30 μS/cm. The thus solid components were treated as wet cakes without drying. To said wet cakes, of which dried components content was 33.4 g, were added 12 g of polyvinyl alcohol and 150 ml of water, and the thus obtained mixture was sufficiently mixed to obtain a slurry. Said slurry was placed in a vessel with 840 g of zirconia beads having an average diameter of 0.5 mm, and then, the thus treated slurry was sujected to dispersion for 5 hours, employing a homogenizer (¼ G sand grinder mill produced by Eyemex Co.) Thus, the fine organic fatty acid silver crystals dispersion having a volume-averaged mean particle diameter of 1.5 μm was obtained. Said particle diameter was measured by the use of Master Saizer X produced by Malvern Instruments Co., Ltd.

(Preparation of Fine Solid Dispersions of Raw Materials)

The fine solid dispersions of tetrachlorophthalic acid, 4-methylphthalic acid, 1,1-bis(2-hydroxy-3,5-dimethylphenyl)-3,5,5-trimethylhexane, phthalazine, tribromomethylsulfonylbenzen were prepapered.

10 g of tetrachlorophthalic acid, o.81 g of hydroxypropyl cellulose and 94.2 ml of water were sufficiently blended by stirring to produce a slurry, and the thus obtained slurry was left undisturbed for 10 hours. After that, said slurry was placed in a vessel with 100 g of zirconia beads having an average diameter of 0.5 mm, and then, the thus treated slurry was subjected to dispersion for 5 hours, employing the same homogenizer as that employed for preparing the fine organic acid silver crystals dispersion. Thus, the fine solid crystals dispersion of tetrachlorophthalic acid was obtained. The particle size of 70 wt % of said fine solid particles is not more than 1.0 μm.

Fine solid particles dispersions of other raw materials were obtained by varying a used amount of dispersant and dispersing time, in order to obtain a desired particle size.

(Preparation of an Emulsion Layer Coating Solution)

To the previously prepared fine organic acid silver crystals dispersion were added the following components to obtain an emulsion coating solution.

| | |
|---|---|
| Fine organic acid silver crystals dispersion | 1 mol |
| Silver halide Grains β | 0.05 mol |
| Binder: SBR latex (LACSTAR 3307B produced by Dainihon Ink Co. | 430 g |
| Raw materials for development: | |
| Tetrachlorophthalic acid | 5 g |
| 1,1-bis(2-hydroxy-3,5-dimethylphenyl)-3,5,5-trimethylhexane | 98 g |
| Phthalazine | 9.2 g |
| Tribromomethylphenylsulfone | 12 g |
| 4-methylphthalic acid | 7 g |
| Hydrazine compound A | 7 g |

LACSTAR 3307B was a styrene-butadiene copolymer latex and particle size of the dispersing particles was between 0.1 and 0.15 μm, and an equilibrium water content ratio contained in polymer was 0.6 wt % under conditions of 25° C. and 60% RH Hydrazine compound A

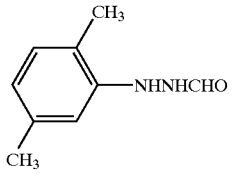

(Preparation of an Emulsion Surface Protective Layer Coating Solution)

The following composition was provided to prepare an emulsion surface protective layer coating solution.

| | |
|---|---|
| Inert gelatin | 10 g |
| Surfactant A | 0.26 g |
| Surfactant B | 0.09 g |
| Fine silica particles (an average size: 2.5 μm) | 0.9 g |
| 1,2-(bisvinylsulfoneacetamide)ethane | 0.3 g |
| Water | 64 g |

Surfactant A

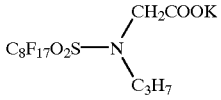

Surfactant B

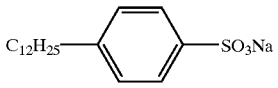

Dye C

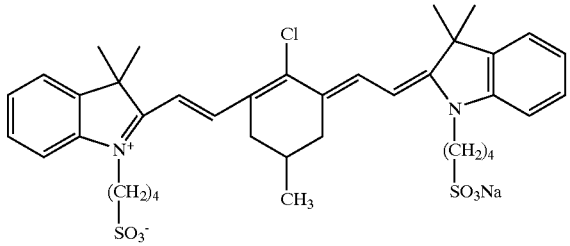

(Preparation of a Backing Layer Coating Solution)

The following composition was prepared to provide a backing layer coating solution.

| | |
|---|---|
| Polyvinyl alcohol | 30 g |
| Dye A | 5 g |
| Water | 250 g |
| Sildex H121 (spherical silica having an average size of 12 μm, produced by Dokal Kagaku Co.) | 1.8 g |

The emulsion layer coating solution prepared above was coated on a polyethyleneterephthalate support, so that a coated amount of silver was 1.6 g/m$^2$. On the thus coated emulsion layer was coated the emulsion surface protective layer coating solution also prepared above, so that a coated amount of gelatin was 1.8 g/m$^2$. After drying, the backing layer coating solution was coated on a back side of the support opposite to said emulsion layer to provide Sample 901, so that an optical density at 780 nm was 0.7. Samples Nos. 902 through 918 were provided in the same way as that employed for providing Sample 101 except that the dye A was replaced with dyes listed in Table 9 in the equivalent mol to the used mol of the dye A.

The thus obtained samples were evaluated in the same way as that employed for evaluating the samples in Example 9. The obtained results are shown in Table 9.

TABLE 9

| Sample No. | Dye | Resolution | Residual color stain | Remarks |
|---|---|---|---|---|
| 901 | Dye A | 100 | 5 | Comparison |
| 902 | Exemplified Compound P-1 | 166 | 29 | Invention |
| 903 | P-10 | 155 | 28 | Invention |
| 904 | Dye C | 86 | 6 | Comparison |
| 905 | Dye D | 87 | 7 | Comparison |
| 906 | Dye-E | 86 | 6 | Comparison |
| 907 | Exemplified compound (1)-1 | 145 | 25 | Invention |
| 908 | (1)-11 | 154 | 25 | Invention |
| 909 | (1)-17 | 149 | 16 | Invention |
| 910 | (2)-7 | 145 | 27 | Invention |
| 911 | (2)-17 | 150 | 24 | Invention |
| 912 | (2)-38 | 138 | 17 | Invention |
| 913 | (3,5)-2 | 141 | 25 | Invention |
| 914 | (4,6)-2 | 140 | 15 | Invention |
| 915 | P-14 | 144 | 25 | Invention |
| 916 | P-23 | 144 | 24 | Invention |
| 917 | P-24 | 150 | 26 | Invention |
| 918 | P-19 | 147 | 27 | Invention |

Example 10

(Preparation of Silver Halide Grains)

In 900 ml of deionized water, 7.5 g of gelatin and 10 mg of potassium bromide were dissolved. After adjusting the temperature to 35° C. and the pH to 3.0, 370 ml of an aqueous solution containing 74 g of silver nitrate and an aqueous solution containing potassium bromide and potassium iodide (in a mole ratio of 96/4) were added employing a controlled double-jet method while maintaining the pAg at 7.7, over a period of 10 min. Subsequently, 0.3 g of 4-hydroxy-6-methyl-1,3,3a,7-tetraazaindene as added and the pH was adjusted to 5 using NaOH. Thus, obtained was cubic silver iodobromide grains having an average grain size of 0.06 $\mu$m, a projection diameter area variation coefficient of 8 percent, and a [100] plane ratio of 86 percent. The resulting emulsion was subjected to desalting through coagulation precipitation employing an coagulant. After that, 0.1 g of phenoxyethanol was added, and the pH and pAg were adjusted to 5.9 and 7.5 respectively to obtain a silver halide emulsion. Subsequently, to the thus obtained silver halide emulsion were added a sensitizing dye, SD-1, in an amount of $5\times10^{-5}$ mol per mol of silver halide, and 0.44 g/m$^2$ of 2-(4-chlorobenzoyl)benzoic acid, and while keeping the temperature of the thus treated silver halide emulsion at 60° C., to said silver halide emulsion was added 2 mg of sodium thiosulfate. The thus obtained silver halide emulsion was subjected to chemical sensitization for 100 min. at 60° C., after which the thus treated silver halide emulsion was cooled to 38° C. so that the chemical sensitization was terminated. Thus, the silver halide grains were obtained.

(Preparation of Organic Fatty Acid Silver Emulsion)

300 ml of water containing 10.6 g of behenic acid was heated up to 90° C. to dissolve the behenic acid. While sufficiently being stirred, to the thus obtained solution was added 31.1 ml of 1N NaOH, and the solution was then stirred for an additional hour, after which the solution was cooled down to 30° C. While being stirred sufficiently, to the solution were added 7.0 ml of 1N phosphoric acid and 0.01 g of N-bromosuccinic acid imide. After that, while being stirred by heating at 40° C., to the thus obtained solution were added previously prepared silver halide grains in an amount of 10 mol % to silver behenate in terms of silver amount. To the above obtained solution was continuously added 25 ml of 1N silver nitrate aqueous solution over a period of 2 minutes and thus obtained solution was left undisturbedly for one hour.

To the thus obtained emulsion was added polyvinyl butyral dissolved in ethyl acetate. The emulsion was sufficiently stirred and left undisturbedly so that ethyl acetate phase containing the silver behenate and the silver halide grains was separated from water phase. After the water phase was removed, the silver behenate and the silver halide grains were collected employing a centrifuge. After that, to the thus obtained silver behenate and silver halide grains were added 20 g of synthesized Zeorite A-3 (spherical form, produced by Toso Co.) and 22 ml of isopropylalcohol and the thus obtained mixture was undisturbedly left over a period of 1 hour and then filtered. Furthermore, to the thus obtained mixture were added 3.4 g of polyvinyl butyral and 23 ml of isopropylalcohol and the resulting mixture was sufficiently stirred at rapid rotational rate and dispersed so that the preparation of an organic fatty acid silver emulsion was completed.

(Photosensitive Layer Composition)

| | |
|---|---|
| Organic fatty acid silver emulsion (in terms of silver amount) | 1.75 g/m$^2$ |
| Pyridiumhydrobromideperbromide | 0.07 g/m$^2$ |
| Potassium bromide | 0.05 g/m$^2$ |
| 2-mercapto-5-methylbenzimidazole | 0.04 g/m$^2$ |
| 2-tribromomethylsulfonylquinoline | 0.36 g/m$^2$ |
| Hexamethylene-di-isocyanate | 0.16 g/m$^2$ |
| Phthalazine | 0.30 g/m$^2$ |
| 4-methyphthalic acid | 0.14 g/m$^2$ |
| Tatrachlorophthalic acid | 0.10 g/m$^2$ |

As solvents, methyl ethyl ketone, acetone and methanol were suitably used.

(Surface Protective Layer Composition)

A surface protective layer coating solution was prepared as follows.

| | |
|---|---|
| Cellulose acetate | 2.30 g/m$^2$ |
| Polymethylmethacrylate (particle size: 10 $\mu$m) | 0.02 g/m$^2$ |
| 1,1-bis(2-hydroxy-3,5-dimethylphenyl)-3,5,5-trimethylhexane | $4.8\times10^{-3}$ mol/m$^2$ |
| Exemplified compound 1 | 0.024 g/m$^2$ |
| Benzotriazole | 0.021 g/m$^2$ |
| Silicon dioxide (particle size: 2 $\mu$m) | 0.22 g/m$^2$ |

As solvents, methyl ethyl ketone, acetone and methanol were suitably used.

(Backing Layer Composition)

A backing layer coating solution was prepared as follows.

| | |
|---|---|
| Cellulose acetate | 4 g/m$^2$ |
| Exemplified compound 1 | 0.019 g/m$^2$ |
| Polymethylmethacrylate (particle size: 10 $\mu$m) | 0.02 g/m$^2$ |

The above-mentioned coating compositions were coated onto a biaxially stretched polyethyleneterephthalate film and dried so as to obtain coating Sample No. 1101. Sample Nos. 1102 through 1109 were obtained in the same manner as that employed in preparing Sample No. 1101 except that the exemplified compound 1 used for preparing Sample No. 1101 was replaced with dyes shown in Table 10. At that time, added amount of said dyes was the same as that of the exemplified compound 1 used in preparing Sample No. 1101 in terms of mol.

The thus obtained thermally developable photosensitive material Sample Nos. 1101 through 1109 were cut into 14×17 inch size sheets. These sheets were exposed to a laser diode capable of generating a 810 nm laser beam, which was inclined at 13 degrees from the vertical plane. After that, these sheets were subjected to thermal development employing a heated drum at 120° C. for 15 sec., and the thus obtained samples were termed Sample Nos. 1111 though 1119 (see Table 10).

TABLE 10

| Sample No. | Dye | Sample No. after thermal development | Remarks |
|---|---|---|---|
| 1101 | Exemplified compound 1 | 1111 | Invention |
| 1102 | Exemplified compound 8 | 1112 | Invention |
| 1103 | Exemplified compound 10 | 1113 | Invention |
| 1104 | Dye A | 1114 | Comparison |
| 1105 | Dye B | 1115 | Comparison |
| 1106 | Dye C | 1116 | Comparison |
| 1107 | Dye D | 1117 | Comparison |
| 1108 | Dye E | 1118 | Comparison |
| 1109 | Dye F | 1119 | Comparison |

Comparative dye A (Described in Japanese Patent Publication Open to Public Inspection No. 10-24654)

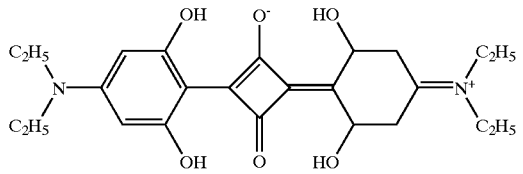

Comparative dye B (Described in Japanese Patent Publication Open to Public Inspection No. 10-24654)

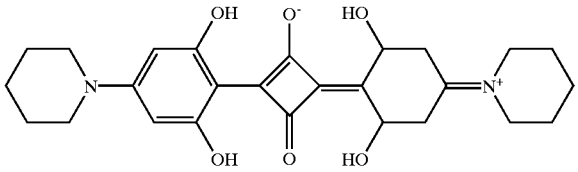

Comparative dye C (Described in Japanese Patent Publication to Public Inspection under PCT Application No. 2-216140)

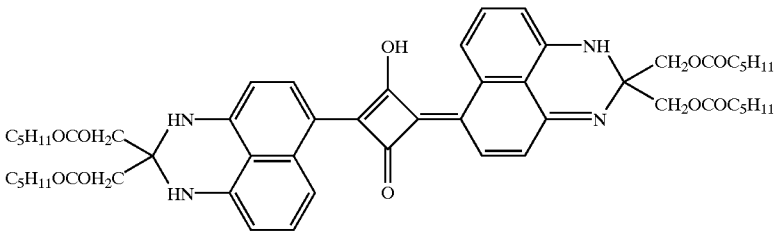

Comparative dye D (Described in Japanese Patent Publication Open to Public Inspection No. 10-36695)

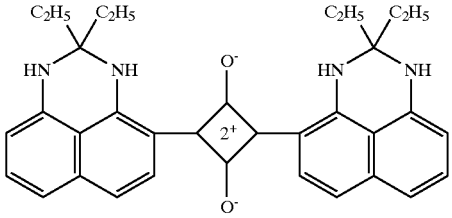

Comparative dye E (Described in Japanese Patent Publication Open to Public Inspection No. 10-158253)

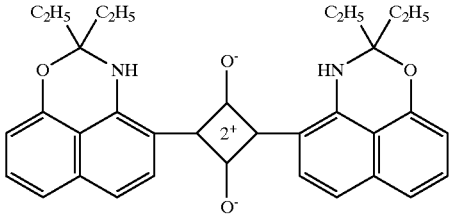

Comparative dye F (Described in Japanese Patent Publication Open to Public Inspection No. 10-24654)

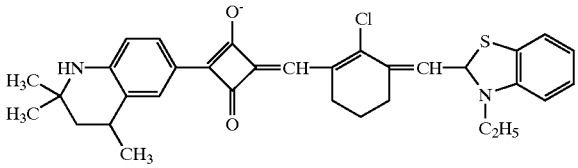

[Evaluation of resolution]

MTF (modulation transfer function) at 10 lines/mm of Sample Nos. 1111 through 1119 was measured, and relative MTF values of Sample Nos. 1112 through 1119 were listed, using an MTF value of Sample No. 1111 as 100.

[Residual color stain]

Residual color stain was visually observed and compared. The residual color stain test was conducted under subjective evaluation by ten monitors, and the evaluated results were obtained based on the following criteria.

3: No problem was observed for practical use

1: Problems were observed for practical use, but practical use is allowable under specific conditions of compromise 0: Practical use is entirely unacceptable.

The above-mentioned points which the ten monitors offered were for comparison.

Obtained results were shown in Table 11.

TABLE 11

| Sample No. | Resolution | Residual color stain | Remarks |
|---|---|---|---|
| 1111 | 100 | 29 | Invention |
| 1112 | 96 | 28 | Invention |
| 1113 | 94 | 27 | Invention |
| 1114 | 31 | 2 | Comparison |
| 1115 | 35 | 5 | Comparison |
| 1116 | 90 | 5 | Comparison |
| 1117 | 60 | 5 | Comparison |
| 1118 | 46 | 5 | Comparison |
| 1119 | 49 | 5 | Comparison |

As can be seen from Table 11, the present inventive Samples namely Nos. 1111, 1112 and 1113 offer more excellent characteristics in both resolution and color residual stain. Conversely, the other samples obtained by using the comparative dyes show large absorption in the visible region and unacceptable residual color stain.

Example 1

Ten times weight of ethylacetate and ten times weight of tri-cresylphosphate (TCP) were added to each dye used in Example 10, and the thus obtained mixture was subjected to ultrasonic dispersion, while ethylacetate was being removed under reduced pressure, which resulted in an oil dispersion of the dye having an average particle diameter of 90 nm.

Samples were produced in the same manner as that employed in Example 10 except that the dye solutions, which were used to obtain Sample Nos. 1101 through 1109, were replaced with the oil dispersions of the dyes obtained above. The thus obtained samples were subjected to the same thermal development as that employed in Example 10 so as to obtain Sample Nos. 1201 through 1209. The evaluation of resolution and residual color stain was conducted in the same manner as that employed in Example 10. The obtained results are shown in Table 12.

TABLE 12

| Sample No. | Resolution | Residual color stain | Remarks |
|---|---|---|---|
| 1201 | 100 | 29 | Invention |
| 1202 | 97 | 28 | Invention |
| 1203 | 98 | 28 | Invention |
| 1204 | 19 | 0 | Comparison |
| 1205 | 21 | 0 | Comparison |
| 1206 | 70 | 15 | Comparison |
| 1207 | 41 | 5 | Comparison |
| 1208 | 42 | 5 | Comparison |
| 1209 | 43 | 5 | Comparison |

As can be seen from Table 12, the resolution of the Comparative Sample Nos. 1204 through 1209 is more inferior, when these comparative dyes are used in the form of an oil dispersion, whereas both the resolution and residual color stain of Inventive Sample Nos. 1201 through 1203 are surprisingly not deteriorated, even when these inventive dyes are used in the form of an oil dispersion. In the case of Sample Nos. 1204 and 1205, precipitation of the dyes was observed to lead to degraded transparency.

Accordingly, as can be seen from Example 11, the present inventive dyes exhibit more of the desired effect, when these dyes are employed in the form of an oil dispersion.

Example 12

Added to the mixture consisting of a dye, a gelatin aqueous solution, and a sodium dodecylbenzenesulfonate aqueous solution were zirconia beads. The resultant mixture was subjected to ball mill dispersion for 24 hours so that the dye was completely pulverized, after which the zirconia beads were removed, which resulted in producing the dispersion of fine solid particles of the dye having an average particle size of 80 nm. Samples were produced in the same manner as that employed in Example 10 except that the dye solutions, which were used in providing Sample Nos. 101 through 109, were replaced with the fine solid particles dispersions of the dyes obtained above. The thus obtained samples were subjected to the same thermal development as that employed in Example 10 so as to obtain Sample Nos. 1311 through 1319. The evaluation of resolution and residual color stain was conducted in the same manner as that employed in Example 10. The obtained results are shown in Table 13.

TABLE 13

| Sample No. | Resolution | Residual color stain | Remarks |
|---|---|---|---|
| 1311 | 100 | 29 | Invention |
| 1312 | 98 | 28 | Invention |
| 1313 | 95 | 27 | Invention |
| 1314 | 15 | 2 | Comparison |
| 1315 | 12 | 3 | Comparison |
| 1316 | 42 | 4 | Comparison |
| 1317 | 38 | 4 | Comparison |
| 1318 | 40 | 4 | Comparison |
| 1319 | 40 | 3 | Comparison |

As can be seen from Table 13, the resolution of the Comparative Sample Nos. 1314 through 1319 is more inferior when these comparative dyes are used in the form of fine solid particles dispersion, whereas both the resolution and residual color stain of Inventive Sample Nos. 1311 through 1313 are surprisingly not deteriorated when these inventive dyes are used in the form of fine solid particles dispersion.

Example 13

The exemplified compound 1, which was added to the backing layer in Example 10, was incorporated in a polyester support. At that time, the incorporated amount of the exemplified compound per unit area was the same as the added amount of that in the backing layer.

A dye was incorporated by blending it with melted polyester, and the resultant mixture was kneaded. The thus obtained mixture was biaxially stretched to obtain a support in the same way as that employed in Example 10

Photosensitive materials Nos. 1401 through 1409 were obtained in the same manner as that employed in Example 10 except that a support used in Example 10 was replaced with supports in which the dyes were incorporated. These samples were exposed and thermally developed in the same manner as that employed in Example 10 so as to obtain Sample Nos. 1411 through 1419. The evaluation of resolution and residual color stain was conducted in the same manner as that employed in Example 10 and the thus obtained results were compared with those obtained in Example 10. The obtained results are shown in Table 14.

TABLE 14

| Sample No. | Resolution | Residual color stain | Remarks |
|---|---|---|---|
| 1411 | 105 | 29 | Invention |
| 1412 | 106 | 28 | Invention |

TABLE 14-continued

| Sample No. | Resolution | Residual color stain | Remarks |
|---|---|---|---|
| 1413 | 98 | 27 | Invention |
| 1414 | 31 | 1 | Comparison |
| 1415 | 90 | 3 | Comparison |
| 1416 | 99 | 3 | Comparison |
| 1417 | 26 | 3 | Comparison |
| 1418 | 32 | 2 | Comparison |
| 1419 | 32 | 2 | Comparison |

As can be seen from Table 14, the present inventive Sample Nos. 1411, 1412 and 1413, which are produced by employing the supports in which the present inventive dyes are incorporated, exhibit more preferable resolution, and furthermore, the residual color stain of these samples is not degraded. On the other hand, some of the comparative samples exhibit improved resolution, however, each comparative sample exhibits unacceptable and unpreferable residual color stain.

Accordingly, from Example 13, the present inventive dyes are considered to exhibit more preferable effects, when these dyes are incorporated in a support.

What is claimed is:

1. A thermally developable silver halide photographic light-sensitive material comprising a dye represented by formula (8), Formula (8)

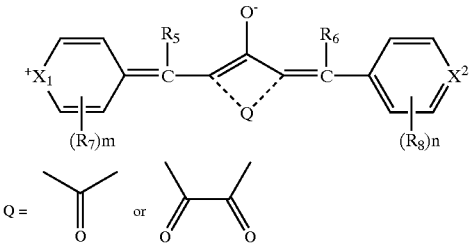

wherein $X_1$ and $X_2$ each represents an oxygen atom, a sulfur atom, a selenium atom, or a tellurium atom; $R_5$ and $R_6$ each represents a hydrogen atom or an alkyl group; $R_7$ and $R_8$ each represents a monovalent substituents, and plural $R_7$ and plural $R_8$ may form a ring structure with each other; m and n each represents an integer of 0 to 4.

2. The thermally developable silver halide photographic light-sensitive material of claim 1, comprising an organic silver salt, a silver halide, and a compound represented by formula (A), Formula (A)

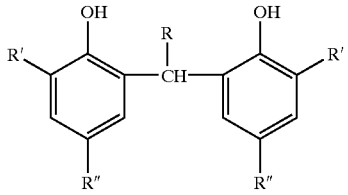

wherein R represents a hydrogen atom or an alkyl group having from 1 to 10 carbon atoms, and R' and R" each represents an alkyl group having from 1 to 5 carbon atoms.

3. The thermally developable silver halide photographic light-sensitive material of claim 1, comprising a water-soluble binder.

4. The thermally developable silver halide photographic light-sensitive material of claim 1, wherein the dye represented by formula (8) is contained in the form of a solid dispersion or an oil dispersion.

5. The thermally developable silver halide photographic light-sensitive material of claim 1, comprising a hydrazine compound.

6. The thermally developable silver halide photographic light-sensitive material of claim 4, wherein the dye in the form of a solid dispersion has an average particle diameter being 0.05 to 3.0 $\mu$m.

7. The thermally developable silver halide photographic light-sensitive material of claim 1, comprising a photosensitive layer, optionally a constitution layer adjacent to the photosensitive layer.

8. The thermally developable silver halide photographic light-sensitive material of claim 7, wherein the photosensitive layer or the constitution layer adjacent to the photosensitive layer contains an hydrazine compound in an amount of $1\times10^{-6}$ to $1\times10^{-2}$ mol per mol of silver halide.

9. The thermally developable silver halide photographic light-sensitive material of claim 7 wherein the photosensitive layer or the constitution layer contains a hydrazine compound in an amount of $1\times10^{-6}$ to $1\times10^{-1}$ mole per mole of silver halide.

10. The thermally developable silver halide photographic light-sensitive material of claim 7 wherein the photosensitive layer or the constitution layer contains a hydrazine compound in an amount of $1\times10^{-5}$ to $1\times10^{-2}$ mole per mole of silver halide.

11. The thermally developable silver halide photographic light-sensitive material of claim 1, comprising a photosensitive layer and a backing layer, wherein the backing layer or the photosensitive layer contains the dye in an amount so that a transmission density at the maximum wavelength of the spectral absorption of the dye is between 0.01 and 3.0.

12. The thermally developable silver halide photographic light-sensitive material of claim 1, wherein the monovalent group represents an alkyl group or an aryl group, and n and m each represents an integer of not more than 2.

13. The thermally developable silver halide photographic light-sensitive material of claim 2, wherein the compound represented by formula (A) is contained in an mount of $1\times10^{-2}$ to 10 mol per mol of silver.

14. The thermally developable silver halide photographic light-sensitive material of claim 1, wherein Q in formula (8) is a linkage of —$CH_2$—CO—$CH_2$—.

15. The thermally developable silver halide photographic light-sensitive material of claim 14, wherein the monovalent group represents an alkyl group or an aryl group, and n and m each represents an integer of not more than 2.

16. The thermally developable silver halide photographic light-sensitive material of claim 1, wherein the dye is selected from the group consisting of P-1 through P-26

P-1

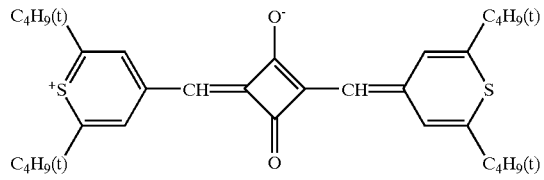

-continued
P-2
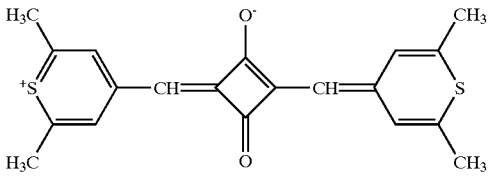
P-3
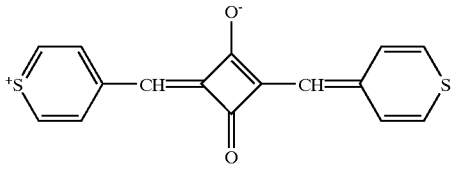
P-4
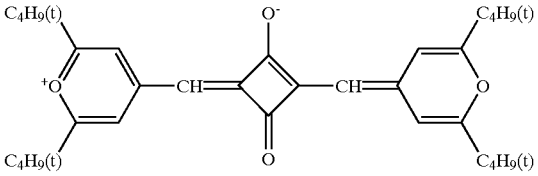
P-5
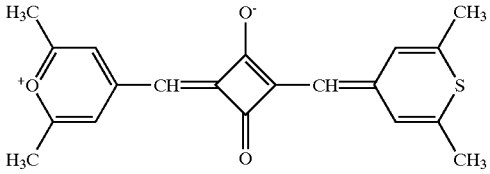
P-6
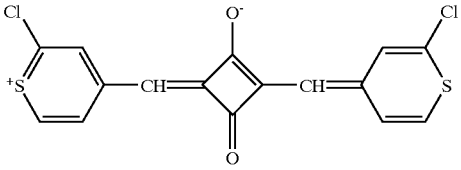
P-7
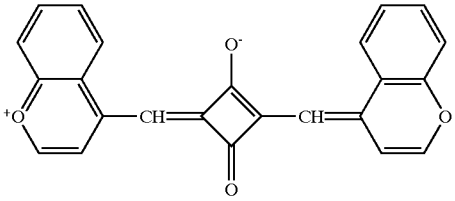
P-8
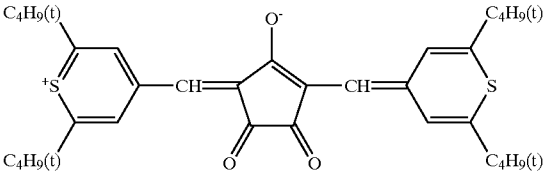
P-9
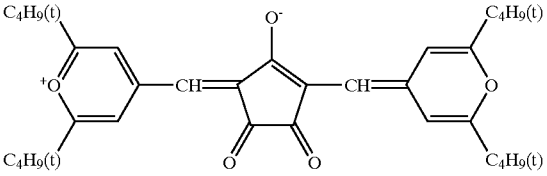
-continued
P-10
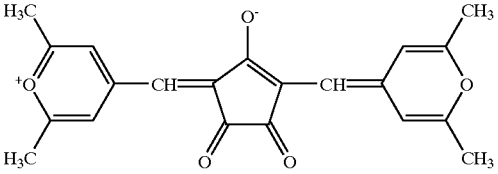
P-11
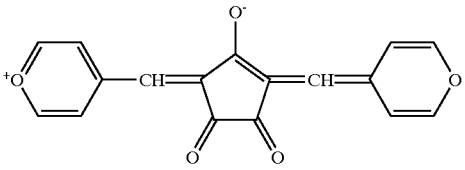
P-12
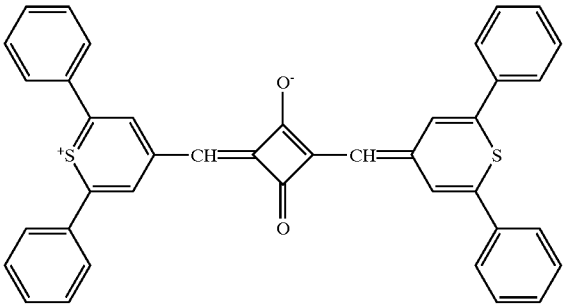
P-13
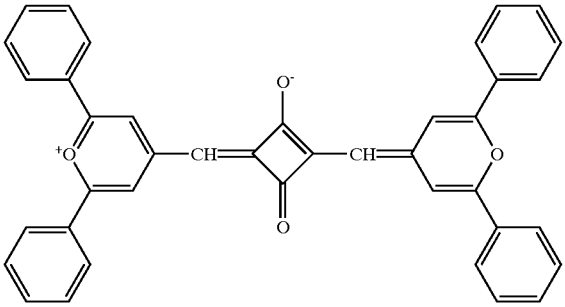
P-14
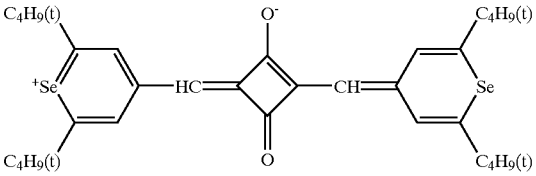
P-15
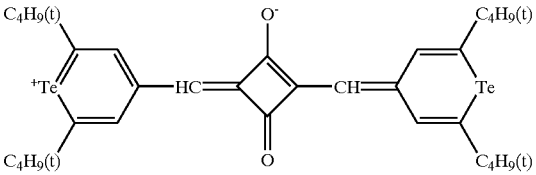
P-16
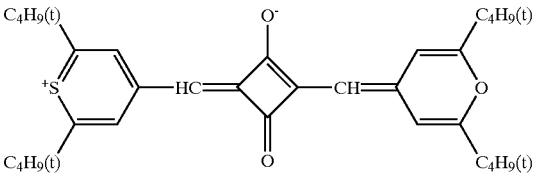

-continued

P-17

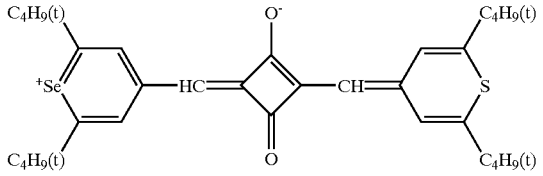

P-18

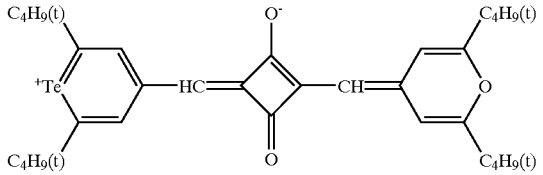

P-19

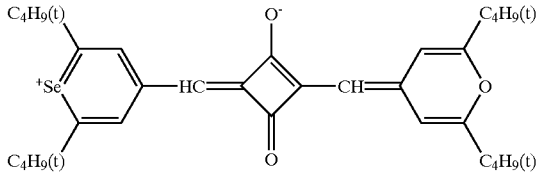

P-20

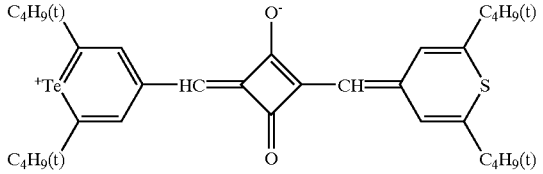

P-21

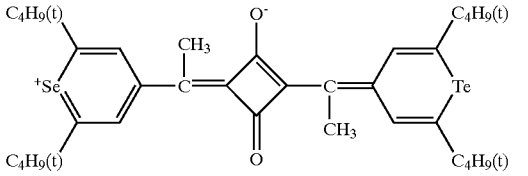

P-22

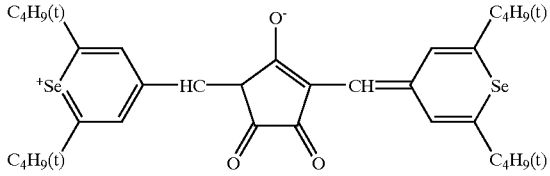

-continued

P-23

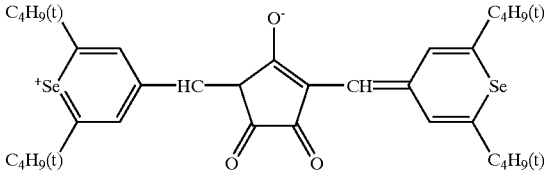

P-24

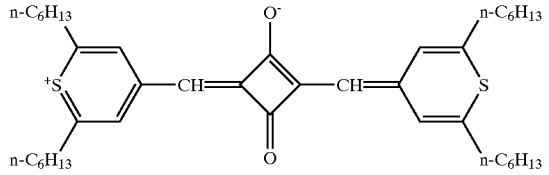

P-25

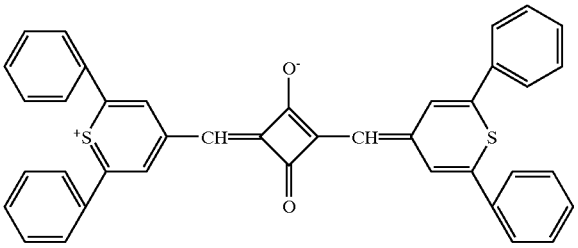

P-26

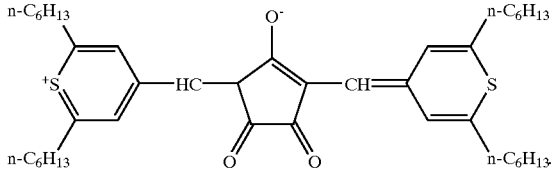

17. The thermally developable silver halide photographic light-sensitive material of claim 16, comprising a photosensitive layer, optionally a constitution layer adjacent to the photosensitive layer and a backing layer, wherein a hydrazine compound is contained in the photosensitive layer or the constitution layer, and the dye is contained in the photosensitive layer or the backing layer.

* * * * *